US005290020A

United States Patent [19]

Matsui et al.

[11] Patent Number: 5,290,020

[45] Date of Patent: Mar. 1, 1994

[54] SHEET FINISHING DEVICE WITH CALCULATING MEANS FOR EFFICIENT OPERATION

[75] Inventors: Toshikazu Matsui, Kishiwada; Takatoshi Nishimura, Hirakata; Kenichi Honda, Kawasaki; Shoichiro Tajima, Sagamihara; Keiichi Asano, Tokyo; Nobukazu Ootsuka, Kashiba; Hiroyuki Nagai, Toyonaka; Yoichiro Irie, Suita; Tooru Himegi; Yoshio Sugishima, both of Osaka, all of Japan

[73] Assignee: Mita Industrial Co., Ltd., Osaka, Japan

[21] Appl. No.: 912,452

[22] Filed: Jul. 13, 1992

[30] Foreign Application Priority Data

| | | | |
|---|---|---|---|
| Jul. 16, 1991 | [JP] | Japan | 3-175276 |
| Nov. 20, 1991 | [JP] | Japan | 3-304920 |
| Nov. 25, 1991 | [JP] | Japan | 3-309193 |
| Nov. 26, 1991 | [JP] | Japan | 3-311054 |
| Mar. 12, 1992 | [JP] | Japan | 4-053832 |

[51] Int. Cl.[5] ..... B42B 2/00; B27F 7/00

[52] U.S. Cl. ..... 270/53; 227/27; 227/111; 355/324

[58] Field of Search ..... 270/53; 355/324; 227/2, 227/27, 111

[56] References Cited

U.S. PATENT DOCUMENTS

| | | | |
|---|---|---|---|
| 4,516,714 | 5/1985 | Braun et al. | 227/111 X |
| 4,925,171 | 5/1990 | Kramer et al. | 270/53 |
| 4,988,030 | 1/1991 | Muramatu et al. | 270/53 X |
| 5,044,625 | 9/1991 | Reid | 270/53 X |
| 5,060,922 | 10/1991 | Sbibusawa et al. | 270/53 |
| 5,088,709 | 2/1992 | Yamamoto | 270/53 |
| 5,100,119 | 3/1992 | Komada et al. | 270/53 |
| 5,131,641 | 7/1992 | Hidaka | 270/53 |

FOREIGN PATENT DOCUMENTS

| | | |
|---|---|---|
| 2-116500 | 1/1990 | Japan . |
| 3-248894 | 6/1991 | Japan . |

*Primary Examiner*—Richard A. Bertsch
*Assistant Examiner*—John Ryznic
*Attorney, Agent, or Firm*—Jordan and Hamburg

[57] ABSTRACT

An automatic sheet processing device mountable on a sorting unit of an image forming apparatus includes a sheet processor for applying a sheet processing to a sheet having a specified length and width, a moving unit capable of supporting the sheet processor for moving the sheet processor along a side of the sheet, and a controller having a storage unit for storing sheet processing data, a calculator for calculating a processing position from the sheet processing data, and a control portion for controlling the moving unit so as to move the sheet processor to the calculated processing position. The processing position is calculated from the stored sheet processing data, and the sheet processor is moved to the calculated processing position, so that sheet processing can be automatically.

21 Claims, 44 Drawing Sheets

2ND MODE

PUNCH TO Q2
S101
BIN BACKWARDS
S102
HOLDER DOWNWARDS
S103
STOPPER RELEASED
S104
PUNCH TO Q3
S105
PUNCHING
S106
PUNCH TO Q4
S107
PUNCHING
S108
PUNCH TO Q5
S109
STOPPER SET
S110
HOLDER UPWARDS
S111
BIN FORWARDS
S112
B
ALL SHEET SETS PROCESSED ?
S113
NO
YES
PUNCH TO Q1
S114
END
DISTANCE TO Q1 SHORTER ?
S115
NO
A
YES
PUNCH TO Q1
S116
BINS SHIFTED ONE STAGE
S117

SHEET FINISHING DEVICE WITH CALCULATING MEANS FOR EFFICIENT OPERATION

BACKGROUND OF THE INVENTION AND RELATED ART STATEMENTS

This invention relates to an automatic sheet finishing device capable of automatically applying finishing such as stapling to a sheet in specified positions thereof.

Binding of a plurality of sheets is generally conducted by stapling the edge-aligned sheets in a desired position at a side portion thereof, or making a hole in such sheets at the side portion thereof and passing a binding material such as a string through the hole. It is apparently effective in binding the sheets more tightly to apply the stapling or like finishing to the sheets in two or more positions at the side portion thereof. These operations have been carried out manually, and have been therefore very cumbersome. Reflecting this, there has been a strong demand for a sheet finishing device capable of automatically carrying out these operations.

In recent years, there have become commercially popular copiers and like image forming apparatus provided with a sorter in which each image of a set of documents is copied onto a plurality of sheets and a series of copy sheets having the same image are automatically sorted into each of a plurality of bin trays. It is apparent that the sheet finishing can be carried out more efficiently with a device capable of automatically stapling and making a hole for binding in the plurality of sheets sorted by such a sorter. Reflecting this, there has been a great demand for an automatic sheet finishing device which is usable in combination with the sorter and capable of automatically carrying out sheet finishing.

SUMMARY OF THE INVENTION

It is an object of the invention to provide a sheet finishing device capable of automatically applying a specified finishing to a sheet in a desired position thereof.

Accordingly, an automatic sheet finishing device of the invention comprises a sheet finisher for applying a sheet finishing to a sheet having a specified length and width, moving means capable of supporting the sheet finisher for moving the sheet finisher along a side of the sheet, control means including storage means for storing sheet finishing data, calculator means for calculating a finishing position from the sheet finishing data, and a first control portion for controlling the moving means so as to move the sheet finisher to the calculated finishing position.

Also, the moving means may be constructed by a support for supporting the sheet finisher, and a first drive transmission mechanism for moving the support in a widthwise direction of the sheet.

Further, the support may be constructed by a base member connected to the first drive transmission mechanism, a mount member movable over the base member for supporting the sheet finisher and a second drive transmission mechanism provided on the base member for moving the sheet finisher in a lengthwise direction of the sheet.

Further, the support may be provided with a mount member for detachably supporting a plurality of sheet finishers.

Further, the control means may be provided with position detector means for detecting positions of the plurality of sheet finisher supported on the support, determinator means responsive to the position detector means and the calculator means for determining a sequence of finishing positions at which the plurality of sheet finishers are to be stopped for sheet finishing while being moved in one widthwise direction of the sheet, and a second control portion for controlling the moving means so as to move the plurality of sheet finishers in accordance with the sequence of finishing positions determined by the determinator means.

Further, a punch may be used as the sheet finisher, and container means is provided to contain waste produced by the punch.

Further, the control means may be provided with discriminator means for discriminating which is shorter of a first distance between a first movable limit of the sheet finisher and a last stopping position of the sheet finisher and a second distance between a second movable limit of the sheet finisher and the last stopping position, and a third control portion responsive to the discriminator means for controlling the moving means so as to move the sheet finisher to nearer one of the first and second movable limits after the sheet finishing is completed.

Further, the automatic sheet finishing device may be further provided with a mount member for mounting the moving means on a sorting unit of an image forming apparatus.

Further, the automatic sheet finishing device may be used for the sorting unit having a plurality of bin trays movable in a vertical direction for holding sheets, and a bin tray moving mechanism for moving the plurality of bin trays in the vertical direction, and may be provided with a fourth control portion for controlling the moving means so as to stay the sheet finisher at the last finishing position for the sheet on one bin tray after the sheet finishing for the sheet on one bin tray is completed, and move the sheet finisher to that one of the plurality of finishing positions for the sheet on the next bin tray which is closer to the last finishing position for the sheet on the one bin tray.

With the above constructions, the finishing position is calculated from the stored sheet processing data, and the sheet processor is moved to the calculated processing position. Accordingly, the sheet processing can be automatic.

Also, the support is movable in the width direction or length direction of sheet. Accordingly, the sheet finishing can be applied for an increased area of a sheet.

Further, the sheet finisher is detachably mounted on the support. Consequently, an increased number of sheet finishing can be applied.

Further, the respective sheet finishings of the plurality of sheet finishers mounted on the support are executed in accordance with the determined sequence while the support is moved in one widthwise direction of the sheet. Accordingly, sheet finishings can be executed at high efficiency. Also, the sheet finisher is moved to nearer one of the first and second movable limits after the sheet finishing is completed. Accordingly, sheet finishings can be applied for a reduced time.

Further, the moving means is mounted on a sorting unit of an image forming apparatus by the mount member. Accordingly, sets of copy sheets into which the sorting unit automatically sorts can be further automatically applied with sheet finishings.

Further, when sheet processing is applied to copy sheet sets on a plurality of bin trays, the movement of the sheet finisher is controlled in taking into consideration the finished position of the sheet finisher for the previous bin tray and a finishing position for the next bin tray. Consequently, the movement of the sheet finisher can be performed at improved efficiency.

These and other objects, features and advantages of the present invention will become more apparent upon a reading of the following detailed description and accompanying drawings.

DETAILED DESCRIPTION OF PREFERRED EMBODIMENTS OF THE INVENTION

Sheet processing devices in accordance with the invention will be described with reference to the accompanying drawings. In the following embodiments, description will be given with respect to a case where an automatic sheet finishing device of the invention is mounted in a sorting unit of an image forming apparatus.

Figure 1:
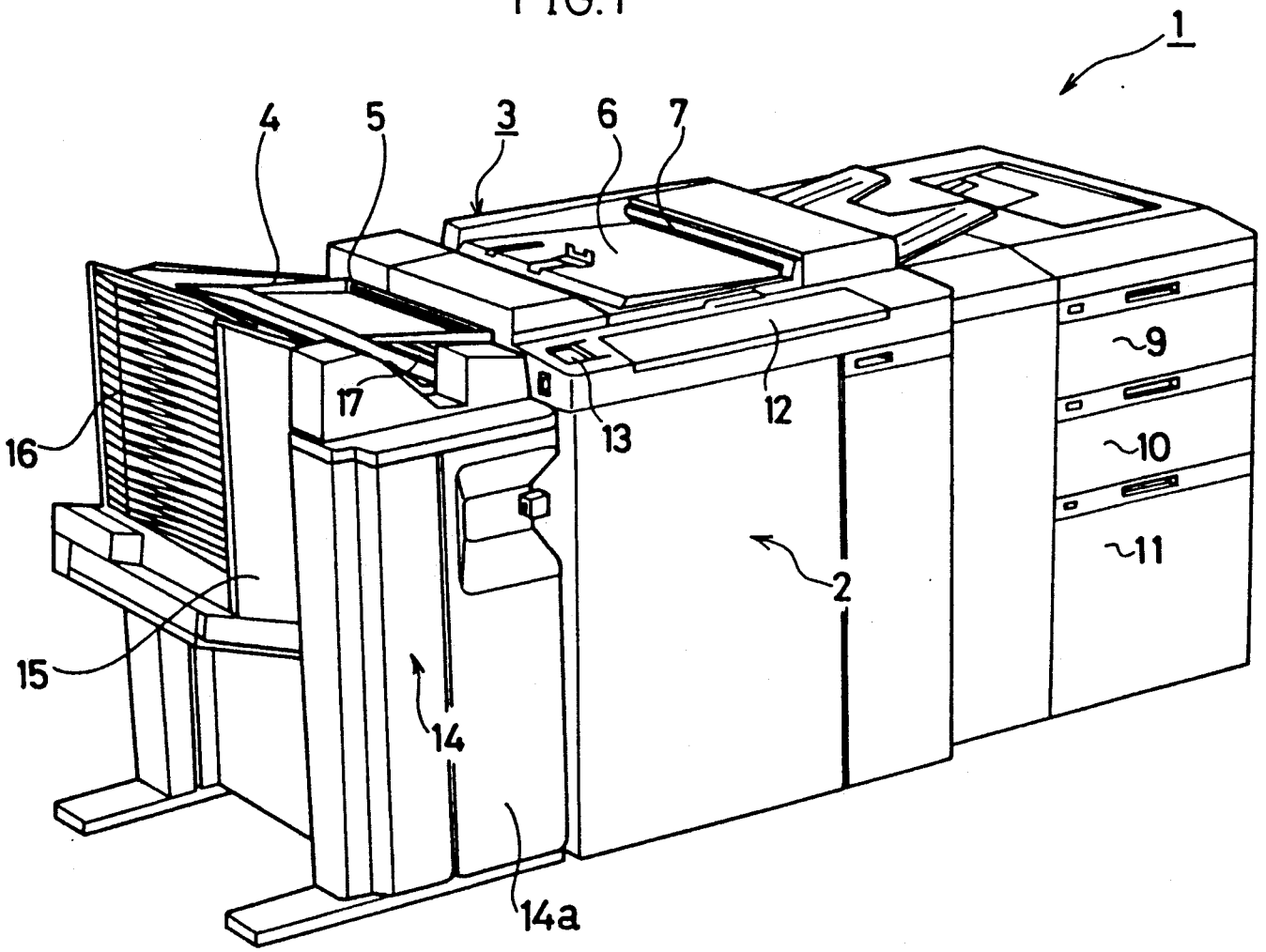
FIG. 1 is a perspective view of an image forming apparatus incorporating an automatic sheet finishing device in accordance with the invention.

FIG. 1 is a perspective view showing an exterior of an image forming apparatus 1 incorporating the automatic sheet finishing device of the invention.

The apparatus 1 is provided with an image forming unit 2 and a sorting unit 14. On a center portion of an upper surface of the image forming unit 2 is placed an unillustrated document platen.

The image forming unit 2 is internally provided with an optical system for optically scanning a document image, an imaging assembly including a photosensitive drum and peripheral devices thereof for forming an image, transport assembly for transporting a copy sheet and the like. A document to be copied is placed face down on the document platen, and an image thereof is optically scanned by the optical system. Light reflected from a document surface is projected onto a surface of the photosensitive drum, and thereby an electrostatic latent image is formed thereon. The formed latent image is developed into a toner image, which is in turn transferred onto a copy sheet. The transferred toner image is fixed to the copy sheet in a fixing unit.

Indicated at 3 is an automatic document feeder for feeding documents one by one automatically. The document feeder 3 is provided with a document holding tray 4, insertion opening 5, document transport assembly 6, and document discharge tray 7. Documents placed on the document holding tray 4 are automatically fed one by one through the insertion opening 5 and transported to a specified position on the document platen by the transport assembly 6. The document has its transport temporarily stopped at the specified position, and then discharged onto the discharge tray 7 after a copying operation.

Cabinets 9, 10, and 11 are designed to contain copy sheets therein. Various sized copy sheets are allowed to be set in these cabinets. An operation panel 12 is provided with various buttons and switches which are manipulated to designate specific operations of the image forming apparatus. These buttons and switches include a copy start button, copy sheet size key to designate the size of copy sheets to be used, and switches to designate a number of copies to be made from the same document. A selection key panel 13 is provided for selecting a desired sheet finishing and includes a sorter mode selection key, sheet finishing selection key which is manipulated to select a desired sheet finishing such as stapling and punching, and the like.

The sorting unit 14 is provided with a door 14*a*, which is openably and closably mounted to a main body of the sorting unit 14. With the door 14*a* open, a first sheet finishing device 30 of the invention to be described later is withdrawable from the sorting unit 14. A sorter 15 is adapted for sorting copy sheets, and includes a plurality of bin trays 16 vertically arranged. Copy sheets are sequentially discharged onto the bin trays 16 in the case where they are sorted. On the other hand, the copy sheets are discharged onto a discharge tray 17 in the case where they are not sorted.

Figure 2:
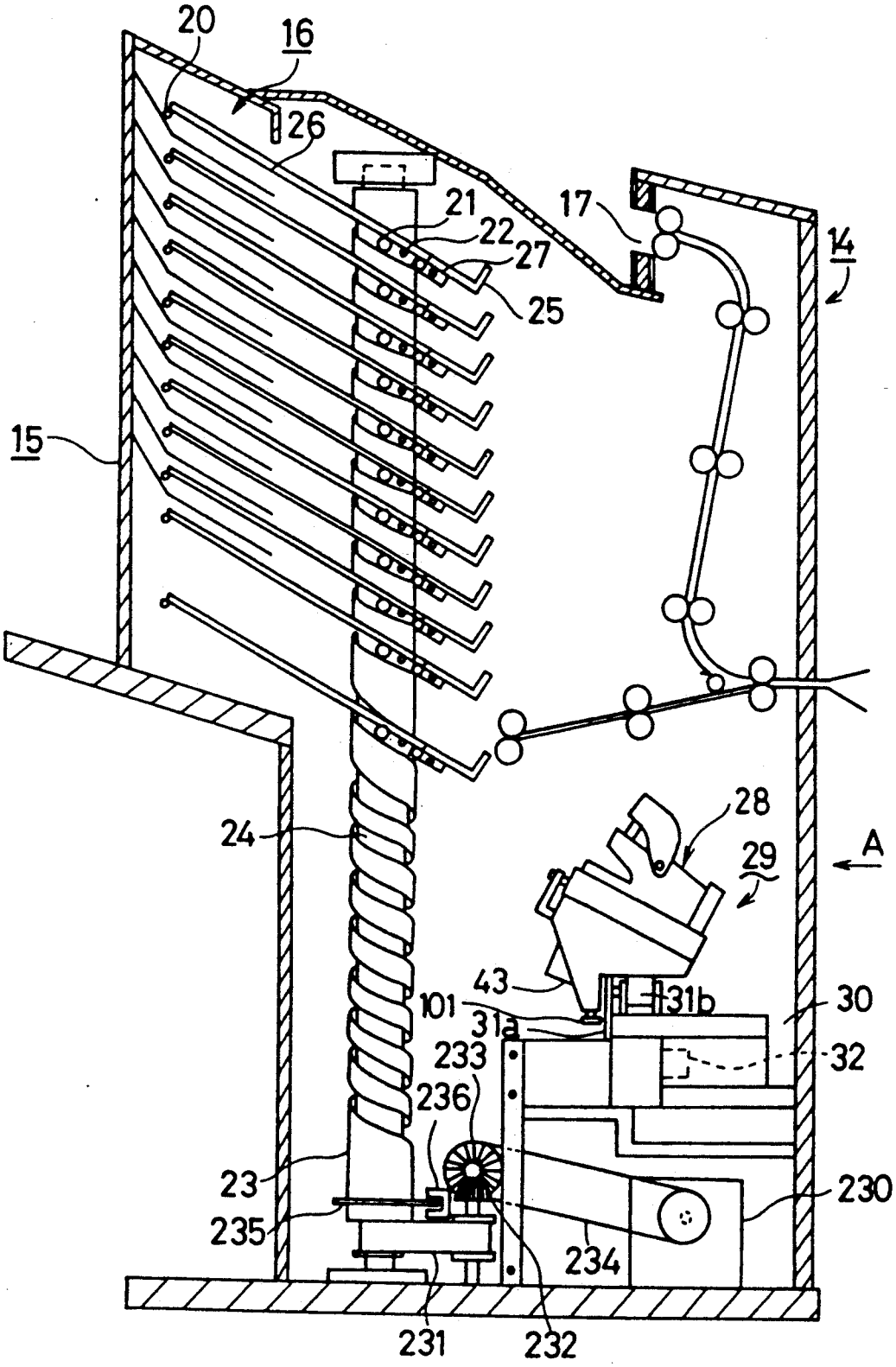
FIG. 2 is a longitudinal sectional view of a sorting unit of the image forming apparatus in which a first automatic sheet finishing device of the invention is provided.

Next, an interior construction of the sorting unit 14 will be described with reference to FIG. 2. FIG. 2 is a vertical sectional view showing the sorter 15 and sheet finishing device 30 accommodated in the sorting unit 14.

A cylinder 23 is provided upstanding at each of opposite sides of the bin trays 16 for shifting the bin trays 16 upward and downward. On a circumferential surface of the cylinder 23 is defined a spiral groove 24. A bottom end of the cylinder 23 is connected to a motor 230 by way of a timing belt 231, bevel gears 232 and 233, and timing belt 234. Further, at a bottom end portion of the cylinder 23 are provided a pulse plate 235 and rotation sensor 236 for detecting a rotation angle of the cylinder 23. When the motor 230 is driven, the driving force thereof is transmitted to the cylinder 23 by way of the timing belt 234, bevel gears 233, 232, and timing belt 231, and thereby the cylinder 23 is rotated.

Each bin tray 16 has pairs of first pins 20, second pins 21, and third pins 22 mounted thereto in such a manner as to project outwardly from opposite sides thereof. In inner surfaces of opposite side walls of the sorter 15 are formed guide grooves which are tilted downwards to the right in the drawing of FIG. 2. The pairs of first pins 20 are fitted in the corresponding guide grooves, and the pairs of second pins 21 are fitted in the corresponding grooves 24 defined on the cylinders 23. In this way, the bin trays 16 are supported shiftable upward and downward according to rotation of the cylinders 23. The third pins 22 are arranged away from the corresponding second pins 21 by a specified distance to the right in FIG. 2.

Each bin tray 16 includes a stopper 25, planar portion 26, and a pair of connecting portions 27. An end portion of the stopper 25 facing a discharge outlet of copy sheets is bent, and thereby rear edges of the copy sheets placed in the bin tray 16 are aligned. The connecting portions 27 connect the stopper 25 with the planar portion 26. In the connecting portions 27 is mounted a rotatable shaft 27*a* each. The stopper 25 is rotatable about the shaft 27*a*. Generally, the stopper is biased counterclockwise in the drawing of FIG. 2 by a spring or other elastic member so as to flush with the planar portion 26. By rotating the stopper 25 clockwise, a stopper function thereof is released.

The cylinder 23 is rotated by 360 degrees by means of the motor 230 each time a copy sheet is discharged from the imaging assembly. Accordingly, a stack of bin trays 16 move integrally upwards or downwards one stage after another in synchronism with a discharging timing of the copy sheet. When a specified processing to be described later is applied to sets of copy sheets upon completion of the copying and sorting operations, the bin trays 16 bearing sets of copy sheets thereon are moved upwards or downwards one stage after another so that the one bearing a set of copy sheets to be finished to an operative position. In addition, the bin tray 16 in the operative position is retracted (to the right in the drawing of FIG. 2) by a predetermined distance along a tilting direction thereof.

The sheet finishing device 30 is detachably mountable in the sorting unit 14, and includes a sheet finisher 28, support 29, frame 31*a*, etc.

The sheet finisher 28 applies a specified mechanical finishing such as stapling and punching to the sets of copy sheets sorted into the bin trays 16, and is mounted on the support 29. The frame 31*a* is provided with a belt 31*b* mounted thereon and a motor 32 for driving the belt 31*b*. The support 29 is fixedly connected to the belt 31*b*, and moves reciprocally by rotating the belt 31*b* in a widthwise direction of the bin tray 16, i.e. in a sideways direction of the copy sheets, by means of the motor 32 through a gear transmission mechanism. In addition, the support 29 is moved forwards (to the left in the drawing of FIG. 2) in the tilting direction of the bin trays 16 by driving a motor 43 to be described later, approaching the set of copy sheet to be mechanically finished. With this movement of the support 29, the finishing can be applied to a rear end portion of copy sheet set in desired positions.

Next, there will be described movement of the copy sheet set, i.e. retracting movement of bin tray 16 when the finishing is applied to the copy sheet set with reference to FIGS. 3A to 6C.

Figure 3A:
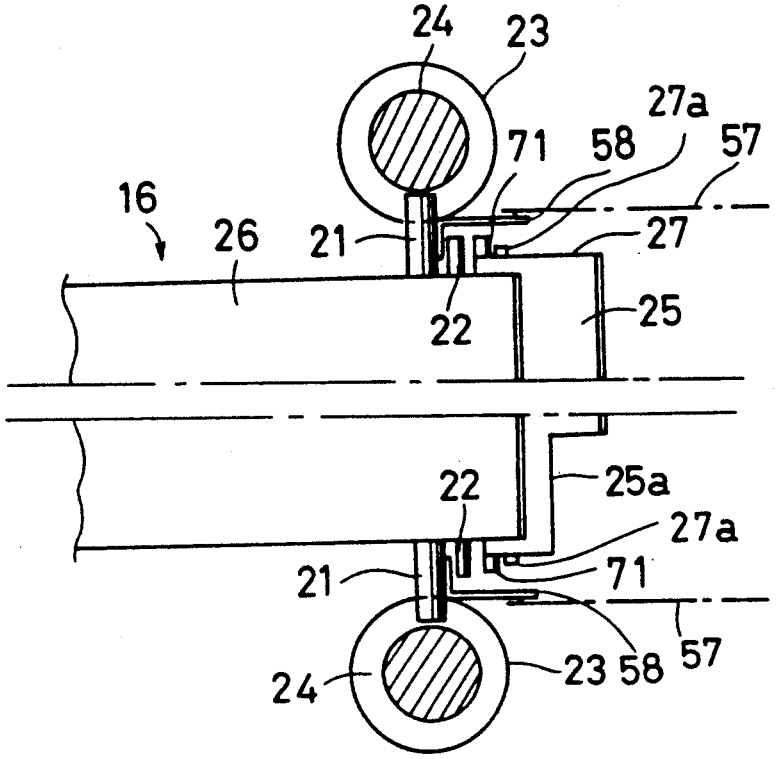
FIGS. 3A, 3B, and 3C are views showing a construction of a bin tray shifting mechanism provided in the sorting unit, FIG. 3A being a plan view in section showing the bin tray shifting mechanism, FIG. 3B being a schematic side view showing the same, and FIG. 3C being a perspective view showing an essential portion of the same.
Figure 3B:
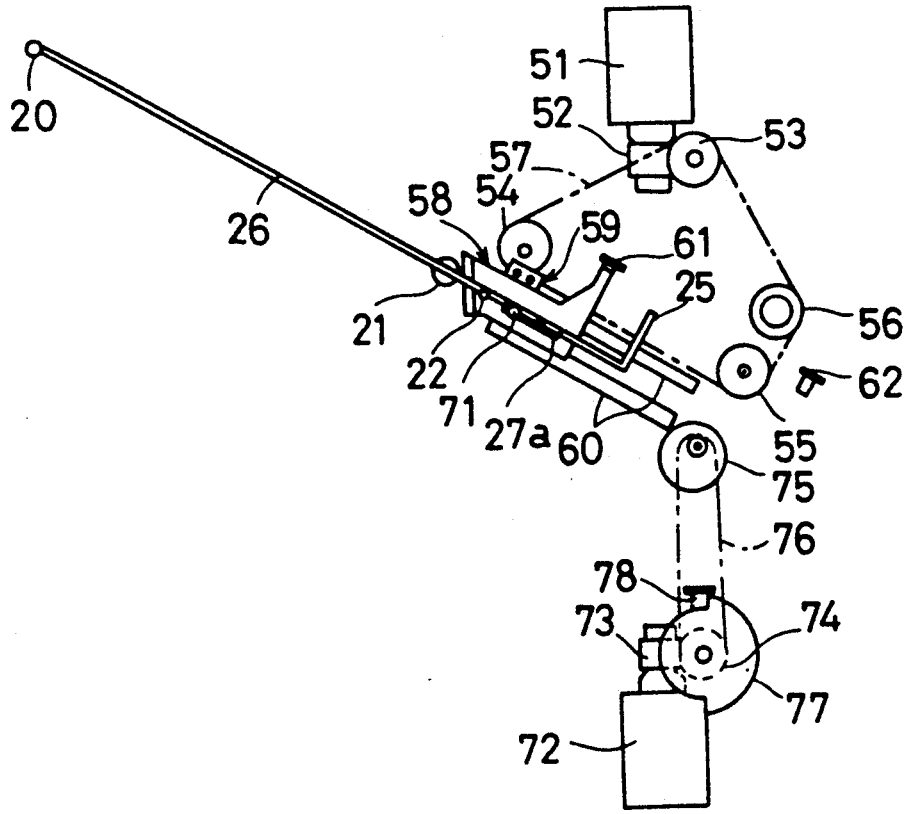
Figure 3C:
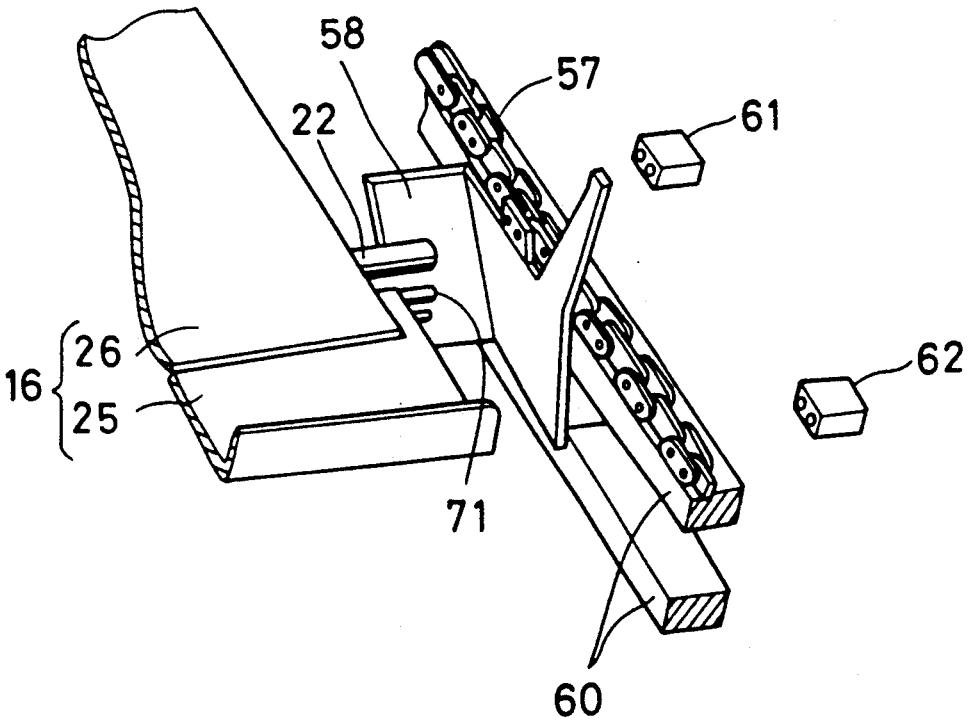

FIG. 3A is a plan view in section showing a construction of a bin tray shifting mechanism; FIG. 3B is a schematic side view showing the same; and FIG. 3C is a perspective view showing an essential portion of the same.

The bin tray shifting mechanism is designed to move the bin tray 16 in the operative position in a lengthwise direction of the bin tray 16 (hereinafter referred to merely as a lengthwise direction). This mechanism includes a motor 51, drive transmission mechanisms each having sprockets 53, 54, 55, and 56 and a chain 57. The drive transmission mechanism is provided at each of opposite sides (upper and lower sides in the drawing of FIG. 3A) of the bin tray 16. The motor 51 is coupled with one of the drive transmission mechanisms. The driving force of the motor 51 is transmitted to the other drive transmission mechanism through a connecting shaft connecting the sprockets 53 disposed at the opposite sides. The driving force of the motor 51 is transmitted to the sprocket 53 through a drive gear 52, and thereby the chain 57 wound on the sprockets 53, 54, 55, and 56 is rotated.

An L-shaped bracket 58 is secured to each of the chains 57. The bracket 58 is adapted to move the bin tray 16 toward and away from the sheet finishing device 30 by rotation of the chain 57 to be described later when a specified finishing is to be applied to the copy sheet set. Also, when in the position near the cylinder 23, the L-shaped bracket 58 is adapted for keeping the pin 21 of the bin tray 16 from disengaging from the spiral groove 24 to maintain the bin tray 16 at the operative position.

Guide rails 60 are adapted for guiding movement of the brackets 58. First and second sensors 61, 62, each including a photointerrupter or the like, detect the presence or absence of the bracket 58 in sensing regions thereof. The detection results of the sensors 61, 62 are output to a control unit 200 to be described later. The control unit 200 controls driving of the motor 51, thereby controlling the movement of the brackets 58.

With the construction as described above, the brackets 58, i.e. bin tray 16, are reciprocally movable within a specified range according to rotation of the motor 51.

A pair of fourth pins 71 are mounted on the connecting portion 27 in such a manner as to project outwardly from the opposite sides of the bin tray 16. When the fourth pins are pressed by an eccentric cam 75 to be described below, the stopper 25 is rotated clockwise.

A motor 72 is driven to rotate the stopper 25 clockwise. The torque of the motor 72 is transmitted to a sprocket 74 through a drive gear 73, and further transmitted to the eccentric cam 75 through a chain 76 wound between the sprocket 74 and eccentric cam 75.

A drive transmission mechanism including the sprocket 74, eccentric cam 75, and chain 76 is provided at each of the opposite sides (upper and lower sides in the drawing of FIG. 3A) of the bin tray 16. The motor 72 is coupled with one of the drive transmission mechanisms. The driving force of the motor 72 is transmitted to the other drive transmission mechanism through a connecting shaft connecting the opposite sprockets 74.

A pulse plate 77 rotates together with the sprocket 74 provided in the drive transmission mechanism coupled to the motor 72. A third sensor 78, including a photointerrupter or the like, detects a rotating amount of the sprocket 74 by means of the pulse plate 77, and the detection result thereof is output to the control unit 200. The control unit 200 controls driving of the motor 72, thereby controlling a rotating amount of the stopper 25.

As shown in FIG. 3A, a notch 25*a* is formed at one corner of the end portion of the stopper 25 facing the discharge outlet for reasons to be described later.

Figure 4:
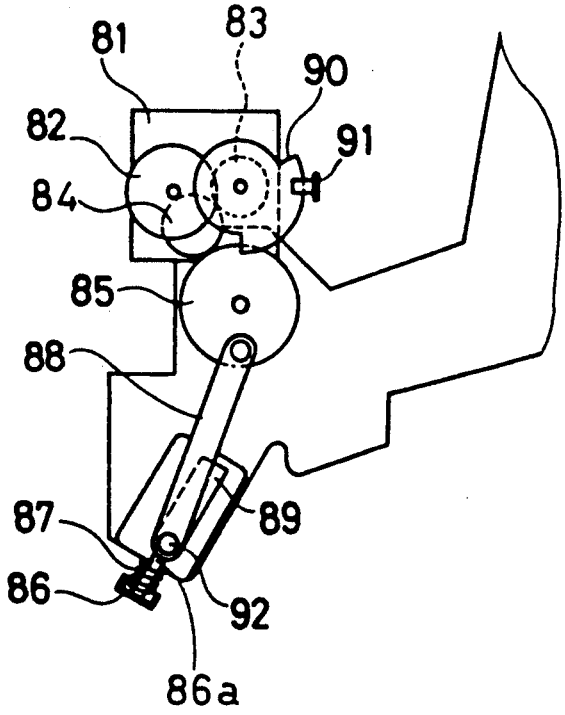
FIG. 4 is a side view showing a construction of a sheet holding mechanism provided in the sorting unit.

FIG. 4 is a side view showing a construction of a sheet holding mechanism.

Figure 8A:
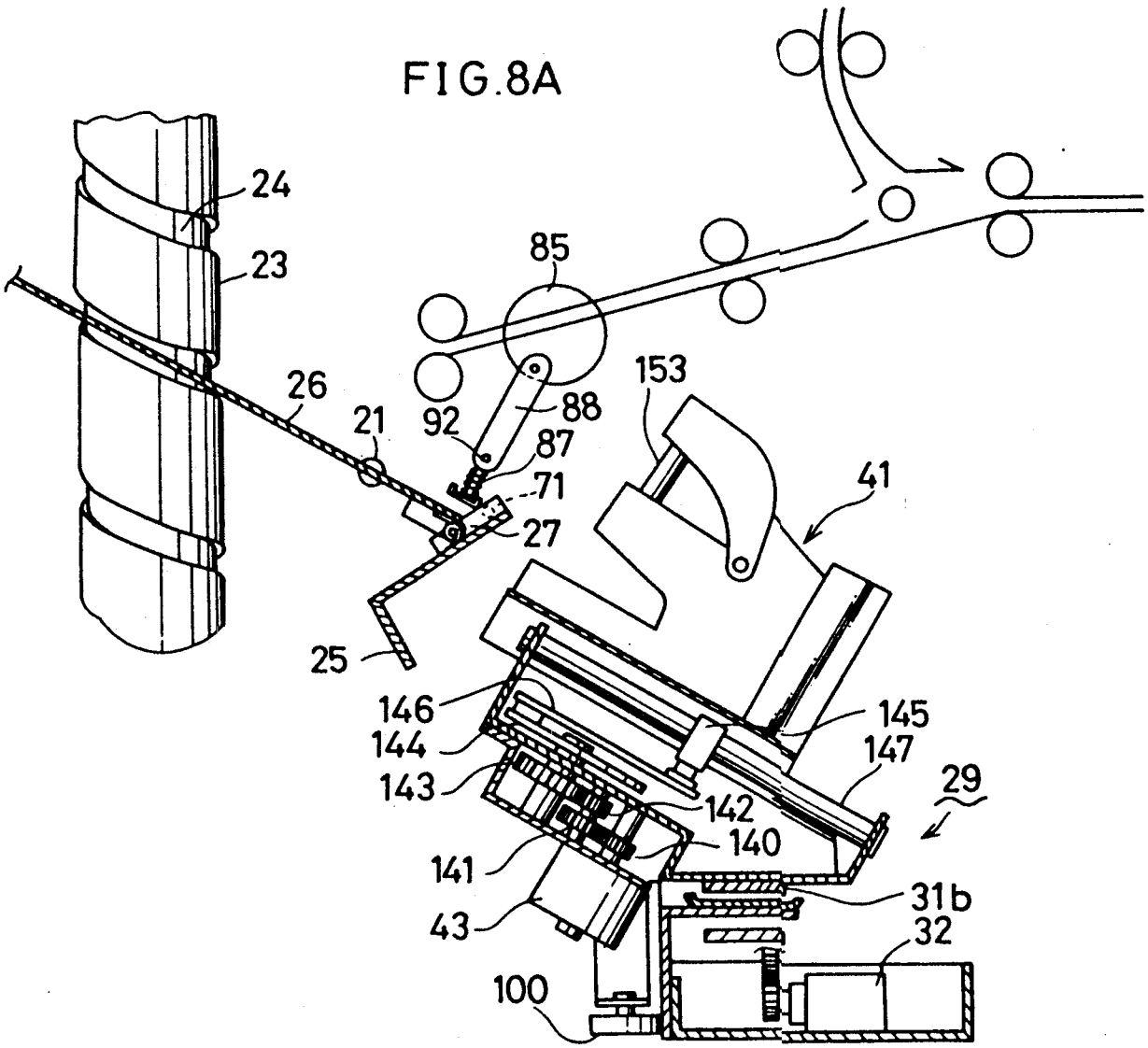
FIG. 8A is an enlarged sectional view showing an operational and positional relationship between the first automatic sheet finishing device and a bin tray provided in the sorting unit.

The sheet holding mechanism is in such positional relationship with the bin tray 16 as shown in FIG. 8A. The sheet holding mechanism is adapted for pressingly holding the sorted copy sheet set on the bin tray 16 against the planar portion 26 of the bin tray 16 immediately before the stopper 25 is rotated clockwise.

In FIG. 4, indicated at 81 is a motor for driving the sheet holding mechanism. The torque of the motor 81 is transmitted to gears 84, 85 through gears 82, 83. A linkage rod 88 connects the gear 85 with the holder support member 86*a*. An upper end of the linkage rod 88 is rotatably mounted to a side surface of the gear 85 at an eccentric position displaced from a center thereof. A guide rail 89 is provided to guide movement of a connecting pin 92 of the linkage rod 88 and holder support member 86*a*.

A drive transmission mechanism including the gear 85, linkage rod 88, holder support member 86*a*, and guide rail 89 is provided at each of the opposite sides (upper and lower sides in the drawing of FIG. 3A) of the bin tray 16. The motor 81 is coupled to one of the drive transmission mechanisms. The driving force of the motor 81 is transmitted to the other drive transmission mechanism through a connecting shaft connecting the opposite gears 85.

Figure 12:
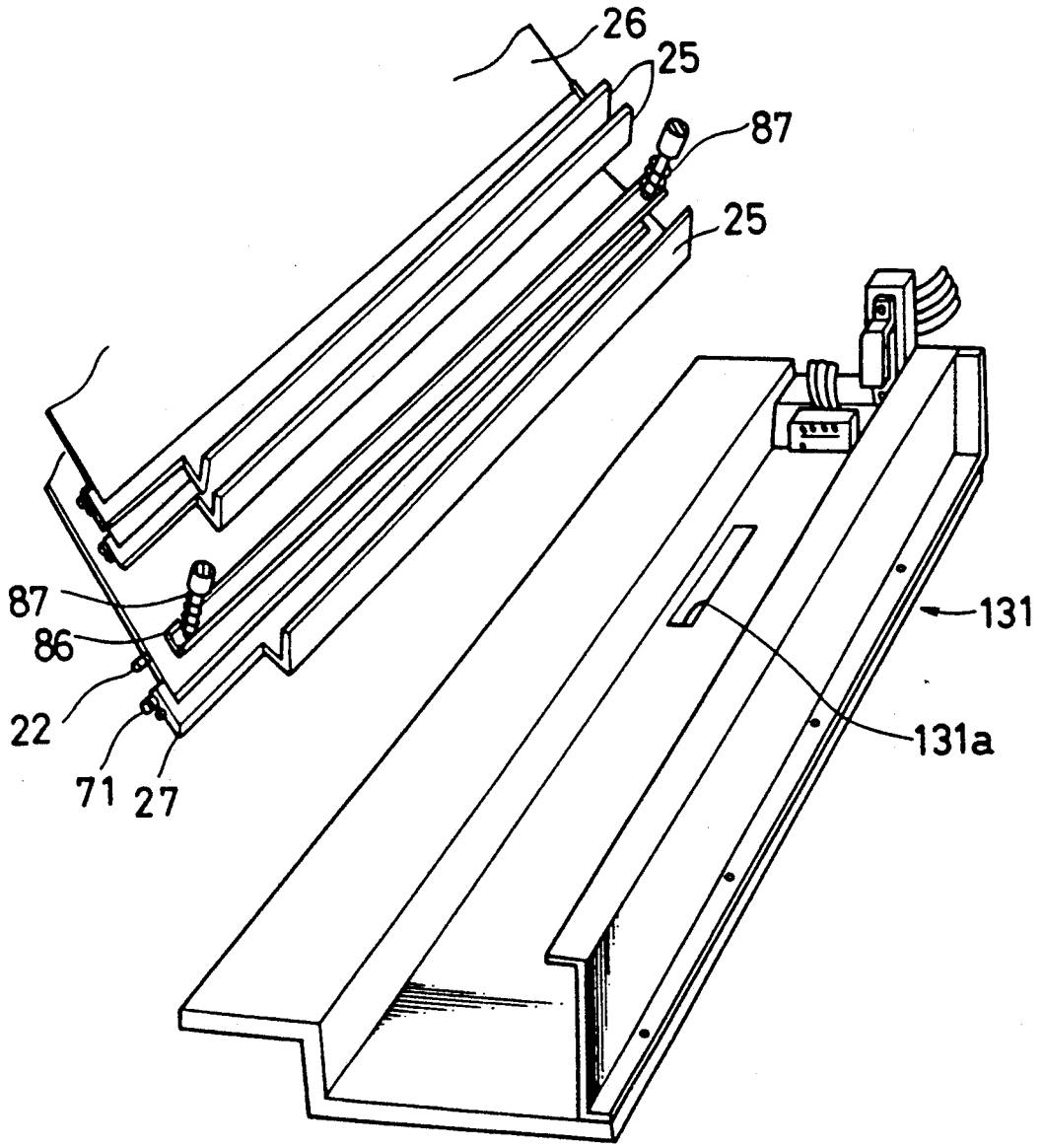
FIG. 12 is a perspective view showing a mount member for mounting the first automatic sheet finishing device on the sorting unit.

A holder 86 is adapted for pressingly holding the copy sheet set. The holder 86 is so formed as to have the length corresponding to the width of the bin tray 16 as shown in FIG. 12, and opposite ends thereof are supported by the support members 86*a*.

A spring 87 is mounted on each support member 86*a*, and applies a desirable pressing force to the sorted copy sheet set according to the number of copy sheets.

A pulse plate 90 rotates together with the gear 83. A fourth sensor 91, including a photointerrupter or the like, detects a rotating amount of the gear 83 depending upon whether light is transmitted or interrupted by the pulse plate 90. The detection result of the sensor 91 is output to the control unit 200.

Next, there will be described operations of the bin shifting mechanism and sheet holding mechanism.

Figure 5:
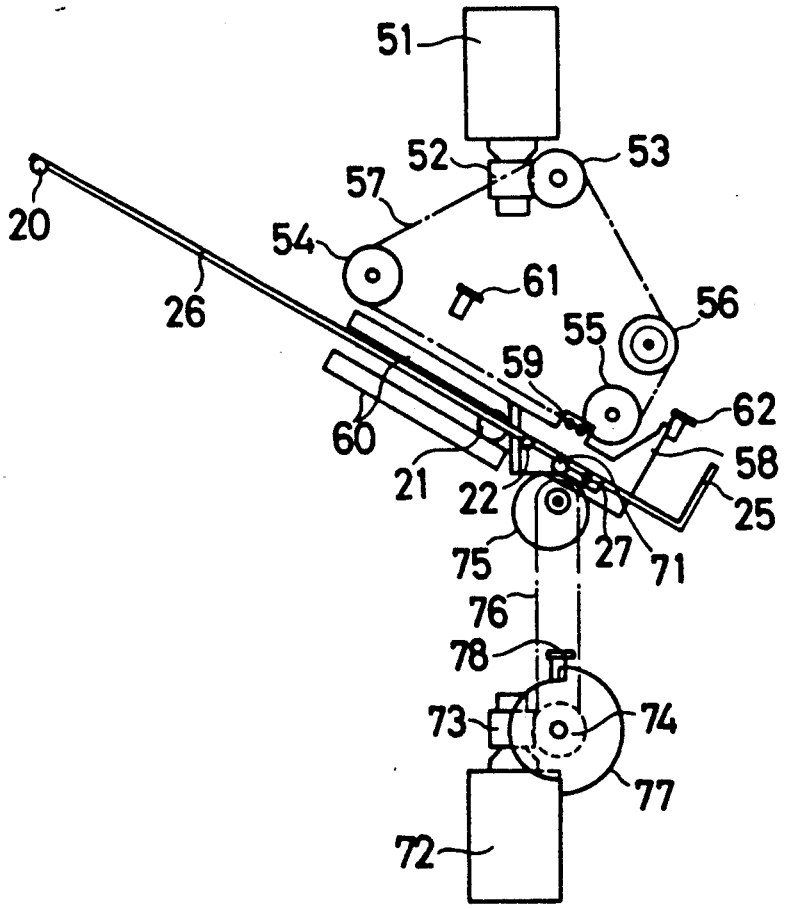
FIG. 5 is a side view showing a state where a bin tray is in a retracted position.

Firstly, the bin shifting mechanism will be described with reference to FIGS. 3B and 5. FIG. 3B shows a state wherein the bin tray 16 is in a forward (original) position, and FIG. 5 shows a state wherein the bin tray 16 is in a retracted position.

When the motor 51 is rotated in one direction, the torque thereof is transmitted to the sprockets 53 through the drive gears 52, and thereby the sprockets 53 start rotating. Then, the chains 57 wound on the sprockets 53, 54, 55, and 56 rotate counterclockwise. By rotation of the chains 57, the brackets 58 start moving in a backward direction (to the right in FIG. 3B) along the guide rails 60.

Since the brackets 58 push the third pins 22 backwards while moving, the bin tray 16 having the third pins 22 mounted thereon moves backwards according to movement of the brackets 58. Upon the bracket 58 reaching a position where the second sensor 62 is disposed as shown in FIG. 5, the sensor 62 detects the presence of this bracket 58 and sends a sensor signal representative of the detection result to the control unit 200. The control unit 200 stops the driving of the motor 51 based on the received sensor signal. In this way, the copy sheet set placed on the bin tray 16 is moved according to backward movement of the bin tray 16.

Next, there will be described forward movement of the bin tray 16 up to the original position thereof.

In this case, the motor 51 is rotated in a direction reverse from the one direction. Upon rotating the motor 51 in the reverse direction, the chains 57 start rotating clockwise. Hereafter, a rotating direction of a motor is referred to as a reverse direction when a part or element is returned to its original or home position by driving the motor. By rotation of the chains 57, the brackets 58 start moving forwards (to the left in FIG. 5) along the guide rails 60.

Since the brackets 58 push the second pins in the forward direction while moving, the bin tray 16 moves forwards. Upon the bracket 58 reaching a position where the first sensor 61 is disposed as shown in FIG. 3B, the sensor 61 detects the presence of this bracket 58 and outputs a sensor signal representative of the detection result to the control unit 200. The control unit 200 stops the driving of the motor 51 based on the received sensor signal.

Next, operations of the sheet holding mechanism will be described with reference to FIG. 4.

Upon rotating the motor 81, the torque thereof is transmitted to the gears 84, 85 through the gears 82, 83, and thereby the gears 84, 85 start rotating. The rotation of the gears 85 causes the holder 86 coupled to the linkage rods 88 to move downwards along the guide rails 89, and thereby the copy sheet set is pressed against the planar portion 26 by the force rendered from the spring 87. The rotation of the gear 83 causes the pulse plate 90 to rotate together therewith. The rotating amount of the pulse plate 90 is detected by the fourth sensor 91, which in turn sends a sensor signal representative of the detected rotating amount to the control unit 200. The control unit 200 stops the driving of the motor 81 based on the received sensor signal, and thereby the holder 86 is fixedly held in a specified position where the holder 86 presses the copy sheets against the planar portion 26.

On the other hand, when the sheet holding is released, the motor 51 is further driven to rotate the gears 85 just one turn. Thereupon, the holder 86 coupled to the linkage rods 88 is caused to move upwards to an original position thereof along the guide rail 89.

Figure 6A:
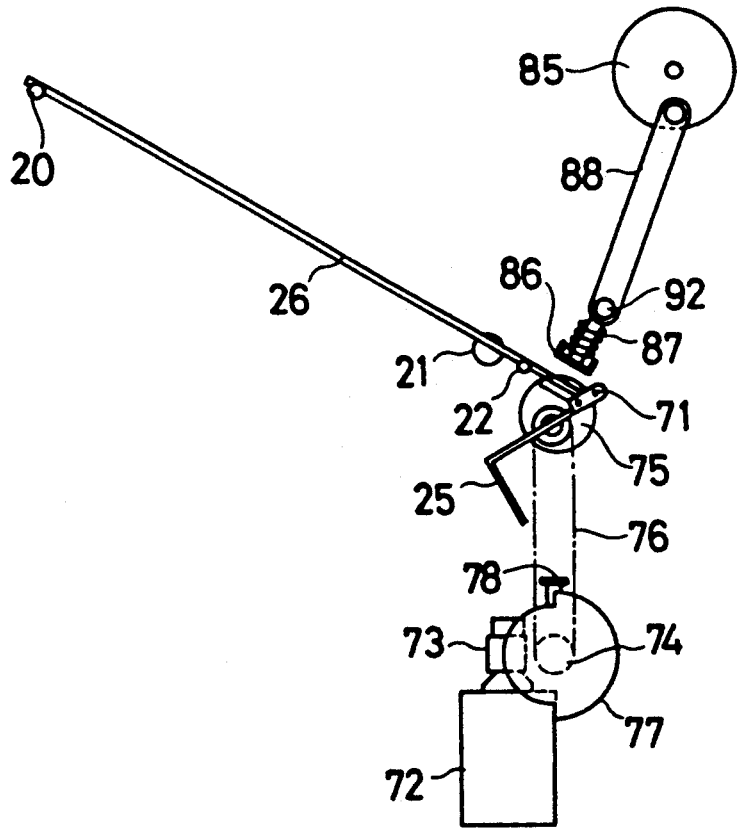
FIG. 6A is a side view showing a state where a stopper is released.
Figure 6B:
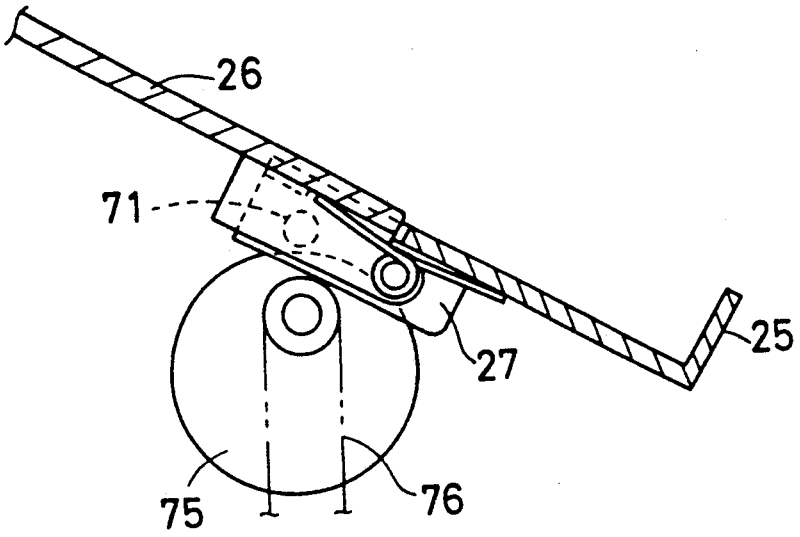
FIGS. 6B and 6C are respectively enlarged views showing an essential portion of the stopper.
Figure 6C:
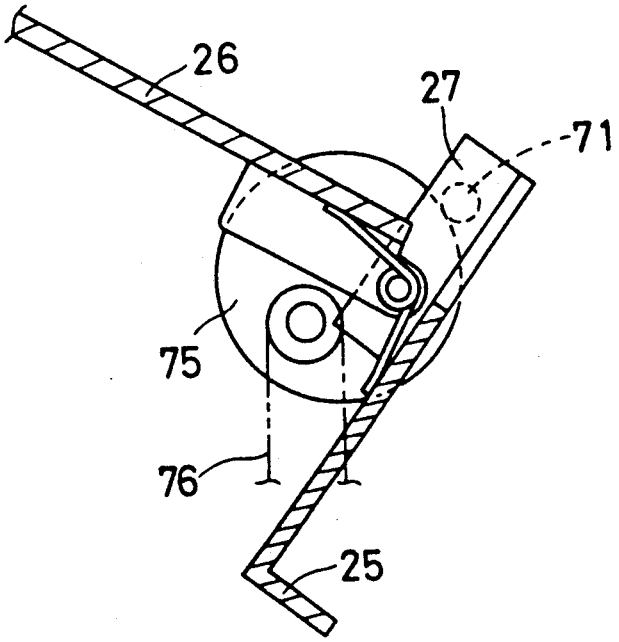

Next, there will be described operations of releasing the stopper 25 which enables application of a specified mechanical finishing to the pressingly held set of copy sheets with reference to FIGS. 5, 6A, 6B and 6C. FIGS. 5 and 6A are side views showing states before and after the stopper 25 is released respectively.

In a state where the bin tray 16 is in the retracted position as shown in FIG. 5, when the motor 72 is driven to rotate the sprockets 74 clockwise through the drive gears 73, the chain 76 rotates clockwise, and thereby the eccentric cams 75 are rotated clockwise. The rotation of the eccentric cams 75 brings the circumferential surfaces thereof into contact with the fourth pins 71.

The further rotation of the eccentric cams 75 pushes the pins 71, thereby causing the stopper 25 to rotate clockwise about the rotatable shafts **27*a* against the forces rendered from the springs provided in the connecting portions 27. In this way, the stopper 25** is released, permitting the specified finishing to be applied to the set of copy sheets.

The rotating amount of the pulse plate 77 rotatable together with the sprocket 74 is detected by the third sensor 78, which in turn sends a sensor signal representative of the detected rotating amount to the control unit 200. The control unit 200 stops the driving of the motor 72 based on the received sensor signal so as to bring the stopper 25 to a specified released position.

To return the stopper 25 to the original position, the motor 72 is further driven to further rotate the eccentric cams 75 clockwise through the drive gears 73, sprockets 74, and chains 76. Thereupon, the forces rendered from the eccentric cams 75 to push the fourth pins 71 are reduced, and the stopper 25 is returned to the original position by the biasing force of the springs provided in the connecting portions 27.

It will be appreciated that the stopper 25 is not released in the case where the finishing is applied to the copy sheet set at one corner thereof, i.e. within an area defined by the notch **25*a*** (hereinafter referred to as a notch defining area).

Next, there will be described a construction of the first sheet finishing device 30 of the invention provided in the sorting unit 14 with reference to FIGS. 7 to 10.

Figure 7:
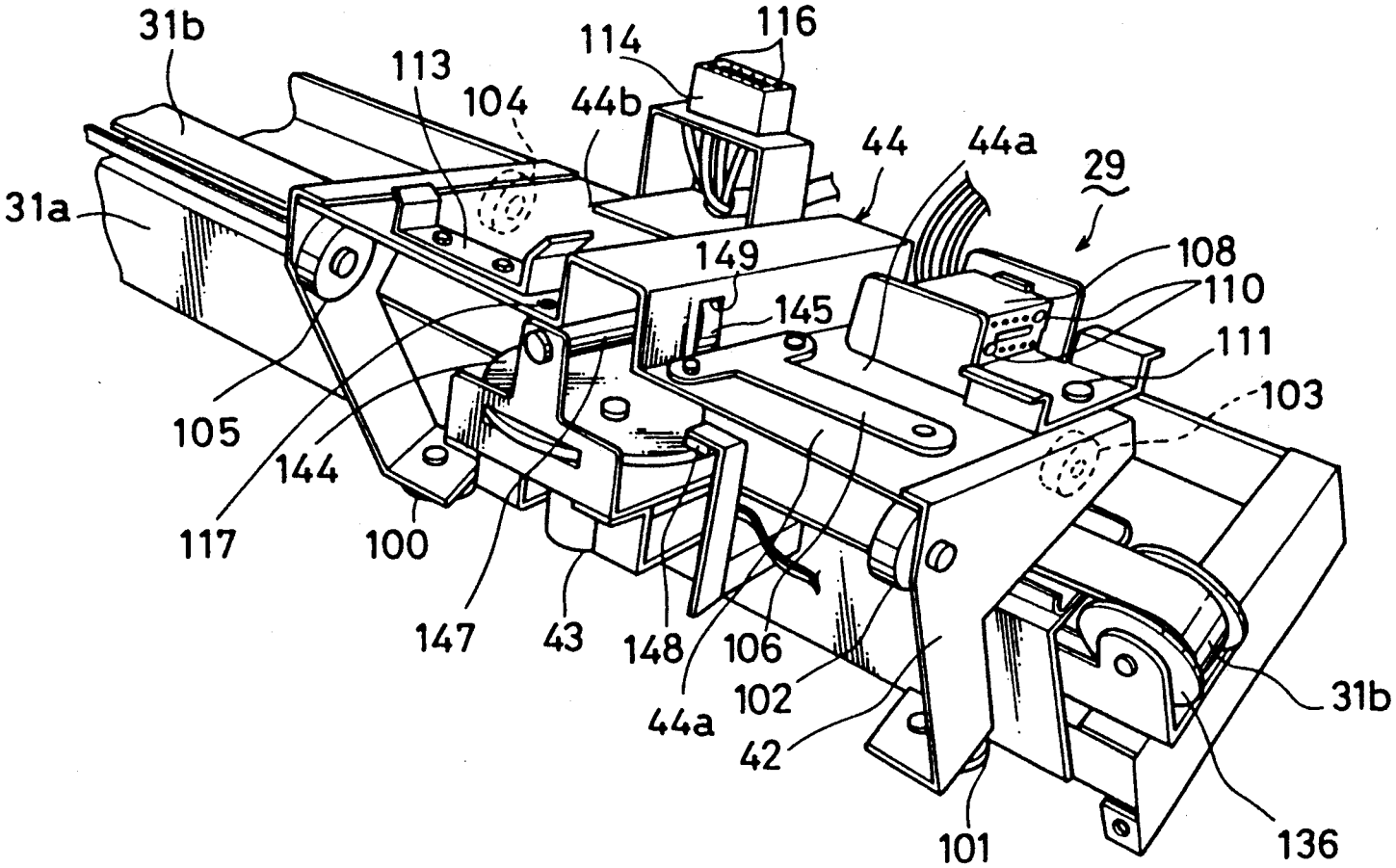
FIG. 7 is a perspective view showing a support and a drive transmission mechanism of the first automatic sheet finishing device, the support not carrying sheet finishers.

FIG. 7 shows the support 29 and drive mechanism therefor with the sheet finisher 28 unmounted on the support 29. The belt **31*b* is stretched horizontally and transversely on the frame 31*a*, and driven by the motor 32**.

The support 29 includes a base table 42 and a mount table 44. The base table 42 is fixed to the belt **31*b*, and reciprocally slidable according to rotation of the belt 31*b*, thereby moving the support 29** as a whole in a widthwise direction of the copy sheet set (first drive transmission mechanism).

The mount table 44 is arranged on an upper surface of the base table 42, and moved forwards and backwards at the same angle as the tilting angle of the guide rails 60 with respect to the horizontal direction. The movement of the mount table 44 is translated from the driving force of the motor 43 (second drive transmission mechanism).

Gears 140, 141, 142, and 143 constitute a drive transmission mechanism for transmitting the torque of the motor 43 to a pulse plate 144. The gears 141 and 142 are mounted on the same shaft, and so arranged that the torque of the motor 43 is boosted while transmitted from the gear 141 to the gear 142. The pulse plate 144 rotates together with the gear 143. A connecting member 146 has one end thereof rotatably mounted to an upper face of the pulse plate 144 at an eccentric position displaced from its center and has the other end thereof rotatably mounted to a lower end of a slider block 145, and thereby connecting the pulse plate 144 with the slider block 145. A cylindrical guide rod 147 is mounted on the base table 42 in such a manner as to form the same inclination with respect to the horizontal direction as the guide rail 60.

Figure 8B:
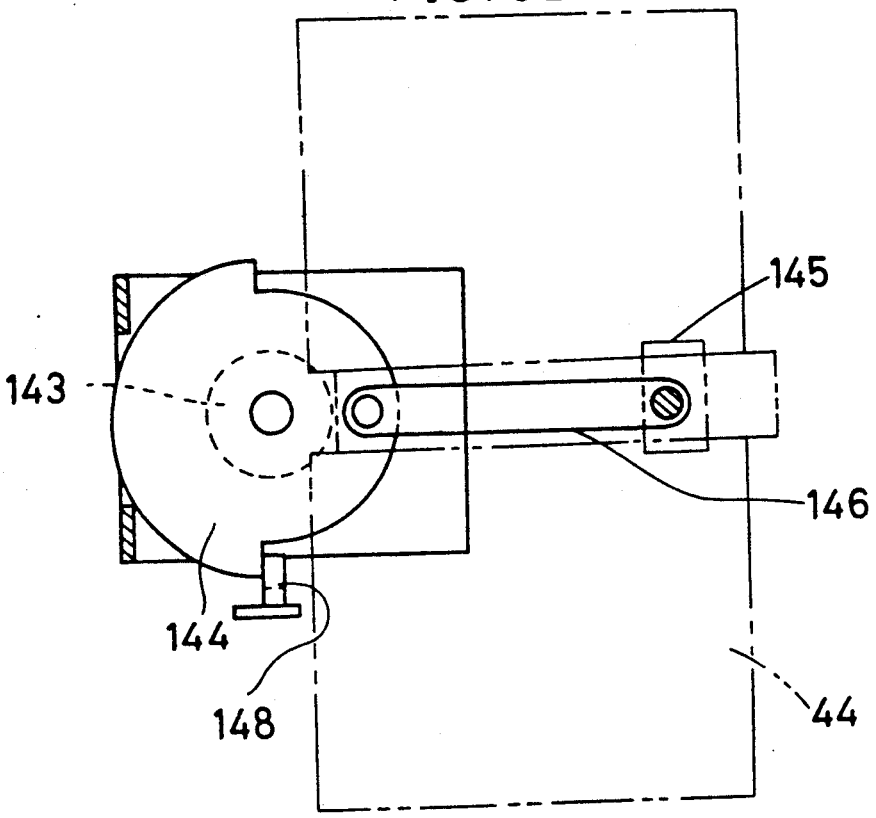
FIGS. 8B and 8C are diagrams showing movements of the mount table and a pulse plate of the first automatic sheet finishing device.
Figure 8C:
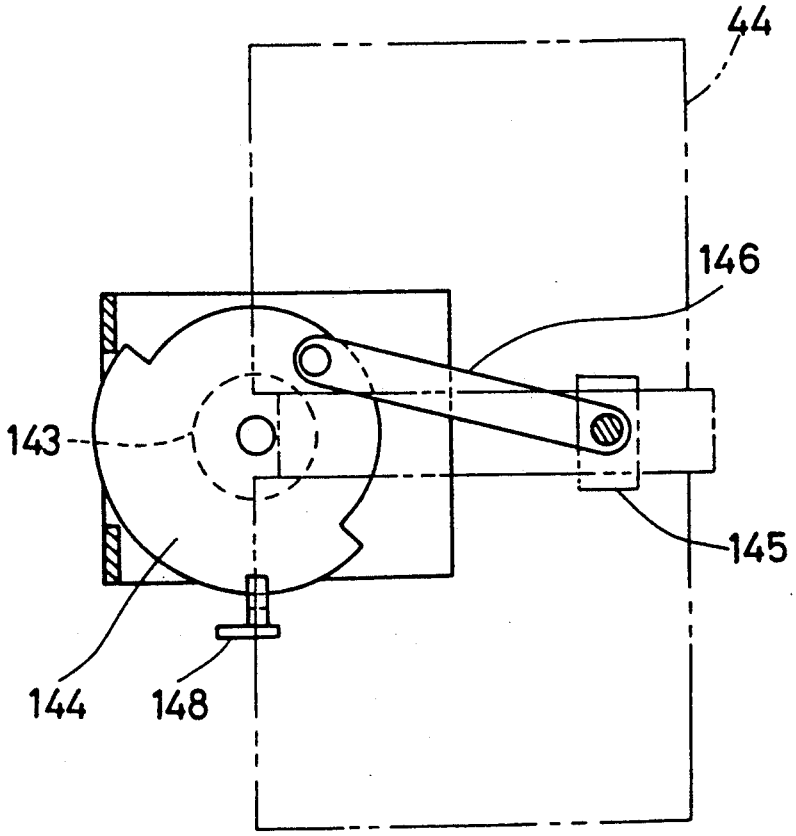

As shown in FIGS. 8B and 8C, the slider block 145 is slidably mounted on the guide rod 147, and reciprocally slides along the guide rod 147 according to the rotation of the pulse plate 144.

As shown in FIG. 7, the mount table 44 is formed with a projecting portion having a U-shaped cross-section opening downward at a center thereof. The mount table 44 is divided by the projecting portion into a first mount portion 44*a* on the right and a second mount portion 44*b* on the left in the drawing of FIG. 7. A notch 149 is defined in each of opposite side walls of the projecting portion in a specified position. The slider block 145 is fitted in the notches 149 defined on the opposite side walls. The sliding of the slider block 145 is translated into movement of the mount table 44 in the lengthwise direction.

A fifth sensor 148, including a photointerrupter or the like, detects a moved amount of the amount table 44 by detecting a rotating amount of the pulse plate 144 rotatable together with the gear 143. The sensor 148 sends a sensor signal representative of the detected moved amount to the control unit 200.

Rollers 100 and 101 are provided to smooth movement of the base table 42 on the frame 31*a*, and rollers 102, 103, 104, and 105 are provided to smooth movement of the mount table 44 on the base table 42.

Figure 9:
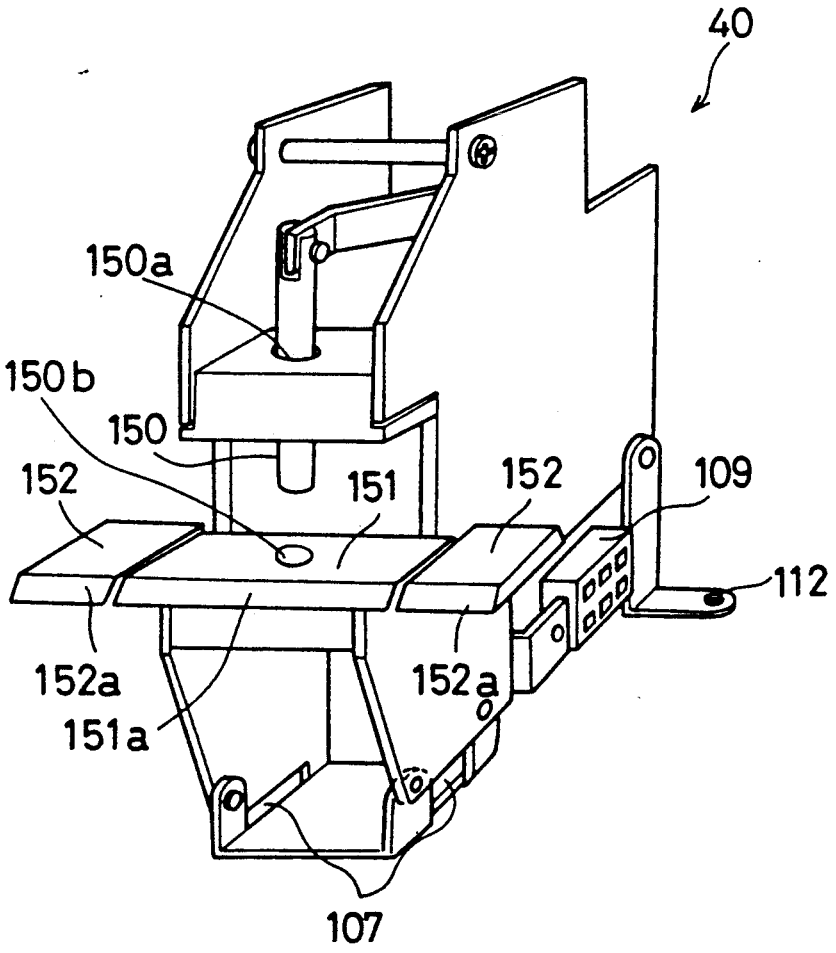
FIG. 9 is a perspective view showing a construction of a punch as an example of the sheet finishing.
Figure 10:
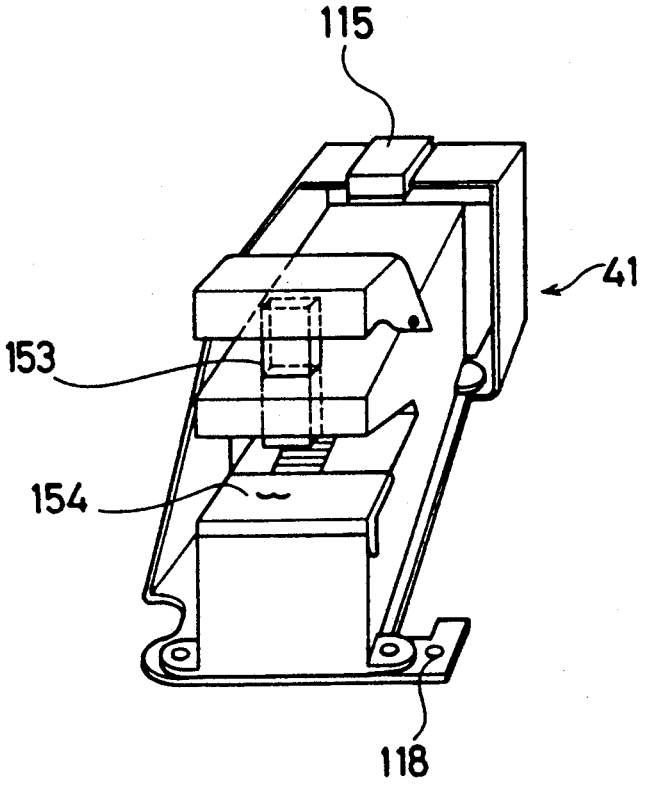
FIG. 10 is a perspective view showing a construction of a stapler as another example of the sheet finishing.

Hereafter, a mounting arrangement for the punch 40 will be described with reference to FIGS. 7, 9, and 10.

A T-shaped fitting 106 is provided on the first mount portion 44*a*. The fitting 106 has two linear portions, a first portion extending along the projecting portion of the mount table 44 and a second portion extending perpendicular to the first portion. The T-shaped fitting is screwed onto the mount portion 44*a* at opposite ends of the first portion, and the second portion thereof is inserted through slits 107 defined at a bottom of the punch 40 so as to assist fixation of the punch 40 on the mount table 44. Also, a connector 108 is provided on the first mount portion 44*a* for connecting to the punch 40 signal lines or the like used to control operations of the punch 40. In the connector 108 are formed holes 110 through which pins for securing connection are inserted.

A punch blade 150 of the punch 40 is adapted for making holes in the copy sheets. The copy sheet set is set on a table 151 when to be punched. On opposite sides of the table 151 are provided auxiliary tables 152 for preventing drooping of the sheets. At leading ends of the tables 151, 152 are formed slanting portions 151*a*, 152*a* so as to facilitate setting of the copy sheets. More specifically, the slanting portions 151*a*, 152*a* are, when the leading end portions of the copy sheets to be processed droop upon releasing of the stopper 25, adapted for setting the copy sheets in a specified position while scooping up the same.

When the punch 40 is driven by an unillustrated driving device, the punch blade 150 moves downwards and upwards through the guide hole 150*a*, thereby punching the copy sheets set on the table 151. Paper waste produced by the punching process falls through a punch hole 150*b* below the table 151.

The punch 40 can be completely fixed onto the support 29 by inserting the second portion of the T-shaped fitting 106 through the slits 107, connecting the connector 108 with a connector 109 provided in the punch 40, and screwing the punch 40 onto the support 29 through holes 111, 112. The holes 111, 112 are oblong in a lengthwise direction of the punch 40 so that the punch 40 is adjustable in that direction.

Next, a mounting arrangement for a stapler 41 will be described with reference to FIGS. 7 and 10.

A U-shaped fitting 113 is provided on the second mount portion 44*b*. The U-shaped fitting 113 includes a base portion and upright portions extending substantially upwards from opposite ends of the base portion. The base portion of the fitting 113 is disposed in a direction parallel to a stretching direction of the belt 31*b*, and screwed to the mount table 44. The upright portions of the fitting 113 are bent at upper ends thereof. The fitting 113 is adapted for assisting the fixation of the stapler 41. Specifically, the stapler 41 is fitted between the upright portions of the fitting 113, and held therebetween by the springback of the upright portions. A connector 114 is adapted for connecting to the stapler 41 signal lines or the like used to control operations of the stapler 41. In the connector 114 are formed holes 116 through which pins for securing connection are inserted.

The stapler 41 binds a set of sheets with a staple. When to be stapled, the sheets are set on a base 154. Similarly to the normal stapler, a stapling portion 153 is caused to descend suddenly whereby to insert opposite leading ends of the staple into the sheets. Upon reaching an anvil defined on the base 154, the opposite leading end portions of the staple are bent, and thereby the sheets are bound.

The stapler 41 requires no auxiliary table when the stapling is applied to the copy sheets at a position located within the notch 25*a* since the stopper 25 is not released. Even in the case where the stapling is applied to the copy sheets at a position located outside the notch 25*a* with the stopper 25 released, the stapler 41 requires neither an auxiliary table nor slanting portions as described above since the tables 151 and 152 of the punch 40 serve as an auxiliary table for the stapler 41 and the drooped copy sheets are scooped up by the slanting portions 151*a*, 152*a* of the tables 151, 152. In accordance with the invention, it is sufficient to provide an auxiliary table and a slanting portion in at least either one of the punch 40 and stapler 41.

The stapler 41 can be completely fixed onto the second mount portion 44*b* by being fitted between the upright portions of the fitting 113 by the springback of the upright portions, connecting the connector 114 with a connector 115 provided in the stapler 41, and screwing the stapler 41 onto the mount portion 44*b* through holes 117, 118.

In this way, the sheet finisher 28 such as the punch 40 and stapler 41 is made detachably mountable to the support 29.

Next, a construction of the frame 31*a* of the sheet finishing device 30 will be described with reference to FIGS. 7, 11, and 12.

The frame 31*a* is formed box-shaped, and provided internally with a drive transmission mechanism including the motor 32, gears 132, 133, pulleys 134, 135, 136, and belt 31*b*. The base table 42 of the support 29 is fixedly connected to the belt 31*b*.

The torque of the motor 32 is transmitted to the pulley 134 rotatable together with the gear 133 through the gear 132, and thereby the belt 31*b* is rotated.

Also, a roller 130 is provided in a specified position at a bottom of the frame 31*a*. As shown in FIG. 12, a slot 131*a* is defined in a mount member 131 for mounting the sheet finishing device 30 in the sorting unit 14. The mount member 131 is mounted in a specified position in the sorting unit 14. When the sheet finishing device 30 is mounted in the sorting unit 14 through the mount member 131, the roller 130 is engageable with the slot 131*a*.

At a bottom of the base table 42 is provided a sixth sensor 137. The sensor 137, including a photointerrupter or the like, detects whether the base table 42 is in a home position and sends a sensor signal representative of the detection result to the control unit 200. The home position is located closer to the door 14*a* (at the left side in FIG. 11), and indicated by solid line in FIG. 11. When the stapling is applied to the copy sheet at the position located within the notch 25*a*, the base table 42 stays in the home position.

The frame 31*a* is formed such that a left end portion thereof projects toward the door 14*a* from the left side end of the bin tray 16 approximately by half the width of the mount table 44 of the support 29. Therefore, a mounting operation, maintenance, and inspection of the punch 40 located on the first mount portion 44*a* can be easily done just by opening the door 14*a*.

In the foregoing embodiment, the punch 40 is mounted on the first mount portion 44*a* which is closer to the door 14*a* and the stapler 41 is mounted on the second mount portion 44*b* which is farther from the door 14*a*. These sheet finishers are arranged in this manner for the following reasons. Generally, stapling is a more frequently required sheet finishing operation than punching. Accordingly, it may be better to detach the punch 40 when not necessary in order to reduce the burden on the motor 32 for driving the support 29. As a result, the punch 40 is mounted and detached more frequently than the stapler 41. In view of this, the punch 40 is mounted on the first mount portion 44*a* closer to the door 14*a*. Also, the punching is applied to a center portion of the sheets while the stapling is applied at opposite end corners of the sheets. Accordingly, the stapler 41 is mounted on the second mount portion 44*b* farther from the door 14*a* so that it can reach a farthest possible position from the door 14*a*.

This enables a moving range of the base table 42 to be shortened without adversely affecting the punching operation which is carried out in a range narrower than the widthwise dimension of the sheets.

Further, when the frame 31*a* is withdrawn from the sorting unit 14, the roller 130 comes into contact with a left edge face of the slot 131*a*, i.e. an edge face which is located closer to the door 14*a*, and stops thereat. The positional relationship between the roller 130 and slot 131*a* is such that, when the frame 31*a* is withdrawn toward the door 14*a* in a state where the base table 42 is in the home position (i.e., a state indicated by solid line in FIG. 11), the support 29 temporarily stays in a position where maintenance and inspection can be carried out for the stapler 41 mounted on the second mount portion 44*b* without being interfered by the presence of the bin tray 16.

When the frame 31*a* is further withdrawn, the left side portion thereof is slightly pressed downward to disengage the roller 130 from the slot 131*a*. After being removed from the slot 131*a*, the roller 130 smoothly rotates on an upper surface of the mount member 131, thereby facilitating withdrawal of the frame 31*a*. In this way, the sheet processing device 30 can be easily mounted and detached to and from the sorting unit 14.

Next, there will be described movements of the base table 42 and mount table 44 with reference to FIGS. 7, 8A, 8B, 8C, and 11.

Firstly, movement of the base table 42 will be described.

Upon rotating the motor 32 in one direction, the torque thereof is transmitted to the pulley 134 through the gears 132, 133, and thereby the pulley 134 starts rotating. Thereupon, the belt 31*b* starts rotating to move the base table 42 in the widthwise direction of the pressingly held copy sheet set. A moving distance of the base table 42 is controlled by the control unit 200 based on an energization period of the motor 32 which is measured using the home position or the like as a reference point, and a number of drive pulses sent to the motor 32.

When the base table 42 is to be returned to the home position, the motor 32 is rotated in the reverse direction. Upon the sixth sensor 137 detecting the presence of the base table 42, the control unit 200 stops the driving of the motor 32.

Next, movement of the mount table 44 will be described.

Upon rotating the motor 43 in one direction, the torque thereof is transmitted to the pulse plate 144 through the gears 140, 141, 142, and 143, and thereby the pulse plate 144 starts rotating. The rotation of the pulse plate 144 is translated into movement of the slider block 145 in the lengthwise direction through the connecting member 146. Together with the connecting member 146, the mount table 44 moves toward the copy sheet set.

The rotating amount of the pulse plate 144 is detected by the fifth sensor 148. Upon the mount table 44 reaching a specified position, the control unit 200 stops the driving of the motor 43. In the specified position, the copy sheet set is on the table 151 and auxiliary tables 152 of the punch 40, or on the base 154 of the stapler 41.

When the mount table 44 is to be returned to its original position, the motor 43 is driven to further rotate the pulse plate 144 in the same direction. When the fifth sensor 148 detects that the mount table 44 has returned to the original position, the control unit 200 stops the driving of the motor 43.

Next, there will be described a control system of the sheet finishing device 30 provided in the sorting unit 14 with reference to FIG. 13.

The control unit 200 includes a storage 201 having a ROM (read only memory) and RAM (random access memory), a (central processing unit), and clocks.

The storage 201 stores therein a control program in accordance with which control operations of the sheet finishing device are executed. The storage 201 also stores finishing position data, such as standard finishing positions of each various sheet finishers. For example, the storage 201 stores respective finishing positions of a punch for A4 and B5 sized copy sheets. Further, the storage 201 stores a sequence of finishings to be executed according to the finishing mode selected, for example, by manipulating the selection key 13.

The control unit 200 measures the energization period of the various motors. The control unit 200 also controls energization and deenergization of the motors 51, 81, 72, 32, and 43 in accordance with the sensor signals sent from the first, second, fourth, third, sixth and fifth sensors 61, 62, 91, 78, 137, and 148 and the energization period of each motor.

Also, the control unit 200 discriminates whether the specified finishing has executed for the sheets on all the bin trays 16 of the sorting unit 14. If there remains a bin tray 16 bearing a set of copy sheets to be finished, the control unit 200 controls the energization and deenergization of the motor 230 in accordance with the sensor signal from the rotation sensor 236 to move the bin trays 16 up and down.

The control unit 200, based on the predetermined sequence of finishings stored in the storage 201 for the selected finishing mode, controls the motors, punch 40, and stapler 41 so as to cause the punch 40 and stapler 41 to perform their respective specified finishings at the predetermined positions while moving the support 29 in the widthwise direction of the frame 31*a* from the home position.

Figure 14:
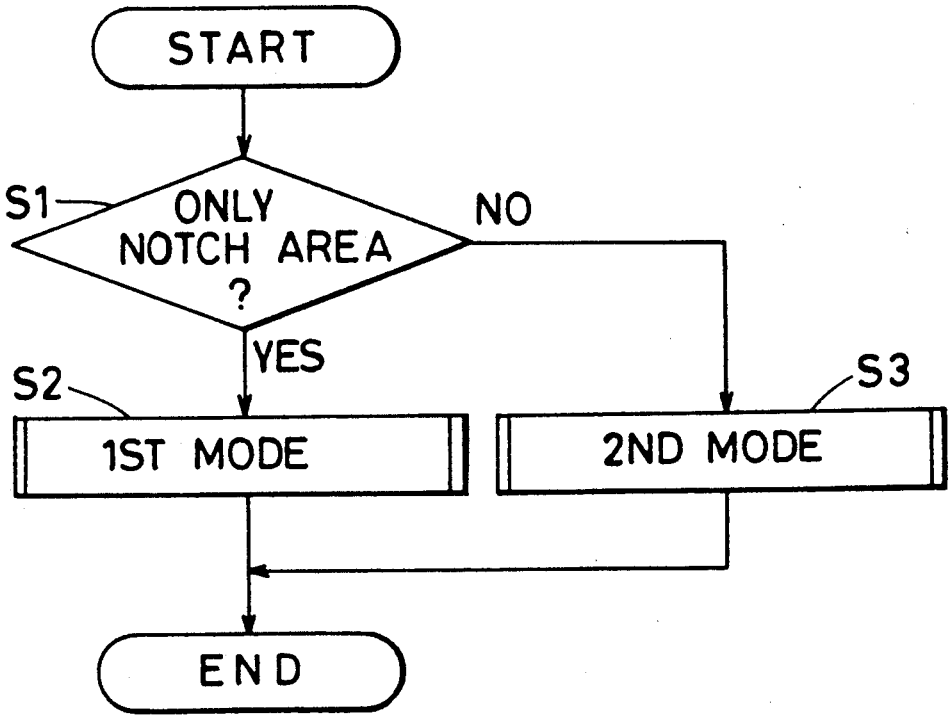
FIG. 14 is a flow chart showing a main routine of the first automatic sheet finishing operation.

Next, the sheet finishing operations will be described with reference to FIGS. 14 to 17. FIG. 14 is a flow chart showing a main routine of the sheet finishing operation.

When the positions where the finishing is applied to the set of copy sheets, i.e. finishing positions, and the type of finishing are selected by means of the selection key panel 13, the sheet finishing operations start. It should be understood that the finishing positions are written in a plural form hereafter though the finishing may be applied at a single position.

Firstly, it is discriminated in Step S1 whether the finishing is required to be executed for only the notch defining area. In the case where the finishing is required to be executed for only the notch defining area (YES is Step S1), the main routine proceeds to Step S2 in which a first mode is executed.

On the other hand, in the case where at least one of the finishing positions is located outside the notch defining area (NO in Step S1), the main routine proceeds to Step S3 in which a second mode is executed.

Figure 15:
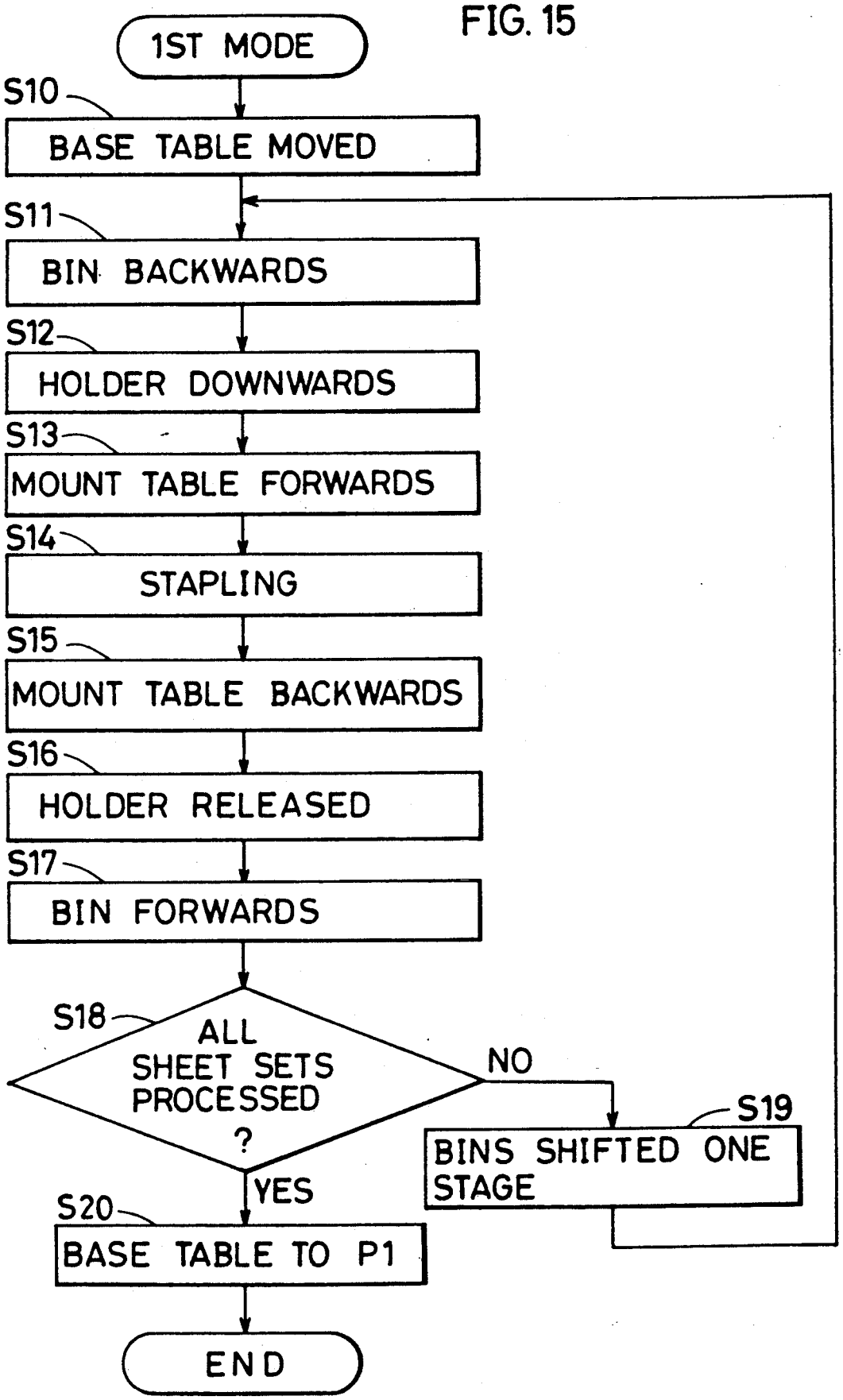
FIG. 15 is a flow chart showing an operation procedure of a first mode where sheet finishing is applied to a set of sheets only in an area defined by a notch formed in the bin tray.

First, the operations of the first mode will be described with reference to FIG. 15. In the first mode, the finishing is applied to the rear end portion of the set of copy sheets within the notch defining area. In this operation, stapling is applied to the copy sheet set in a single position as an example of finishing.

Firstly, the motor 32 is driven to move the base table 42 up to a position where the stapler 41 opposes the finishing position in Step S10. Subsequently, the motor 51 is driven to move the bin tray 16 bearing the copy sheet set to be finished thereon backwards toward the stapler 41 in Step S11. Upon the second sensor 62 detecting the presence of the bin tray 16 in the retracted position, the motor 51 is deenergized and the motor 81 is driven to move the holder 86 downwards so as to pressingly hold the copy sheet set in Step S12.

Thereafter, the motor 43 is driven to move the mount table 44 forwards up to the finishing position and deenergized to cause the mount table 44 to stop thereat, and the copy sheet set is set on the base 154 of the stapler 41 in Step S13. In the first mode, it is not required to release the stopper 25 since the finishing is applied to the copy sheet set within the notch defining area. In Step S14, the stapler 41 is actuated, and thereby binding the copy sheet set with a staple.

Upon completion of the stapling operation, the motor 43 is driven in the reverse direction to move the mount table 44 backwards to the original position, moving the stapler 41 away from the copy sheet set in Step S15. Subsequently, the motor 81 is further driven in the same direction to release the holder 86 in Step S16. In Step S17, the motor 51 is driven in the reverse direction to move the bin tray 16 forwards, and deenergized upon the first sensor 61 detecting the presence of the bin tray 16 in the original position.

Next, in Step S18, it is discriminated whether all the sets of copy sheet on the bin trays 16 have been processed. Unless all the sets of copy sheets have been processed (NO in Step S18), the motor 230 is driven to shift the stack of bin trays 16 upwards or downwards by one stage in Step S19. At this time, the stack of bin trays 16 are shifted downwards by one stage in the case where the stapling is started from the bottommost bin tray 16, while shifted upwards by one stage in the other case. The operations executed in Steps S11 to S18 are directed to the bin tray 16 shifted to the operative position.

On the other hand, if all the sets of copy sheets have been finished (YES in Step S18), the motor 32 is driven in the reverse direction to bring the base table 42 back to the home position in Step 20 and the sheet finishing operation ends.

If the finishing position is a position opposing the home position, no operation is required in Steps S10 and S20. This is because movement of the base table 42 is not necessary. Although the operation of the flow chart of FIG. 15 is described with reference to stapling, it is needless to say that punching may be executed in accordance with this flow chart.

Figure 16:
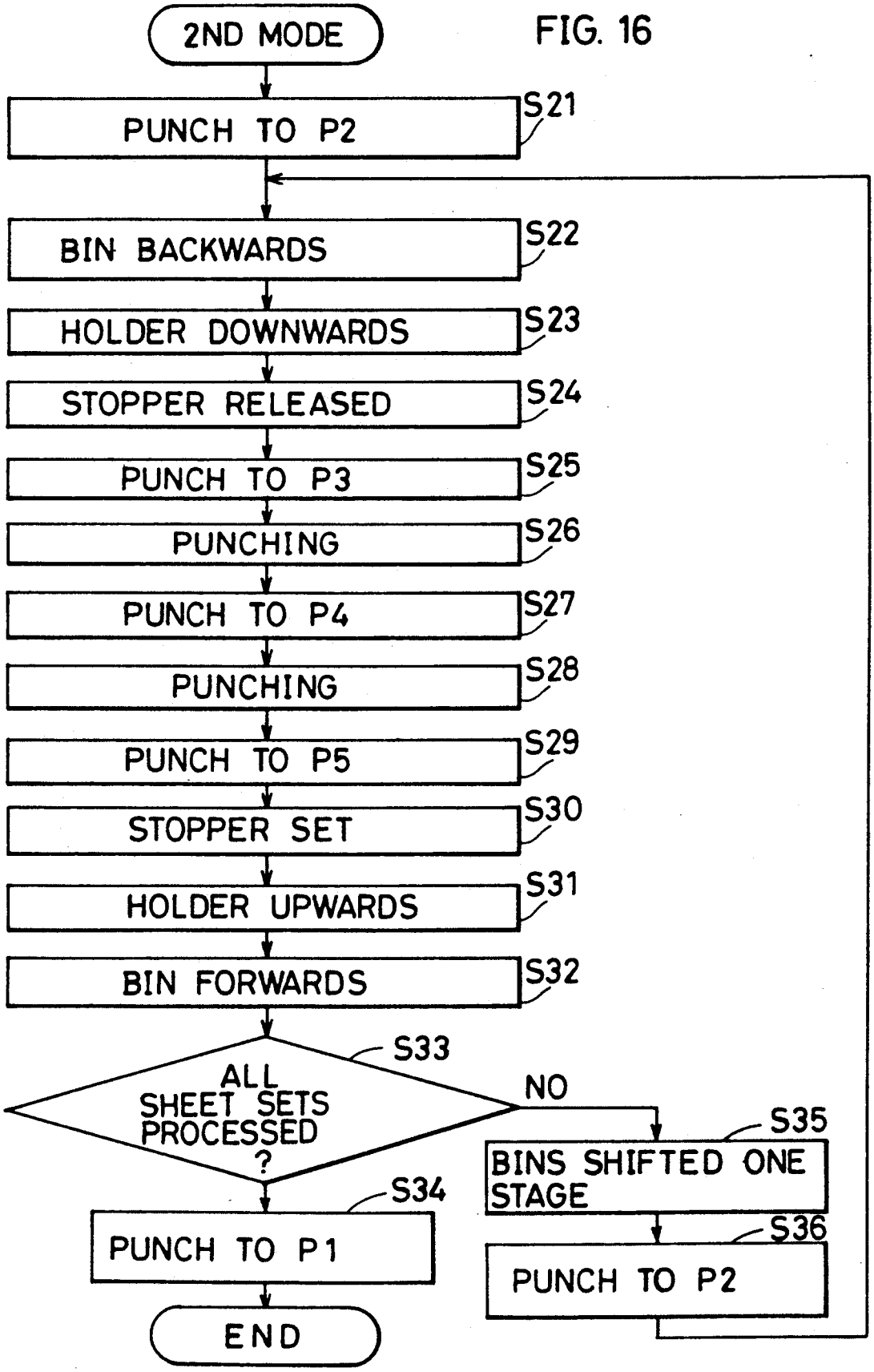
FIG. 16 is a flow chart showing an operation procedure of a second mode wherein, for example, sheet finishing is applied to a rear end portion of a set of sheets in two positions spaced apart in a widthwise direction of the sheet symmetrically with respect to a center in the width of the sheet.
Figure 17:
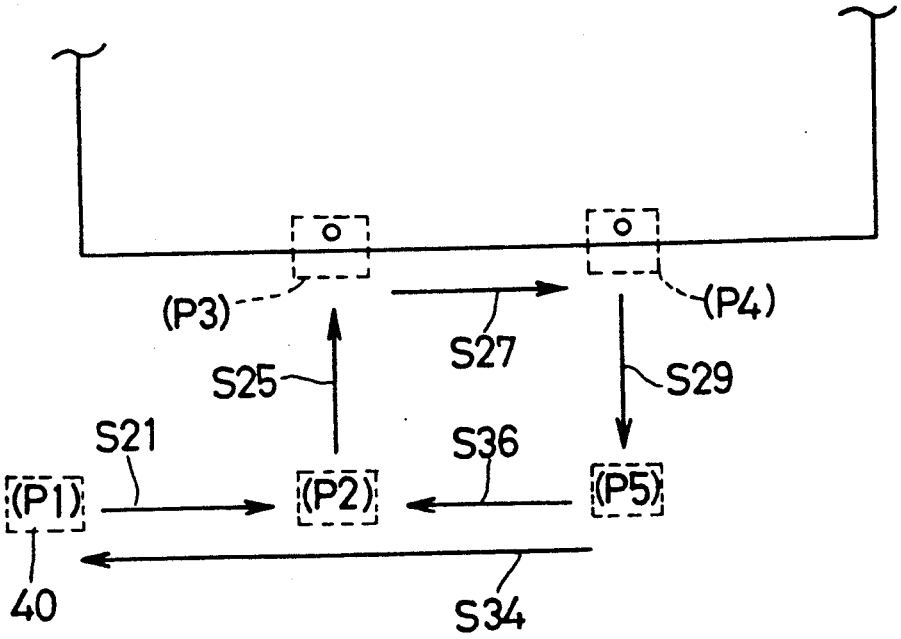
FIG. 17 is a diagram showing a moving course of the punch and punching positions.

Next, operations of the second mode will be described with reference to FIG. 16. In the second mode, the finishing is applied to two portions of the rear end portion of the set of copy sheets. In this operation, the punching is applied to the copy sheet set as an example of the finishing FIG. 17 is a diagram showing a relation between the movement and stop positions of the punch 40 and punching positions of the copy sheet.

Firstly, in Step S21, the motor 32 is driven to move the base table 42 in the widthwise direction of the sheet to move the punch 40 from the home position P1 to a position P2 opposing a first punching position P3, and is deenergized to stop the punch 40 thereat. Subsequently, the motor 51 is driven to move the bin tray 16 bearing the set of copy sheets to be processed thereon to the retracted position in Step S22. Thereafter, the motor 81 is driven to cause the holder 86 to pressingly hold the copy sheet set in Step S23. Thereupon, the motor 72 is driven to release the stopper 25 of the bin tray 16 in Step S24. It will be appreciated that, pressingly held already in Step S23, the copy sheet set is not to droop even if the stopper 25 is released.

Next, the motor 43 is driven to move the mount table 44 forwards to the processing position P3, and the copy sheet set then comes over the table 151 and auxiliary tables 152 of the punch 40 in Step S25. In Step S26, the punch 40 is actuated to make a hole in the copy sheet set. Upon completion of the punching operation at the first punching position P3, the motor 32 is driven to move the punch 40 further in the widthwise direction to a second punching position P4, and deenergized to stop the punch 40 thereat in Step S27. Subsequently, the punch 40 is actuated to make a hole in the copy sheet set in Step S28. Upon completion of the punching operation at the second punching position P4, the motor 43 is driven in the reverse direction to move the mount table 44 backwards up to a position P5, moving away from the copy sheet set in Step S29.

Subsequently, the motor 72 is further driven in the same direction to return the stopper 25 from the released position to the stopping position in Step S30. In Step S31, the motor 81 is further driven in the same direction to release the holder 86. Then, the motor 51 is driven in the reverse direction to return the bin tray 16 bearing the finished copy sheet set to the original position in Step S32.

Thereafter, it is discriminated whether the punching is applied to the respective copy sheet sets of all the bin trays 16 in Step S33. Unless all the sets of copy sheets have been finished (NO in Step S33), the motor 230 is driven to shift a stack of bin trays 16 upwards or downwards by one stage in Step S35.

In Step S36, the motor 32 is driven in the reverse direction to move the punch 40 from the position P5 to the position P2, and deenergized to cause the punch 40 to stop thereat. Then, this routine returns to Step S22 and operations executed in Steps S22 to S33 are directed to a copy sheet set placed on the bin tray 16 just shifted to the operative position.

On the other hand, if all the sets of copy sheets have been finished (YES in Step S33), the motor 32 is driven in the reverse direction to bring the punch 40 back to the home position P1 in Step S34 and the sheet finishing operation ends.

Figure 18A:
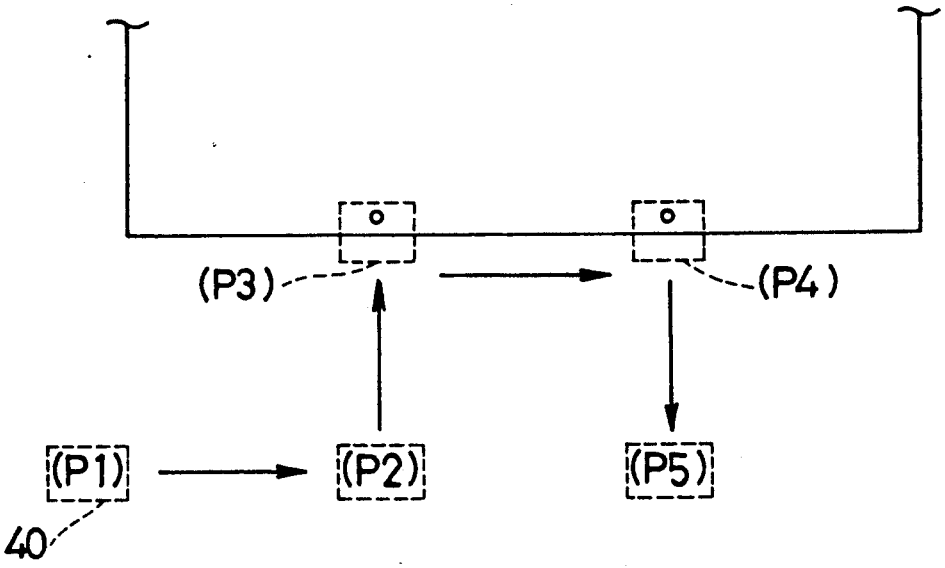
FIGS. 18A and 18B are diagrams showing other moving courses of the punch and punching positions.
Figure 18B:
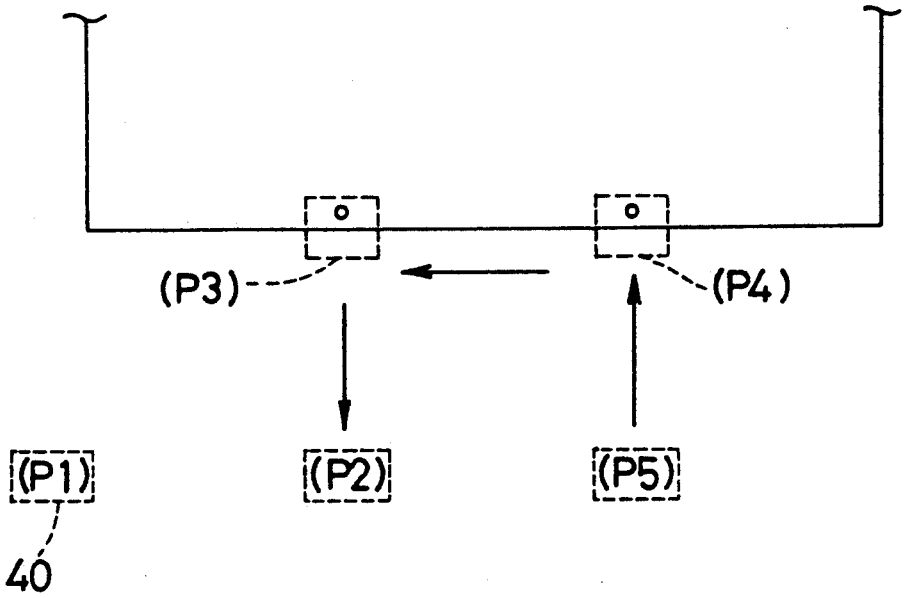

It will be appreciated that a course of movement of the punch 40 is not limited to the one shown in FIG. 17 according to the invention, and may be a course as shown in FIGS. 18A and 18B for example. More specifically, the punch 40 is paused at the position P5 without returning to the position P2 in Step S36 as shown in FIG. 18A. For the next set of copy sheets, the punching is applied first at the second finishing position P4 and then at the first processing position P3 as shown in FIG. 18B. Thereafter, the punch 40 is moved backwards to the position P2. In this way, it is also possible to alternately change a sequence of punching at the first finishing position P3 and second finishing position P4 each time a new set of copy sheets is set in the operative position.

In this embodiment, the second mode is described with respect to a case where punching is applied as a mechanical finishing. However, stapling may be applied in place of punching in the second mode by executing the similar control. Since the stapler 41 and punch 40 are mounted on the support 29 side by side along the moving direction of the support 29, the home positions thereof are different. Accordingly, the distance between the home positions of the stapler 41 and punch 40 in the moving direction of the support 29 should be taken into account in controlling the position of the stapler 41.

Further, in this embodiment, the second mode is described with respect to a case where the finishing is applied to two positions of each set of copy sheets. However, it should be understood that the sheet finishing operation of the invention can be controlled similarly to the above embodiment even if the finishing is to be applied to three or more positions of each set of copy sheets. In addition, the finishing can be applied to an any desired position of each set of copy sheets.

As described above, in the sheet finishing device of the invention, a finishing position is firstly calculated based on the finishing data stored in the storage 201, and the support 29 carrying the sheet finisher 28 is moved to the thus calculated position where the sheet finishing is in turn to be executed. Accordingly, the sheet finishing device 30 of the invention makes it possible that the sheet finishing is automatically performed at a desired position of copy sheets.

Also, the support 29 carrying the sheet finisher 28 is movable in the widthwise direction of the bin tray 16. Accordingly, the automatic sheet finishing can be performed at a plurality of positions in the widthwise direction of the copy sheets.

Further, the mount table 44 of the support 29, which is adapted for carrying the sheet finisher 28, is movable in the lengthwise direction of the bin tray 16. Accordingly, the automatic sheet finishing can be performed at an any desired position in the lengthwise direction of the copy sheet.

Also, the mount table 44 is provided with the first and second mounting portions 44*a* and 44*b*. Accordingly, two kinds of sheet finishers 28 can be mounted on the support 29, which thus enables two kinds of sheet finishing to be performed during a one direction movement of the support 29. Consequently, the sheet finishing can be performed for a shorter period. Moreover, the sheet finisher 28 can be removably mounted on the mount table 44. Accordingly, various sheet finishers 28 can be replaced with one another according to the needs.

Furthermore, the driving mechanism for moving the mount table 44 in the lengthwise direction of the bin tray 16 is provided on the center portion of the support 29, which consequently enables the support 29 to have a simpler construction compared with providing of driving mechanism on opposite side portions of the support 29.

Moreover, the sheet finishing device 30 is provided with the mount member 131. The sheet finisher 28, support 29, and frame 31*a* are assembled into a unit. The unit is removably mounted on the mount member 131. When providing the sheet finishing device 30 in a desired portion (in a sorting unit of an image forming apparatus in this embodiment), the mount member 131 is attached to an appropriate position, and the unit is then mounted on the mount member 131. Accordingly, the sheet finishing device 30 can be provided more easily. Also, the frame 31*a* of the unit is slidable on the mount member 131, which makes the mounting of the unit easier. Further, the slot 131*a* and roller 130 constitute means for stopping the unit temporarily, which assures a safe replacement of the sheet finisher 28.

Next, a second sheet finishing device of the invention which is mounted in the sorting unit 14 of the image forming apparatus will be described with reference to FIGS. 19 to 21. It will be appreciated that like or identical parts are designated by like or identical numerals in the first and second embodiments. The second sheet finishing device 30 is given an additional function of collecting paper waste produced as by-product of a sheet finishing operation.

The second sheet finishing device 30 is provided with a waste collector 420 including a container disposed below a movable range of a support 29 for collecting paper waste produced as by-product of a sheet finishing operation. A leveling member 421 is formed integrally with a base table 42, and accordingly movable in a widthwise direction of a bin tray 16, i.e. a direction vertical to the drawing of FIG. 19. The leveling member 421, extending downwards from a bottom portion of the base table 42 and facing the waste collector 420, is adapted for leveling off the paper waste unevenly heaped up in the waste collector 420 when moved in the widthwise direction together with the base table 42.

Figure 19:
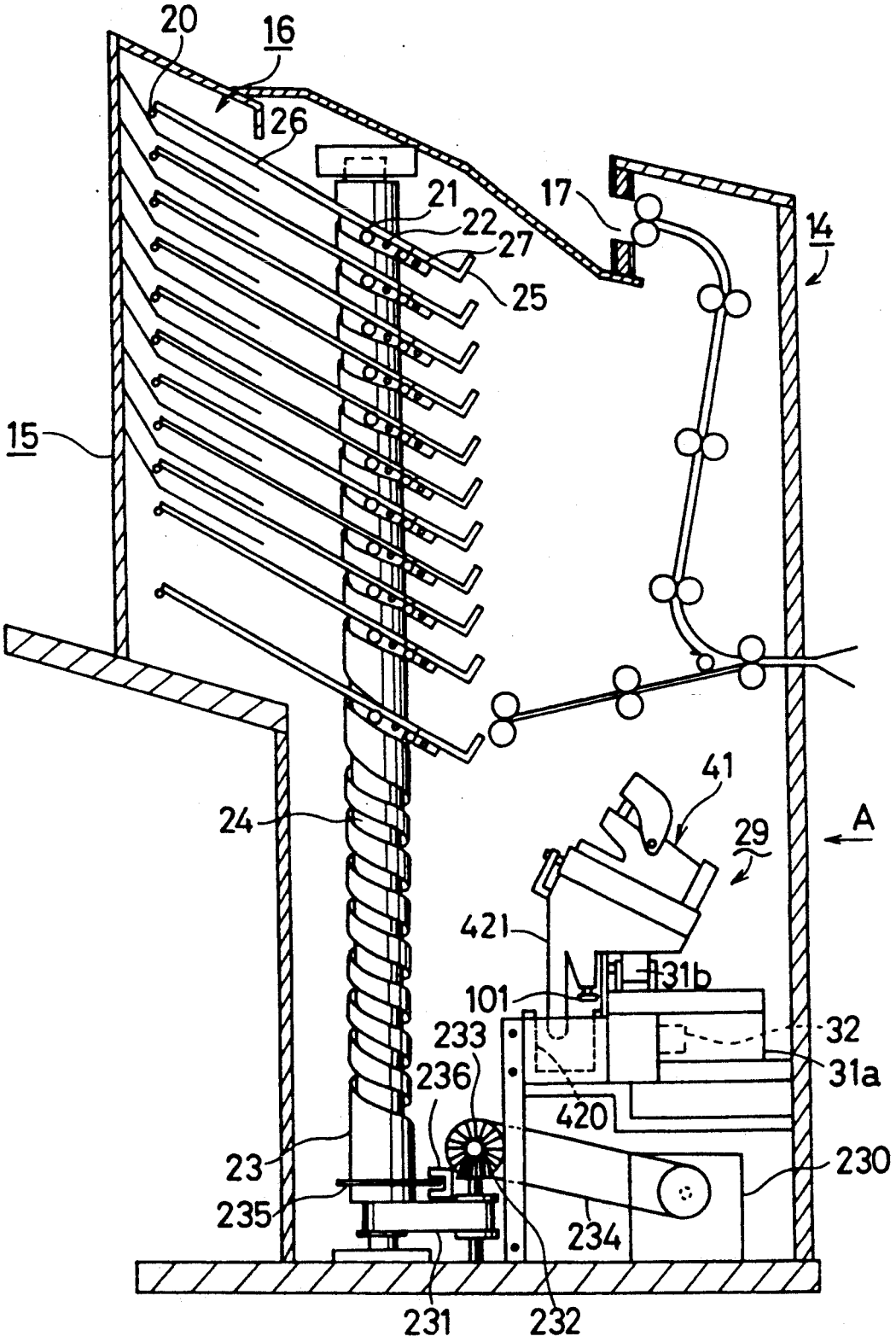
FIG. 19 is a longitudinal sectional view of a sorting unit in which a second automatic sheet finishing device of the invention is provided.
Figure 20:
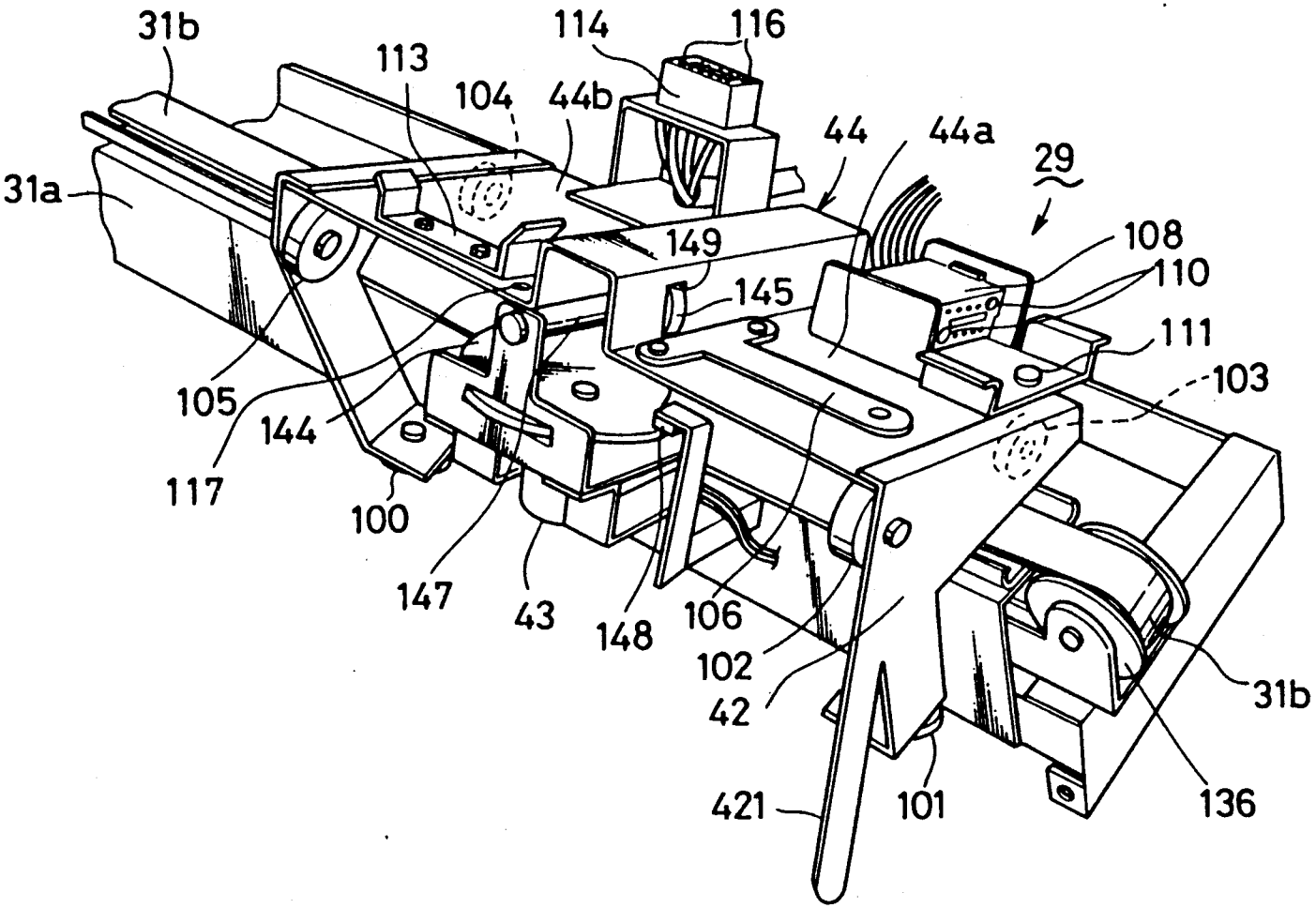
FIG. 20 is a perspective view showing a support and a drive transmission mechanism of the second automatic sheet finishing device, the support not carrying sheet finishers.
Figure 21:
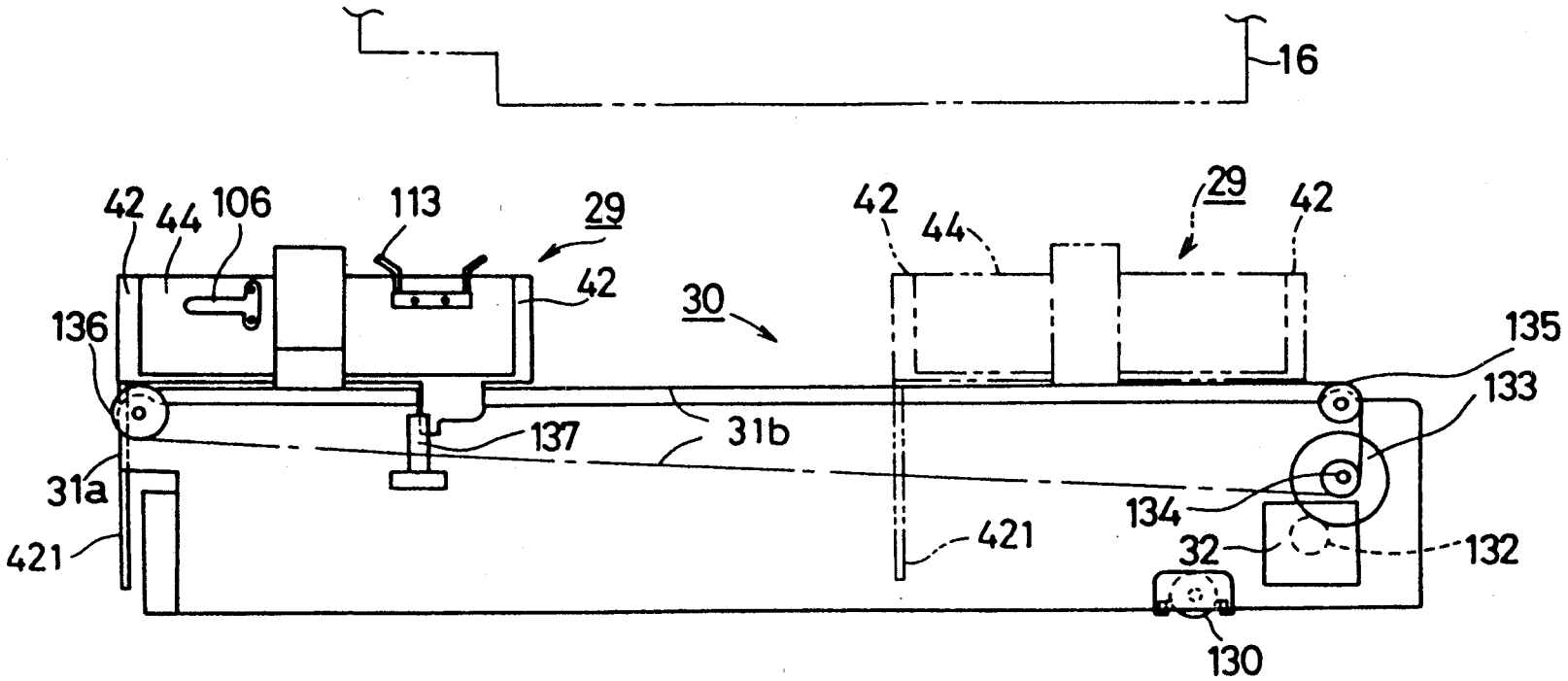
FIG. 21 is an elevational view seen from an arrow direction A in FIG. 2, showing a widthwise movement of the support.

It will be appreciated that the shape of the leveling member 421 is not limited to the one shown in FIGS. 19 to 21. For instance, the leveling member 421 is configured such that a lower end portion thereof has a width substantially equal to the width of the waste collector 420. With this leveling member 421, the paper waste can be leveled off uniformly in the waste collector 420. Further, the leveling member 421 may have a forked lower end portion so as to level off heaps of paper waste in the collector 420.

As described above, the sheet finishing device 30 is provided with the waste collector 420 for collecting paper waste as by-product of the sheet finishing operation below the movable range of the support 29, and the leveling member 421 extending downwards from the support 29 and facing the collector 420. Accordingly, all the paper waste can be collected reliably regardless of positions where the finishing is carried out. In addition, the paper waste unevenly heaped in the collector 420 can be prevented from locally overflowing therefrom, thereby preventing an occurrence of maloperations caused by the paper waste overflown into peripheral devices such as sensor and drive mechanism.

Next, a third sheet finishing device of the invention will be described with reference to FIGS. 22A to 24B. It will be appreciated that like or identical parts are designated by like or identical numerals in the first and third embodiments. The third sheet finishing device 30 has the identical function to the second sheet finishing device 30.

A support 29 of the third sheet finishing device 30 has a rear portion slidably supported by a shaft 243. Rollers 29*a* are mounted at specified positions on a rear face of the support 29, and slidably supported on a rail 244. The shaft 243 and rail 244 extend in a widthwise direction of the bin tray 16.

Figure 22A:
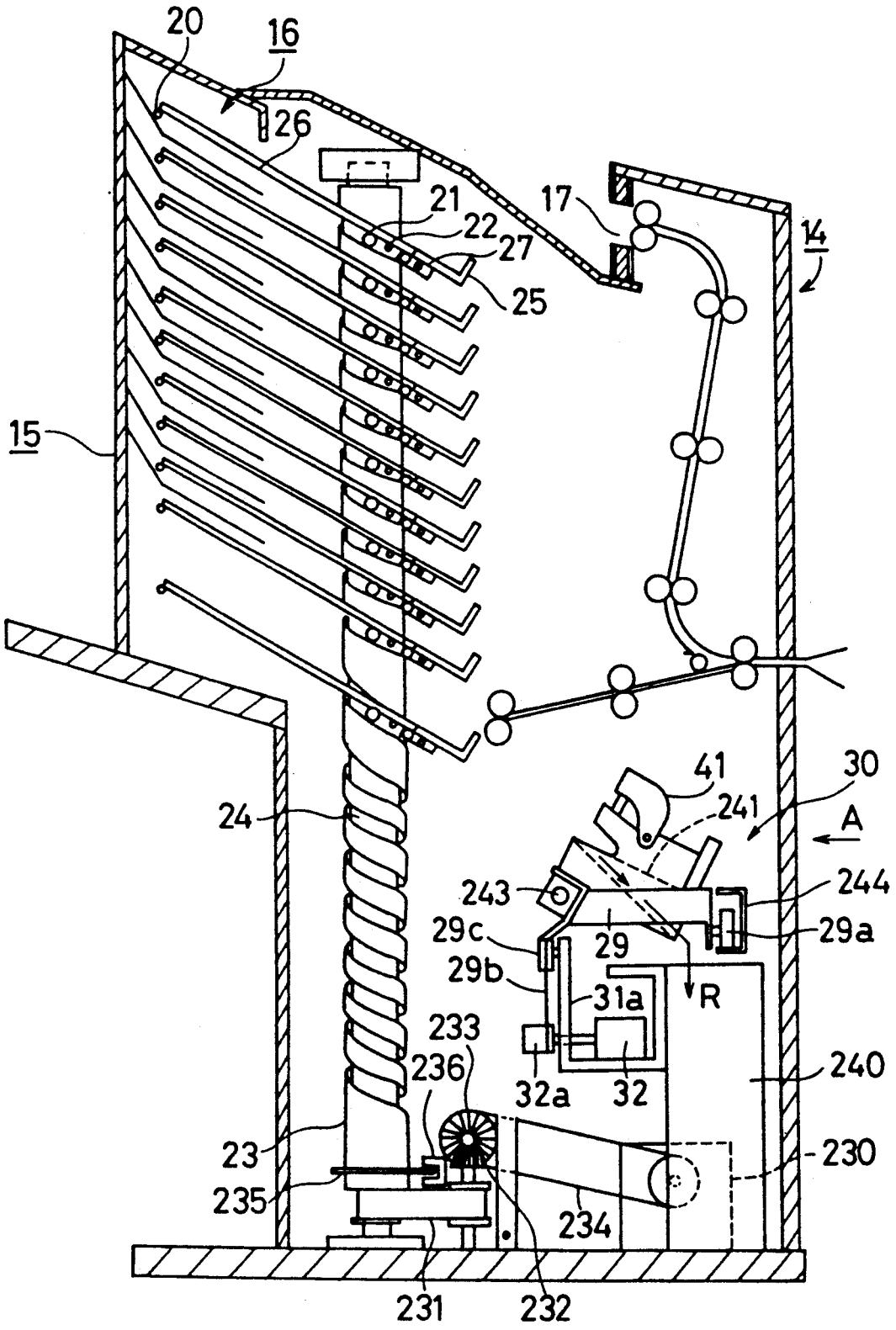
FIG. 22A is a longitudinal sectional view of a sorting unit in which a third automatic sheet finishing device of the invention is provided.
Figure 22B:
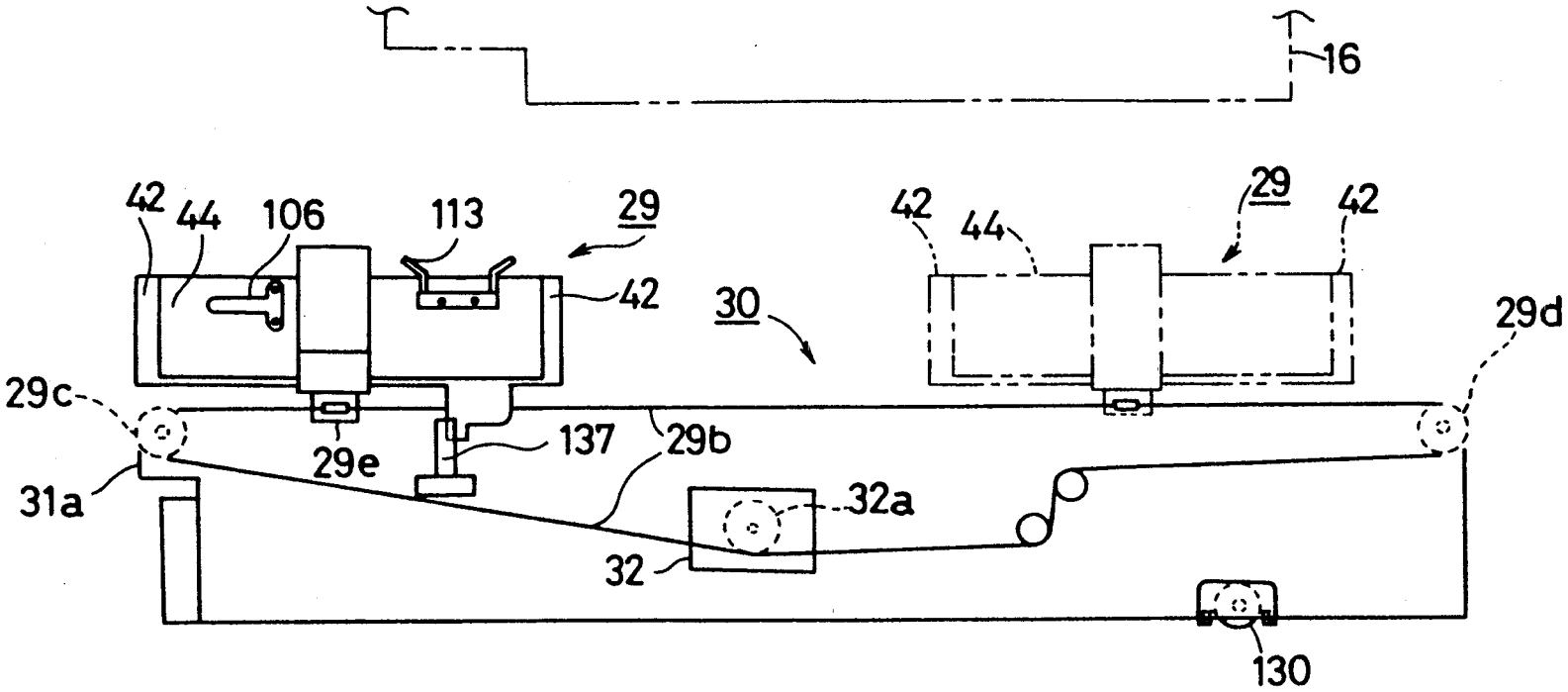
FIG. 22B is an elevational view seen from an arrow direction A in FIG. 22A.
Figure 23:
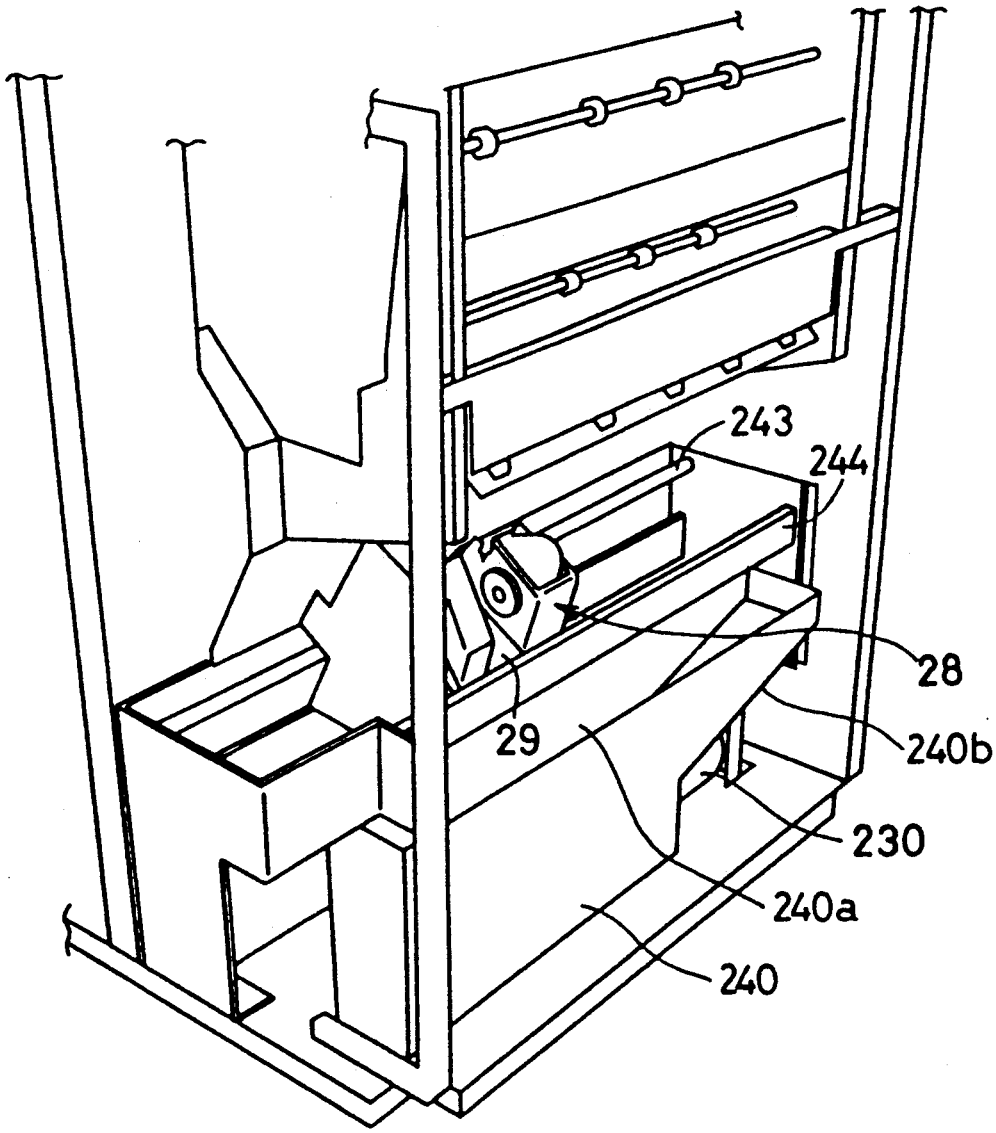
FIG. 23 is a perspective view showing the third automatic sheet finishing device mounted on the sorting unit.

As shown in FIG. 22B, the support 29 is fixedly connected to a wire 29*b* at a specified portion of a front end thereof. The wire 29*b* is wounded on pulleys 29*c*, 29*d*, and 32*a*. The pulley 32*a* is connected to a motor 32. The wire 29*b* is rotated by driving the motor 32 in forward and reverse directions, and thereby the support 29 moves reciprocally.

In this way, the support 29 moves reciprocally along the shaft 243 and rail 244, enabling a sheet finisher 28 mounted on the support 29 to apply a specified finishing to a rear end portion of a set of copy sheets in a desired position.

Also, the third sheet finishing device 30 is provided with a waste collector 240 for collecting paper waste produced as by-product of the sheet finishing operation. The collector 240 extends in the moving direction of the support 29, and is independently detachable from the main body of the sheet finishing device 30. The collector 240 is provided below a rear portion of the support 29 (a right side portion thereof in the drawing of FIG. 22A) so as to avoid interference with the driving mechanism.

Figure 24A:
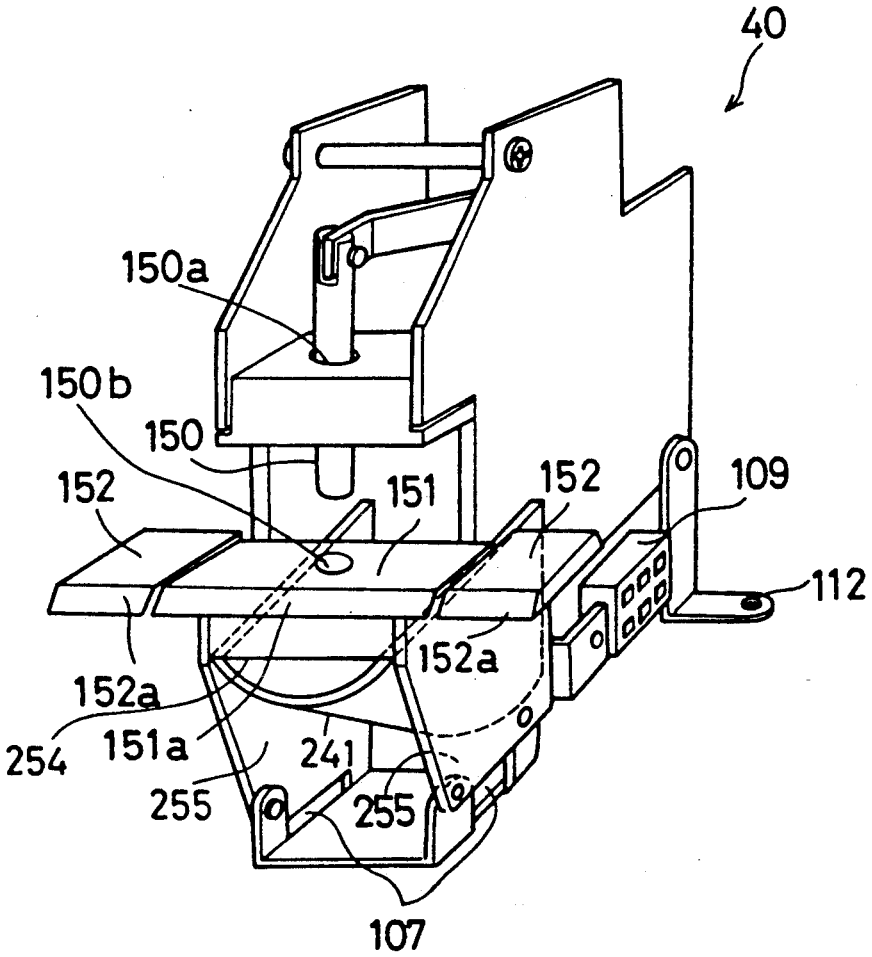
FIG. 24A is a perspective view showing a construction of a punch for the third automatic sheet finishing device.
Figure 24B:
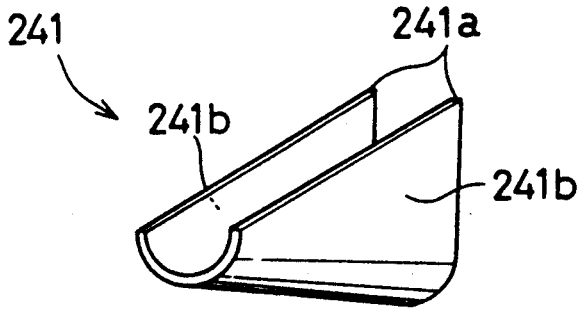
FIG. 24B is a perspective view showing configuration of an introducing member mounted to the punch of FIG. 24A.

An introducing member 241 is formed by curving polyester film or like low friction material in the shape of a trapezoid in such a manner as to have a U-shaped cross-section as shown in FIG. 24B. Thus formed introducing member 241 is disposed in the punch 40 with top end surfaces 241*a* of the introducing member 241 facing an underside face 254 of the punch 40 and with side surfaces 241*b* of the introducing member 241 facing inner side surfaces 255 of the punch 40 as shown in FIG. 24A.

Paper waste produced by the operation of the punch 40 falls to the introducing member 241, and slides down along a bottom of the member 241 in an arrow direction R shown in FIG. 22A due to the weight thereof. Consequently, the paper waste is introduced into the waste collector 240 through an opening 240*a*.

As described above, the sheet finishing device 30 is provided with the waste collector 240 disposed below the rear portion of the support 29 and having the opening 240*a* extending the movable range of the support 29, and introducing member 241 for introducing the paper waste as by-product of the sheet finishing operation into the collector 240. Accordingly, all the paper waste produced can be reliably collected, and the waste collector 240 is allowed to have a large capacity. Hence, a burden of maintenance and inspection including waste disposal can be lighted, and there can be prevented an occurrence of maloperations caused by the paper waste overflown into peripheral devices such as sensor and drive mechanism.

The material for the introducing member 241 is not limited to polyester, but any material is applicable as long as its has low coefficient of friction. Also, the introducing member 241 may be screwed to, tightly held by or engaged with the sheet finisher 28 in order to be mounted thereto. In this embodiment, the introducing member 241 is so formed as to introduce paper waste in a fixed direction. However, the introducing member 241 may be so formed as to have a variable waste introducing direction, such that the paper waste can be introduced to the waste collector 240 disposed in a desired position.

Further, in order to avoid interference with the motor 230 for driving the cylinder 23, the waste collector 240 is formed with a slanting bottom portion 240*b*. This slanting bottom portion 240*b* also has an advantage of introducing the paper waste into a deeper portion of the waste collector 240 from the portion raised to avoid the interference with the motor 230.

In this embodiment, the first drive transmission mechanism is different from the one described in the first embodiment. However, the waste collector 240 and introducing member 241 can be adopted in the first embodiment merely by changing the disposition position of the collector 240 and changing the shape of the introducing member 241 according to the position of the collector 240.

Next, a fourth sheet finishing device of the invention will be described with reference to FIGS. 25A to 26C. It will be appreciated that like or identical parts are designated by like or identical numerals in the first and fourth embodiments.

Figure 11:
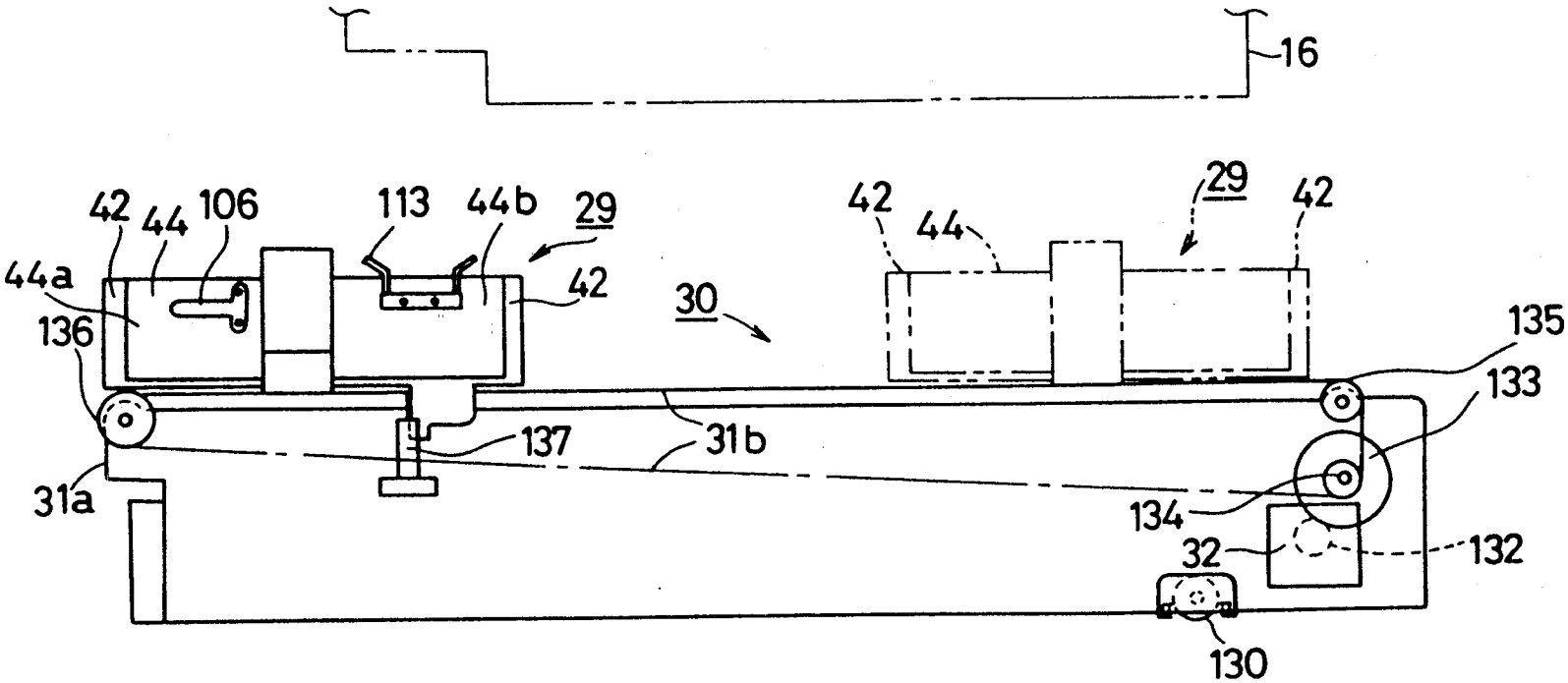
FIG. 11 is an elevational view seen from an arrow direction A in FIG. 2, showing a widthwise movement of the support.

In this embodiment, a stand-by position for a support 29 is provided at an opposite side of a home position (at right side in FIG. 11) as indicated by phantom line in FIG. 11.

The fourth sheet finishing device is applicable for a sorter having a plurality of bin trays 16 for holding a set of copy sheets, and operable to execute sheet finishing on the copy sheet set at a plurality of positions thereof. In this sheet device, to assure high efficiency, after completing the application of last sheet to the copy sheet set on one bin tray 16, comparing distances to the home position and stand-by position from the position at which the sheet processing is last applied to the copy sheet set on one bin tray 16, are determined and a sheet finisher of the sheet finishing device is moved to closer one of the home position and stand-by position.

Figure 13:
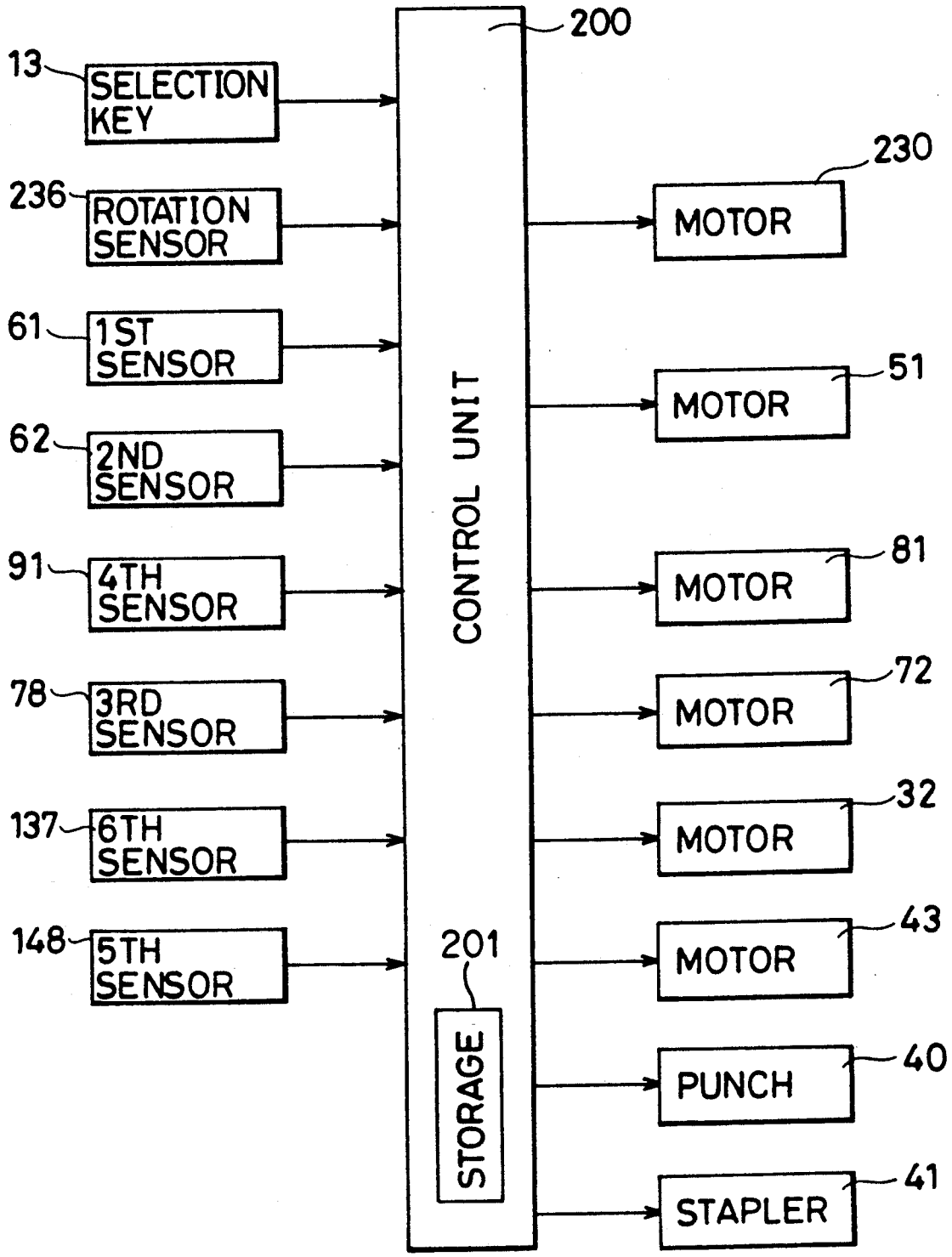
FIG. 13 is a block diagram showing a control system of the first automatic sheet finishing device.

The fourth sheet finishing device has a control system similar to the control system of the first sheet processing device, which is shown in FIG. 13.

In the fourth sheet finishing device, the storage 201 stores, in addition to the functions of the first sheet finishing device, a distance between the home position and the stand-by position and a distance between the home position and each of a plurality of specified finishing positions of a sheet finisher 28 such as punch 40 and stapler 41.

Also, the control unit 200 has, in addition to the functions of the first sheet finishing device, a function of comparing a distance between the home position and last finishing position with a distance between the stand-by position and last finishing position, and discriminating whether the last finishing position is closer to the home position or stand-by position. The last finishing position is a position where the sheet finishing is last applied to a set of copy sheets placed on each bin tray 16.

In the case where the support 29 is in the home position prior to the sheet finishing operation, the control unit 200 controls motors 32, 43 and sheet finisher, 28 so that the finishing is applied to the copy sheet set sequentially from a finishing position closest to the home position. On the contrary, in the case where the support 29 is in the stand-by position, the control unit 200 controls the motors 32, 43 and sheet finisher 28 so that the finishing is applied to the copy sheet set sequentially from a finishing position closest to the stand-by position.

Next, a procedure of the sheet finishing operation will be described. Description on a basic operation procedure and an operation procedure in a first mode is not to given here since being the same as those described with reference to FIGS. 14 and 15.

An operation procedure in a second mode will be described with reference to FIGS. 25A to 26C.

Figure 25A:
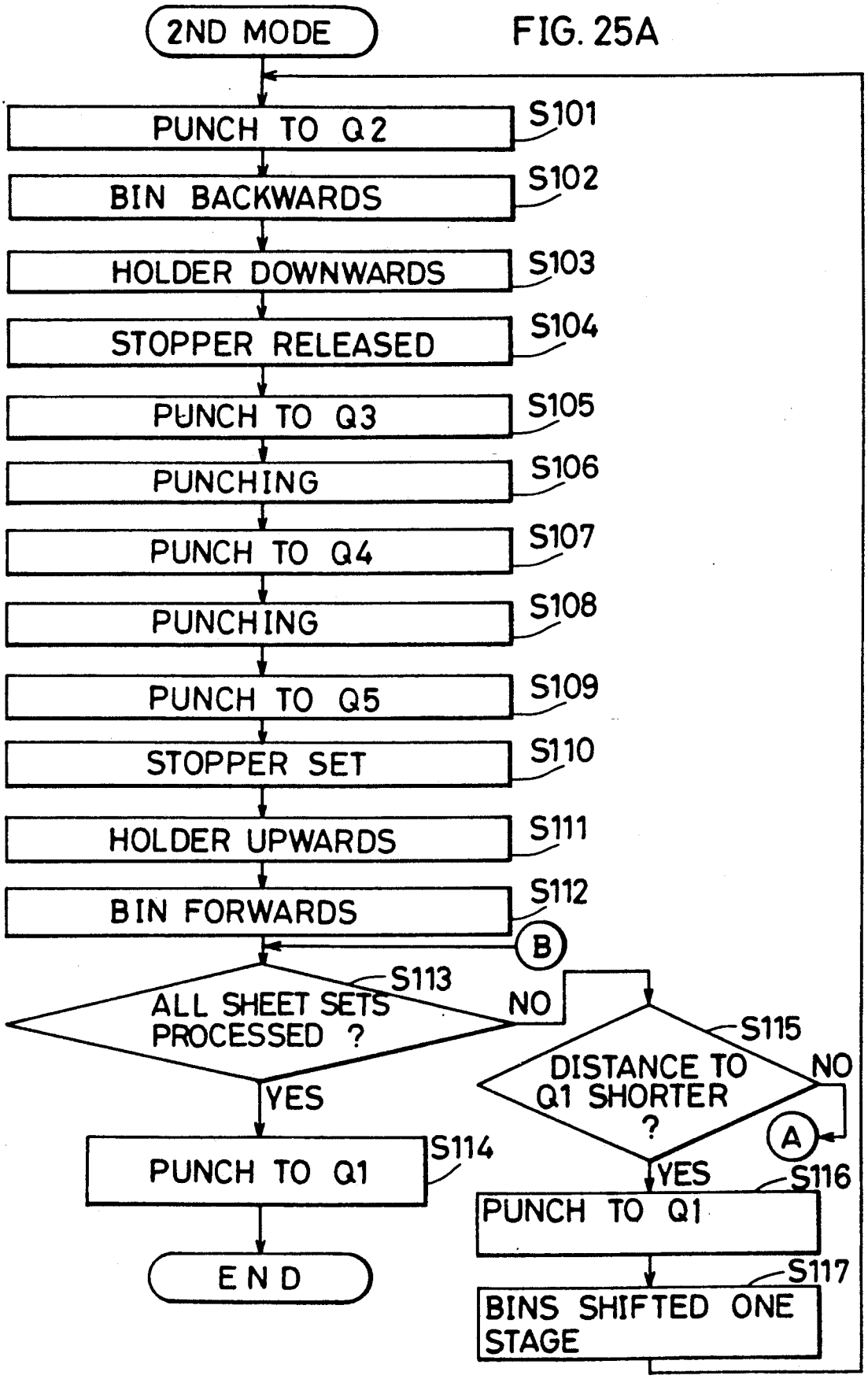
FIGS. 25A and 25B are a flow chart showing an operation procedure of a second mode in a fourth automatic sheet finishing device of the invention.
Figure 25B:
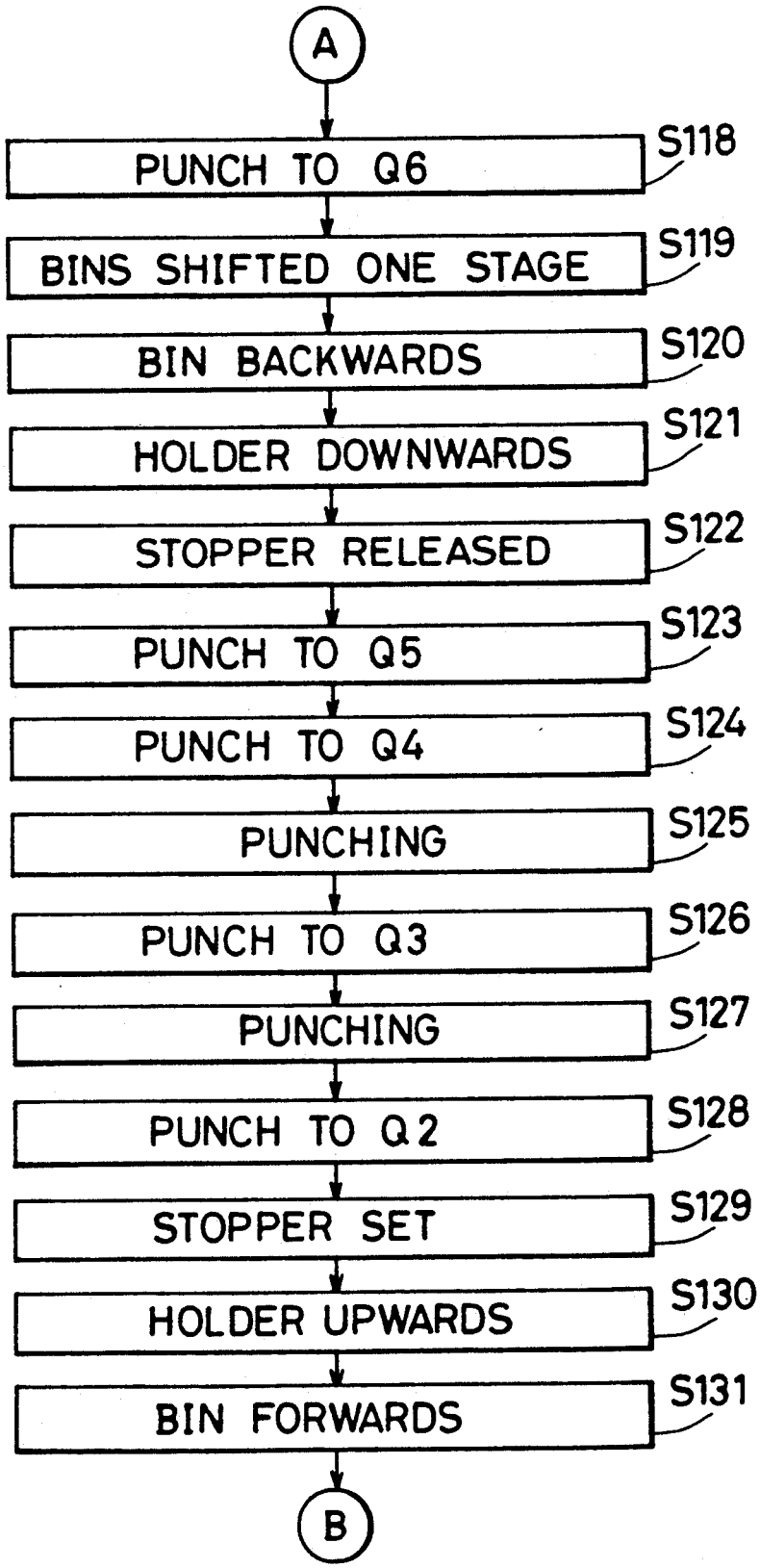

FIGS. 25A and 25B are a flow chart showing an operation procedure wherein the finishing is applied to a rear end portion of the copy sheet set in two transversely spaced apart positions. In this operation, the punching is applied to the copy sheet set in a first punching position Q3 and a second punching position Q4 as an example.

Figure 26A:
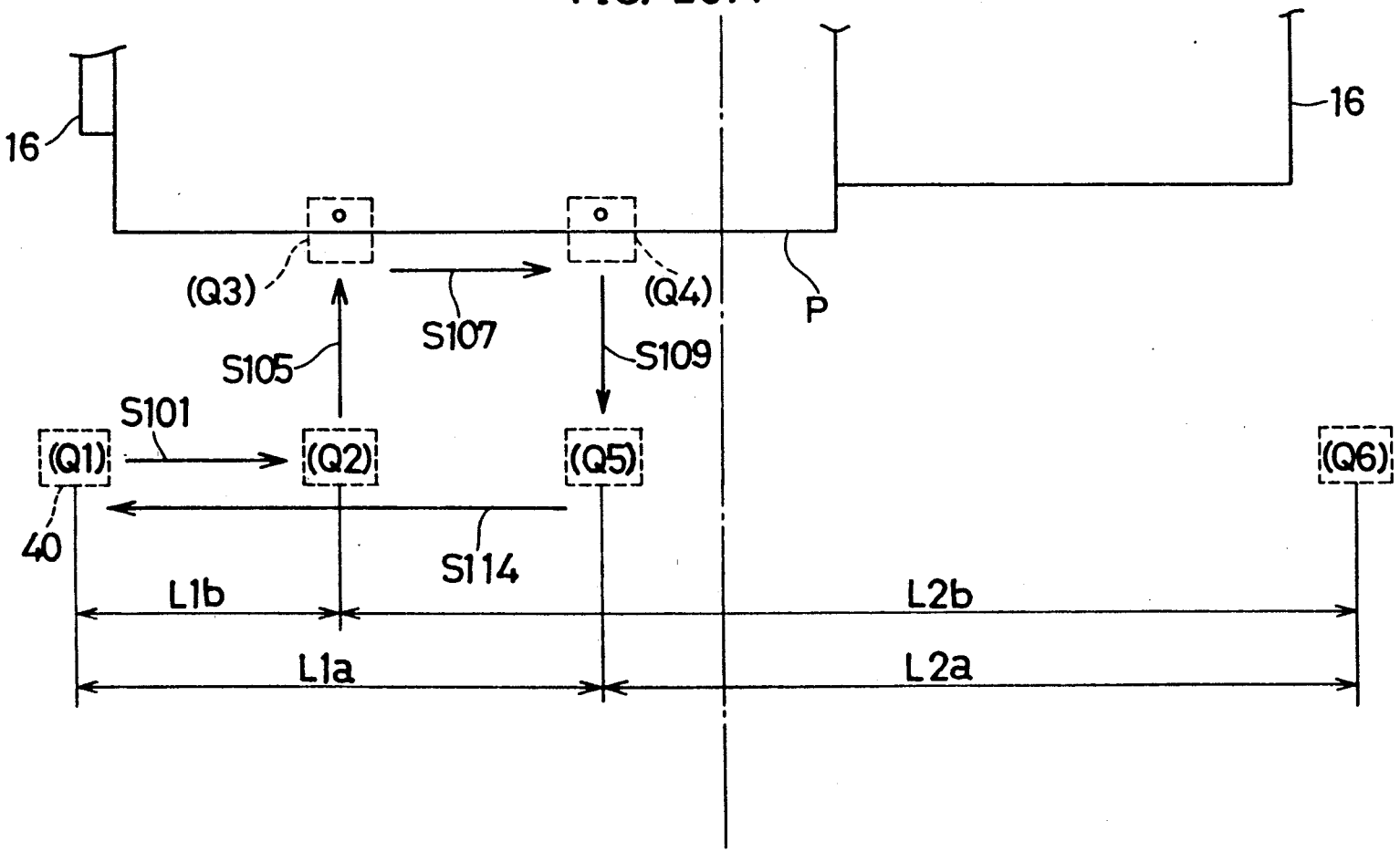
FIGS. 26A to 26C are diagrams showing moving courses of a punch of the fourth automatic sheet finishing device.
Figure 26B:
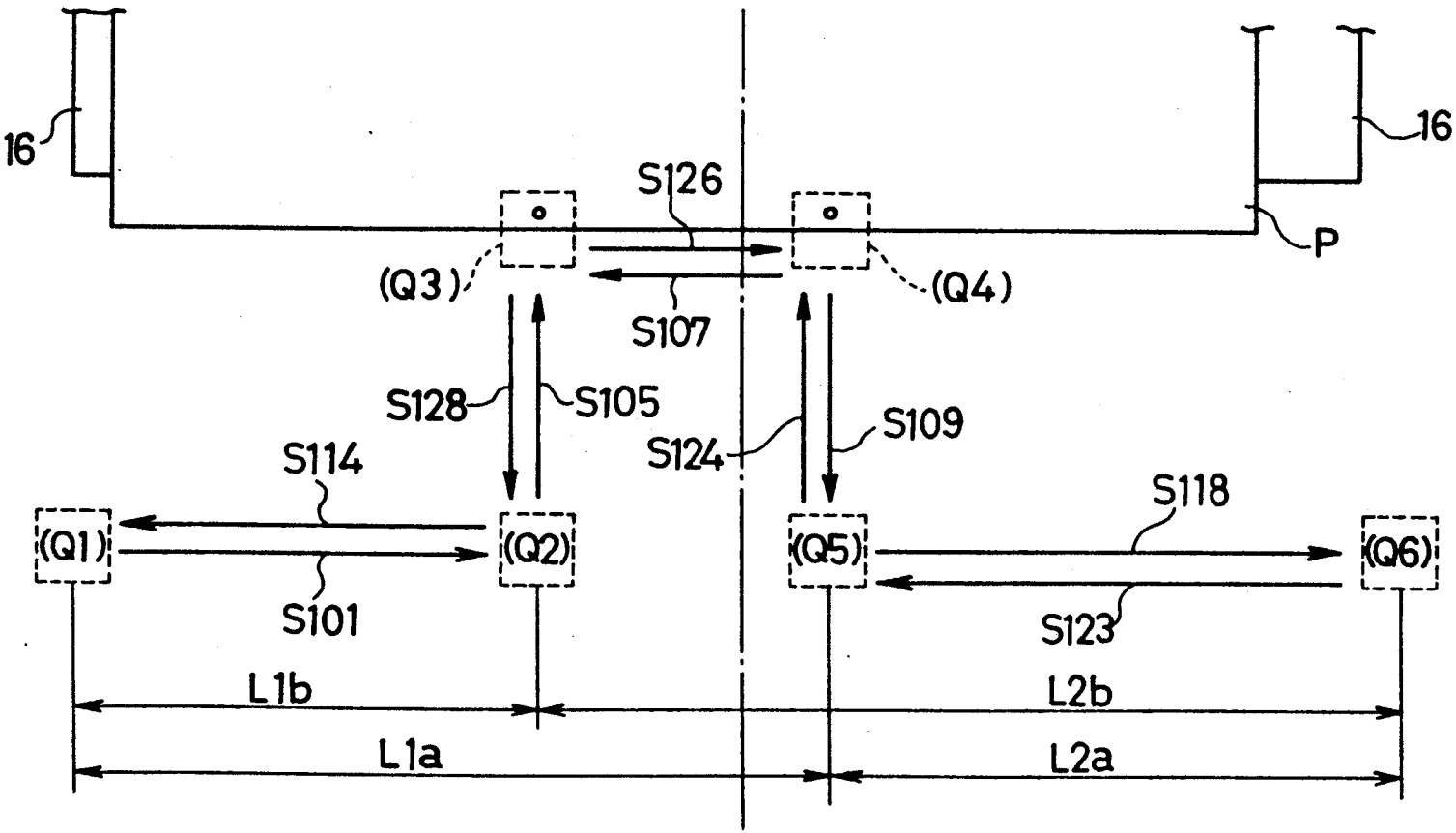
Figure 26C:
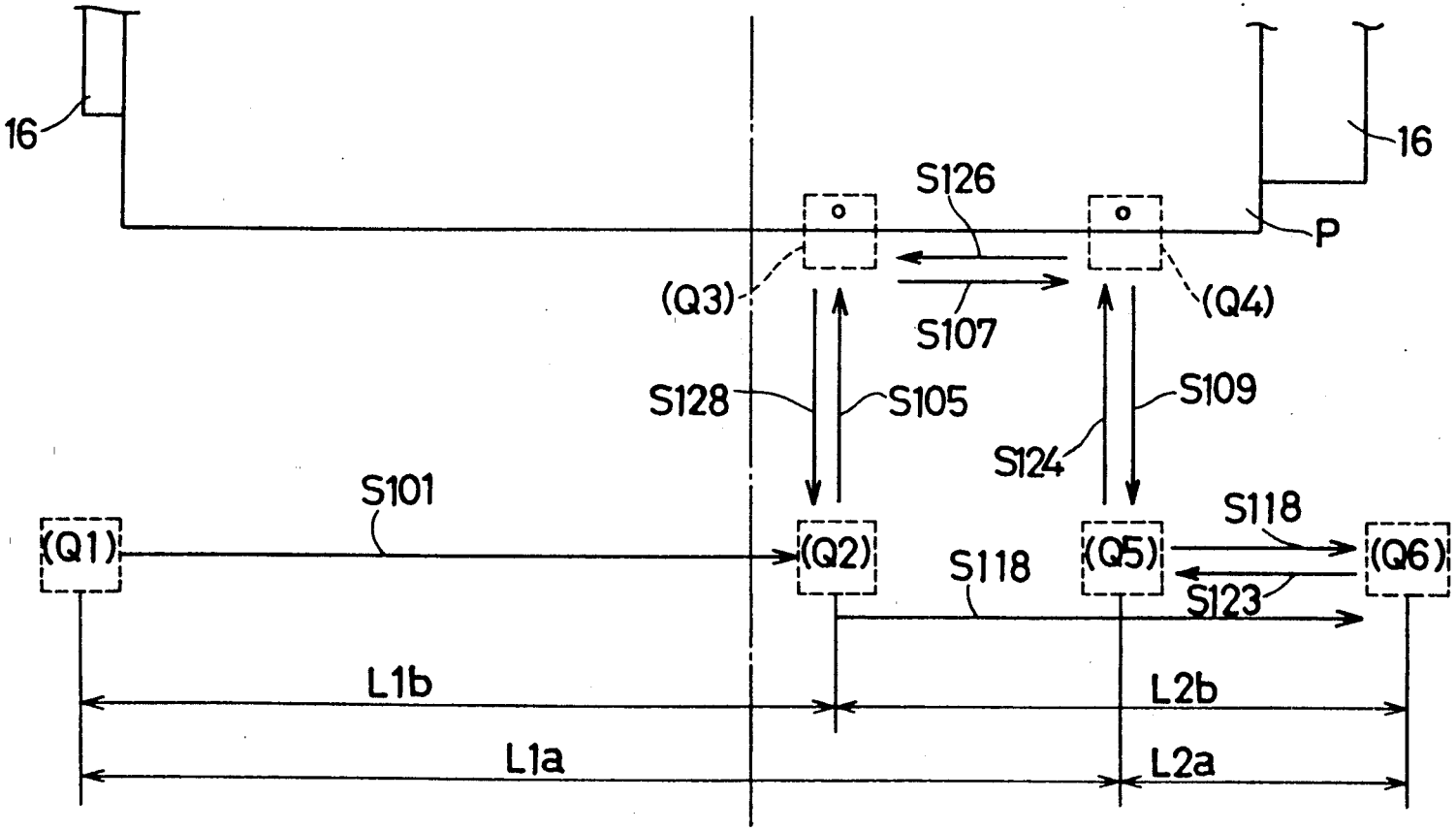

FIGS. 26A to 26C are diagrams showing courses of movement of the punch 40 and punching positions.

FIG. 26A shows movement of the punch 40 in a case where a distance L1*a* is shorter than a distance L2*a* and a distance L1*b* is shorter than a distance L2*b*. The distance L1*a* is defined by a home position Q1 and a position Q5 opposing the second punching position Q4. The distance L2*a* is defined by the position Q5 and stand-by position Q6. The distance L1*b* is defined by the home position Q1 and position Q2 opposing the first punching position Q3. The distance L2*b* is defined by the position Q2 and stand-by position Q6.

FIG. 26B shows movement of the punch 40 in a case where the distance L1*a* is longer than the distance L2*a*, and the distance L1*b* is shorter than the distance L2*b*.

FIG. 26C shows movement of the punch 40 in a case where the distance L1*a* is longer than the distance L2*a*, and the distance L1*b* is longer than the distance L2*b*.

Let it be assumed that the punch 40 is in the home position Q1 before the punching to a copy sheet set placed on the first bin tray 16 is started.

Firstly, in order to apply the punching to the copy sheet set P placed on the first bin tray 16, the motor 32 is driven to move the punch 40 in the widthwise direction of the sheet from the home position Q1 to the position Q2 in Step S101. Subsequently, a motor 51 is driven to move the bin tray 16 to a retracted position in Step S102. In Step S103, a motor 81 is driven to move a holder 86 downwards so as to pressingly hold the copy sheet set P. Then, a motor 72 is driven to release a stopper 25 of the bin tray 16 in Step S104. As described above, pressingly held by the holder 86, the copy sheet set P is not to droop even after the stopper 25 is released.

Thereafter, the motor 43 is driven to move a mount table 44 forwards to the first punching position Q3, and thereby the copy sheet set P is set on a table 151 and auxiliary tables 152 in Step S105. In Step S106, the punch 40 is actuated to make a hole in the copy sheet set P at the first punching position Q3 in Step S106. Subsequently, the motor 43 is driven to move the punch 40 further in the widthwise direction up to the second punching position Q4 in Step S107. Then, the punch 40 is actuated again to make a hole in the copy sheet set P in the second punching position Q4 in Step S108. In Step S109, the motor 43 is driven in the reverse direction to move the mount table 44 backwards up to the position Q5.

Thereafter, the motor 72 is further driven in the same direction to move the stopper 25 back to an original (aligning) position in Step S110. After the holder 86 is returned to its original position by means of the motor 81 in Step S111, the motor 51 is further driven in the same direction to move the bin tray 16 forwards back to its original position in Step S112.

Subsequently, in Step S113, it is discriminated whether the punching is applied to all the sets of copy sheets on the bin trays 16. If the punching has been applied to all the available copy sheet sets (YES in Step S113), the motor 32 is driven in the reverse direction to move the punch 40 back to the home position Q1 in Step 114 and thereby the sheet finishing (punching) operation ends.

Unless all the copy sheet sets have been processed (NO in Step S113), it is discriminated whether the distance L1*a* is shorter than the distance L2*a* in Step S115.

If the distance L1*a* is shorter than the distance L2*a* as shown in FIG. 26A (YES in Step S115), the punch 40 is caused to move back to the home position Q1 by means of the motor 32 and to pause thereat in Step S116. Then, in Step S117, the motor 230 is driven to shift a stack of bin trays 16 upwards or downwards by one stage so as to set a next bin tray in the operative position.

Thereafter, this routine returns to Step S101 and operations executed in Steps S101 to S117 are repeated for each set of copy sheets until the copy sheet sets placed on all the bin trays 16 are finished. Upon completion of the finishing to the copy sheet set placed on one bin tray 16, the punch 40 waits in the home position until the next bin tray 16 is set in the operative position.

On the other hand, if the distance L2*a* is shorter than the distance L1*a* as shown in FIG. 26B (NO in Step S115), the punch 40 is caused to move further in the widthwise direction up to the stand-by position Q6 by means of the motor 32 and to pause thereat in Step S118.

Subsequently, in Step S119, the motor 230 is driven to shift the stack of bin trays upwards or downwards by one stage so that the punching can be applied to a copy sheet set placed on the next bin tray 16. Similarly to the operations of Steps S102 to S104, this bin tray 16 is moved to the retracted position, the holder 86 is moved downwards to pressingly hold the copy sheet set P, and the stopper 25 is released in Steps S120 to S122.

Then, the motor 32 is driven in the reverse direction to move the punch 40 from the stand-by position Q6 to the position Q5 opposing the second punching position Q4 which is the finishing position closest to the position Q6 in Step S123. Thereafter, in Step S124, the motor 43 is driven to move the punch 40 forwards to the second punching position Q4, and thereby the copy sheet set P is placed properly on the punch 40.

After making a hole in the copy sheet P at the second punching position Q4 in Step S125, the punch 40 is moved to the first punching position Q3, which is the last finishing position, by means of the motor 32 in Step S126. Then, in Step S127, the punch 40 is actuated to make a hole in the copy sheet set P at the position Q3.

Subsequently, the punch 40 is moved backwards to the position Q2 by means of the motor 43 in Step S128, and the stopper 25 is returned to the aligning position by means of the motor 72 in Step S129. After the holder 86 is returned to the original position by means of the motor 81 in Step S130, the bin tray 16 is moved forwards to the original position by means of the motor 51 in Step S131.

Then, this routine returns to Step S113. If there still remains a copy sheet set to be finished (NO in Step S113), it is discriminated whether the distance L1*b* is shorter than the distance L2*b* in Step S115.

Since the distance L1*b* is shorter than the distance L2*b* as shown in FIG. 26B (YES in Step S115), the punch 40 is caused to move to the home position Q1 and to pause thereat in Step S116.

In this way, the punch 40 waits on stand-by for a next copy sheet set P to be set alternately in the stand-by position Q6 and home position Q1 until all the copy sheet sets P are punched.

Further, in the case where the punching positions are located as shown in FIG. 26C, the operations of Steps S101 to S131 are executed similarly to the aforementioned case shown in FIG. 26B in a first run. After Step S131 of the first run, unless all the copy sheet sets P have been punched yet (NO in Step S113), the punch 40 is caused to move to the stand-by position Q6 and to pause thereat in Step S118 since the distance L1*b* is longer than the distance L2*b* (NO in Step S115).

In this case, the punch 40 waits on stand-by for a next copy sheet set P to be set in the stand-by position Q6 until all the copy sheet sets P are punched.

As described above, it is discriminated whether the last finishing position for each copy sheet set P is closer to the home position (a first stand-by position) Q1 or stand-by position (a second stand-by position) Q6. Upon completion of the punching to the copy sheet set P, the punch 40 is caused to move to the closer of the position Q1 or Q6 and to wait there on stand-by until the stopper 25 of the next bin tray 16 is released. Accordingly, the sheet finishing can be performed for a reduced time.

Also, the application of sheet finishing to the copy sheet set on the next bin tray 16 is started from the finishing position closer to the waiting position in the earlier bin tray 16. Accordingly, the finishing time can be reduced further and the sheet finishing can be performed at high speed, which improves the efficiency of a sheet finishing device.

In this embodiment, the punching is performed. However, stapling operation can be executed in accordance with the flow chart of FIGS. 25A and 25B. Further, a plurality of sheet finishings, e.g., punching and stapling, can be executed in accordance with the flow chart of FIGS. 25A and 25B.

In this embodiment, discrimination on whether the last finishing position is closer to the home position Q1 or stand-by position Q6 is made after the finishing is applied in the last finishing position, i.e. in Step S113. However, since the processing positions such as punching positions are generally determinable in a standardized manner, the above discrimination may be made when the size of copy sheets are designated through the copy sheet size key.

Thus obtained discrimination result may be stored in a storage 201, and movement of the sheet finisher 28 may be controlled based on the stored discrimination result. For instance, in the case as shown in FIG. 26B, the storage 201 stores information indicating that the sheet finisher 28 waits on stand-by for a next copy sheet set alternately in the stand-by position Q6 and home position Q1.

This embodiment is described with respect to a case where two finishing positions are provided. However, the sheet finishing device can be controlled in a similar fashion in cases where the finishing is applied in three or more positions and where the finishing is applied in desired positions.

Further, the home position and stand-by position may be exchanged with each other. Specifically, the home position may be located at the right side in FIG. 11 and the stand-by position may be located at the left side in FIG. 11. In this case, it may be appropriate to provide a door 14*a* on an opposite side wall of the sorting unit 14 as well.

Next, a fifth sheet finishing device of the invention will be described with reference to FIGS. 27A to 28B. It will be appreciated that description on a construction of the fifth embodiment is not to be given since it is the same as the construction of the first embodiment. This embodiment aims at improving the efficiency of a plurality of sheet finishings different from each other by changing sequence of the sheet finishings in accordance with change in the distance between the sheet finishings.

A sheet finishing operation procedure in the fifth embodiment will be described. Description on a basic operation procedure and an operation procedure in a first mode is not to be given here since being the same as those described with reference to FIGS. 14 and 15.

An operation procedure in a second mode will be described with reference to FIGS. 27A to 28B.

Figure 27A:
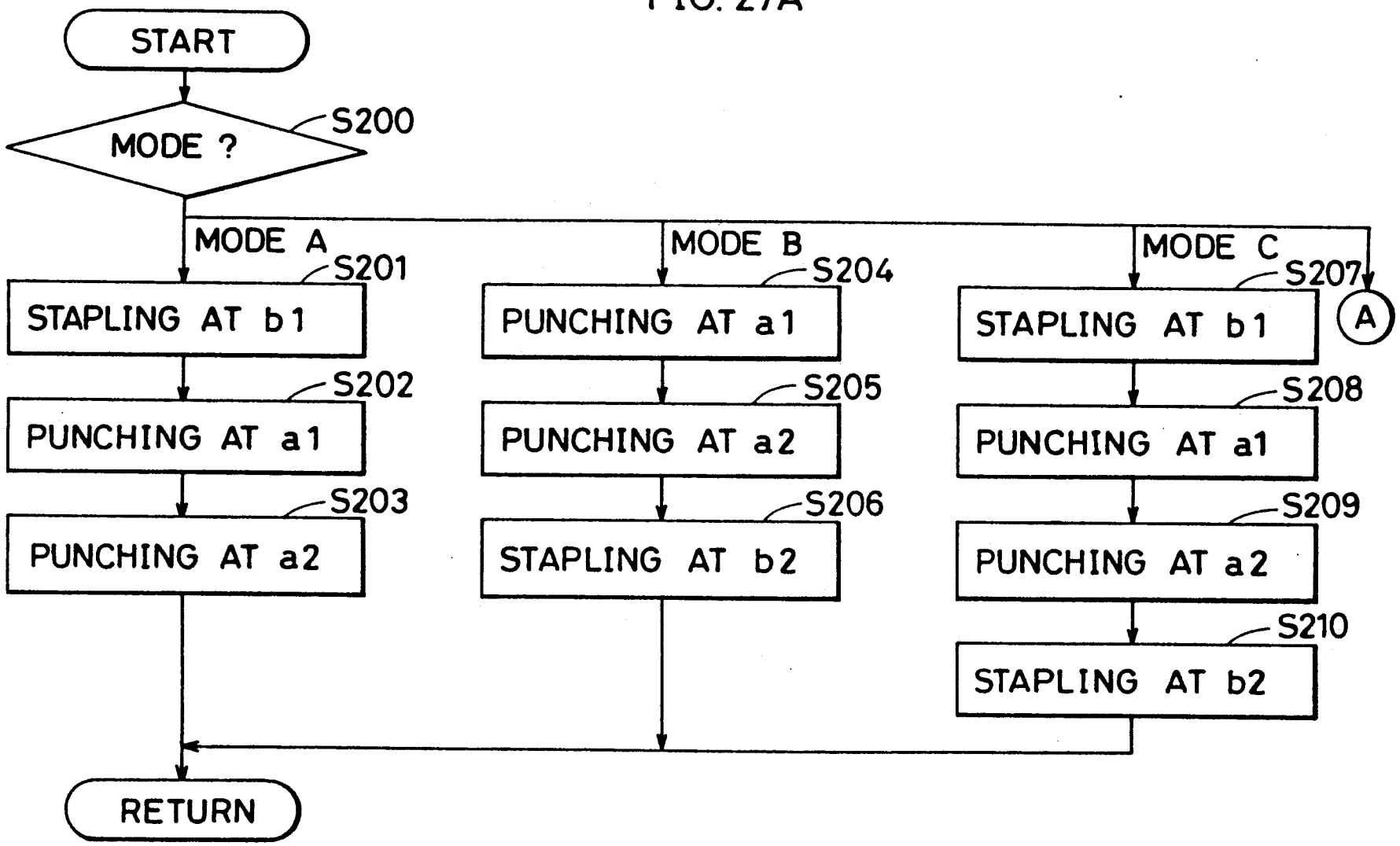
FIGS. 27A and 27B are a flow chart showing an operation procedure of a second mode of a fifth automatic sheet finishing device of the invention.
Figure 27B:
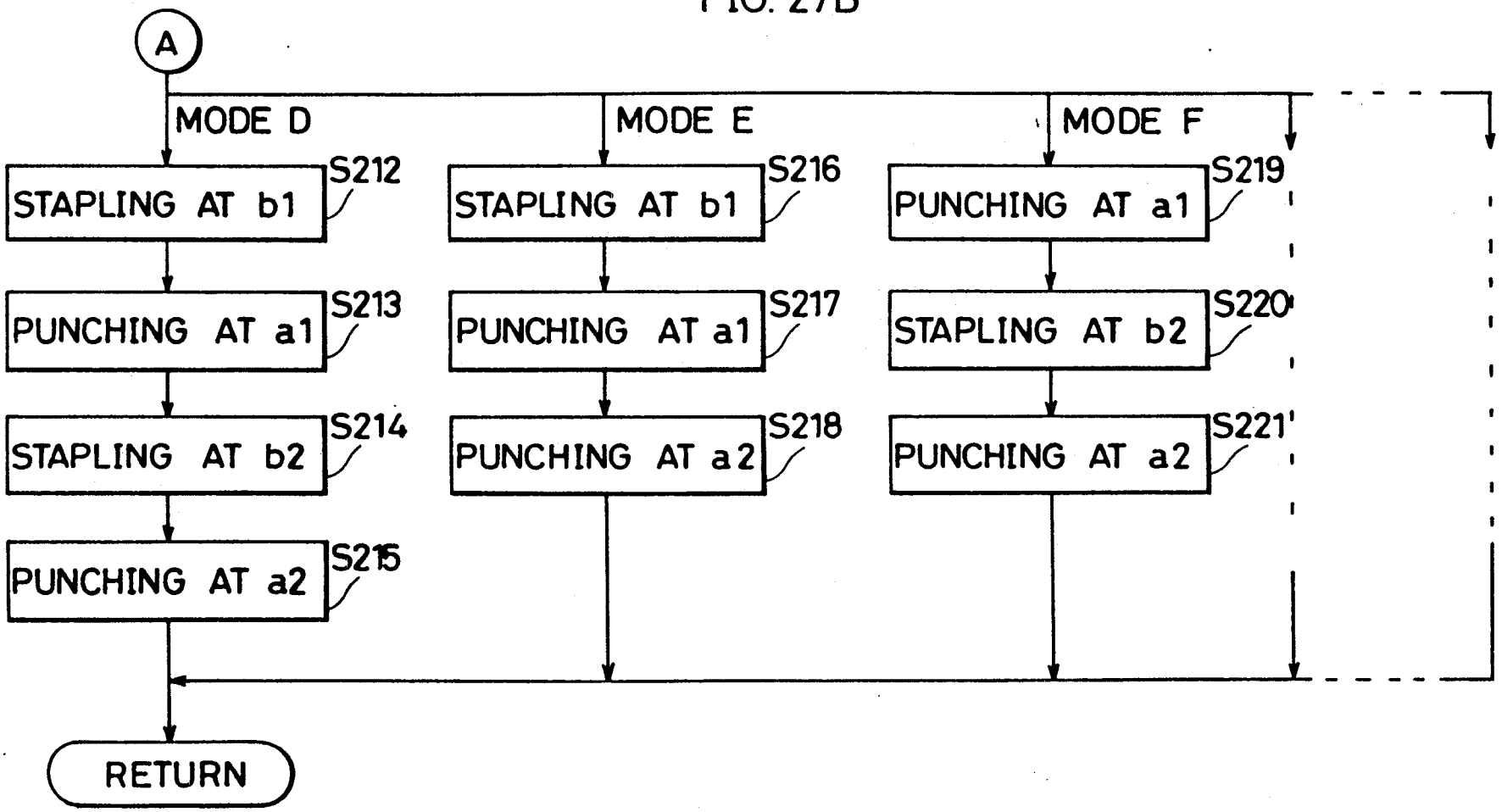

FIGS. 27A and 27B are a flow chart showing an operation procedure wherein the finishing is applied to a rear end portion of a copy sheet set P in two transversely spaced apart positions. In this operation, the punching and stapling are applied to the copy sheet set P as an example.

Figure 28A:
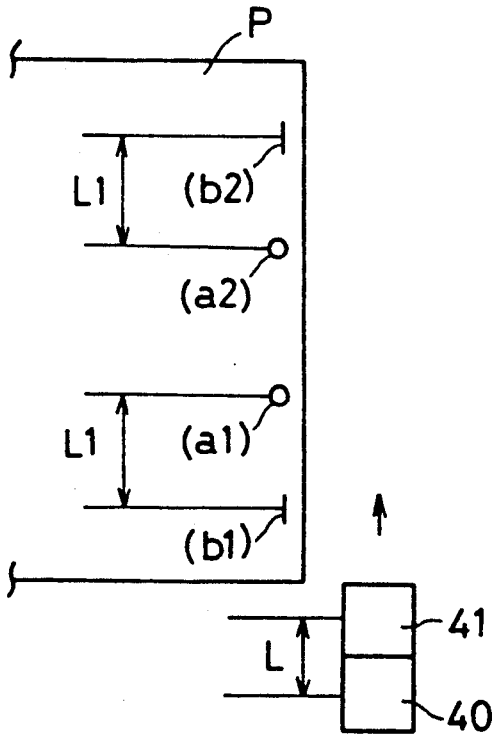
FIGS. 28A and 28B are diagrams showing relationships between a spacing between two adjacent processing positions of the different types and a spacing between a punch and a stapler used in the fifth automatic sheet processing device.
Figure 28B:
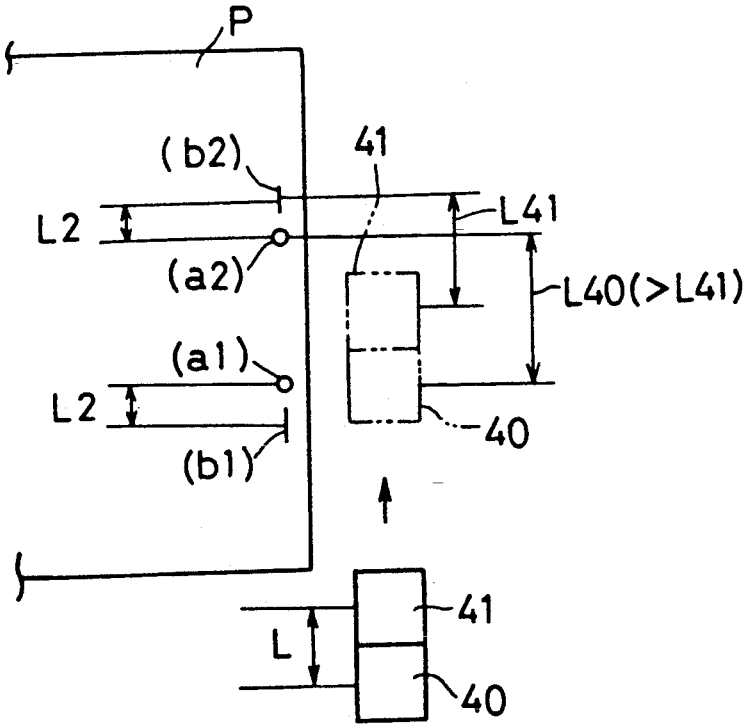
Figure 29:
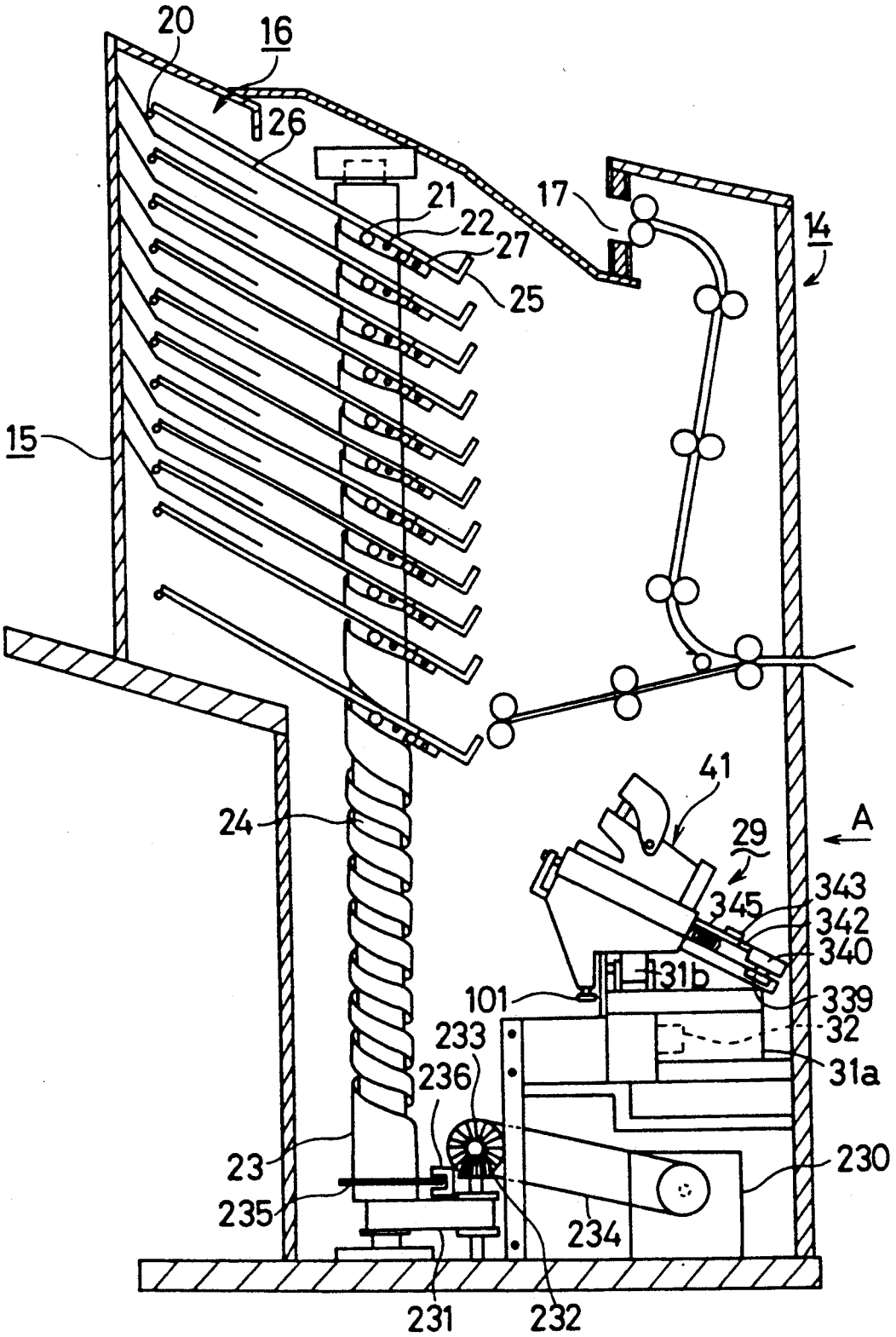
FIG. 29 is a longitudinal sectional view of a sorting unit in which a sixth automatic sheet finishing device of the invention is provided.
Figure 30:
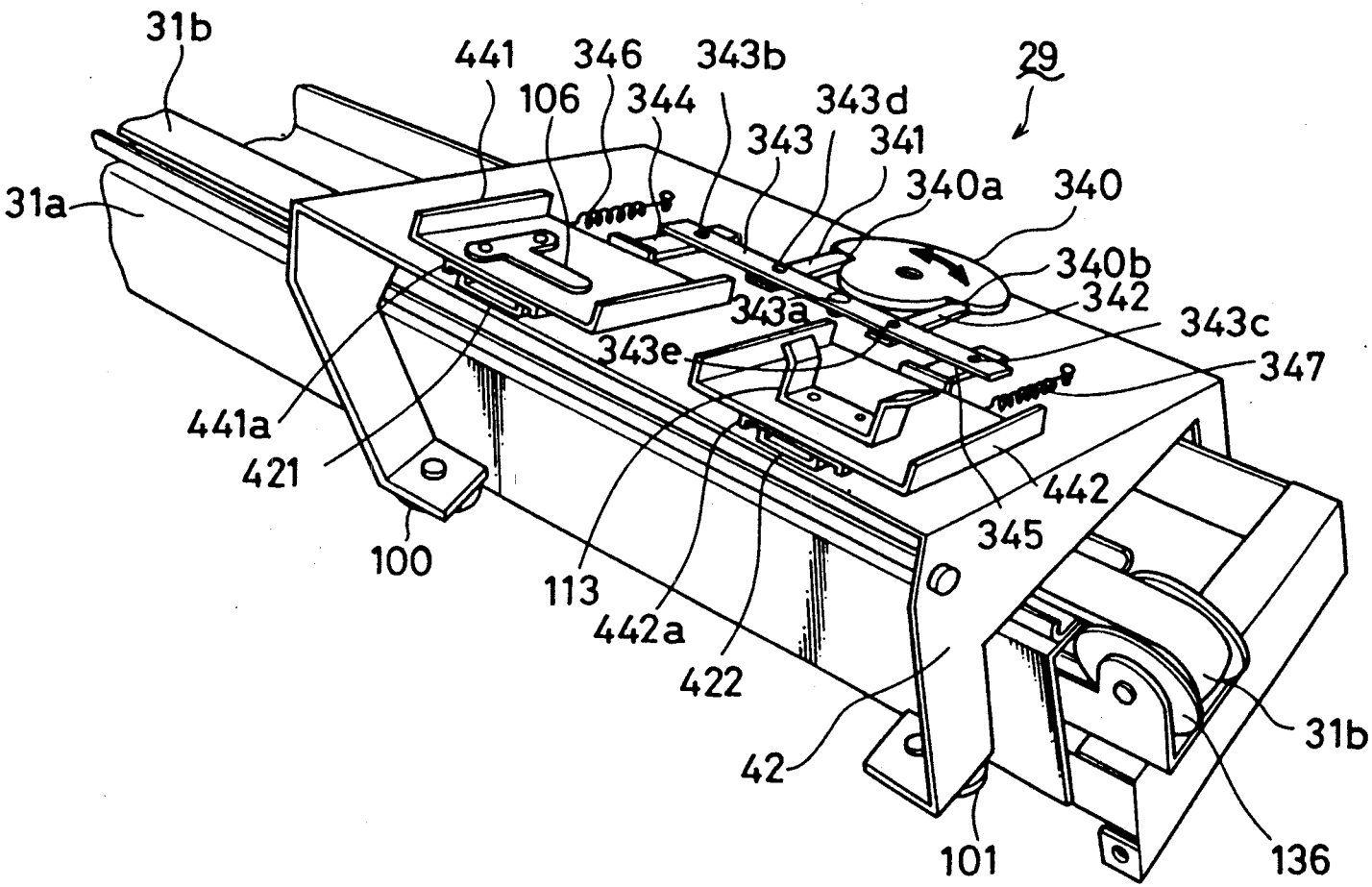
FIG. 30 is a perspective view showing a construction of a support and a drive transmission mechanism of the sixth automatic sheet finishing device, the support not carrying sheet finishers.
Figure 31:
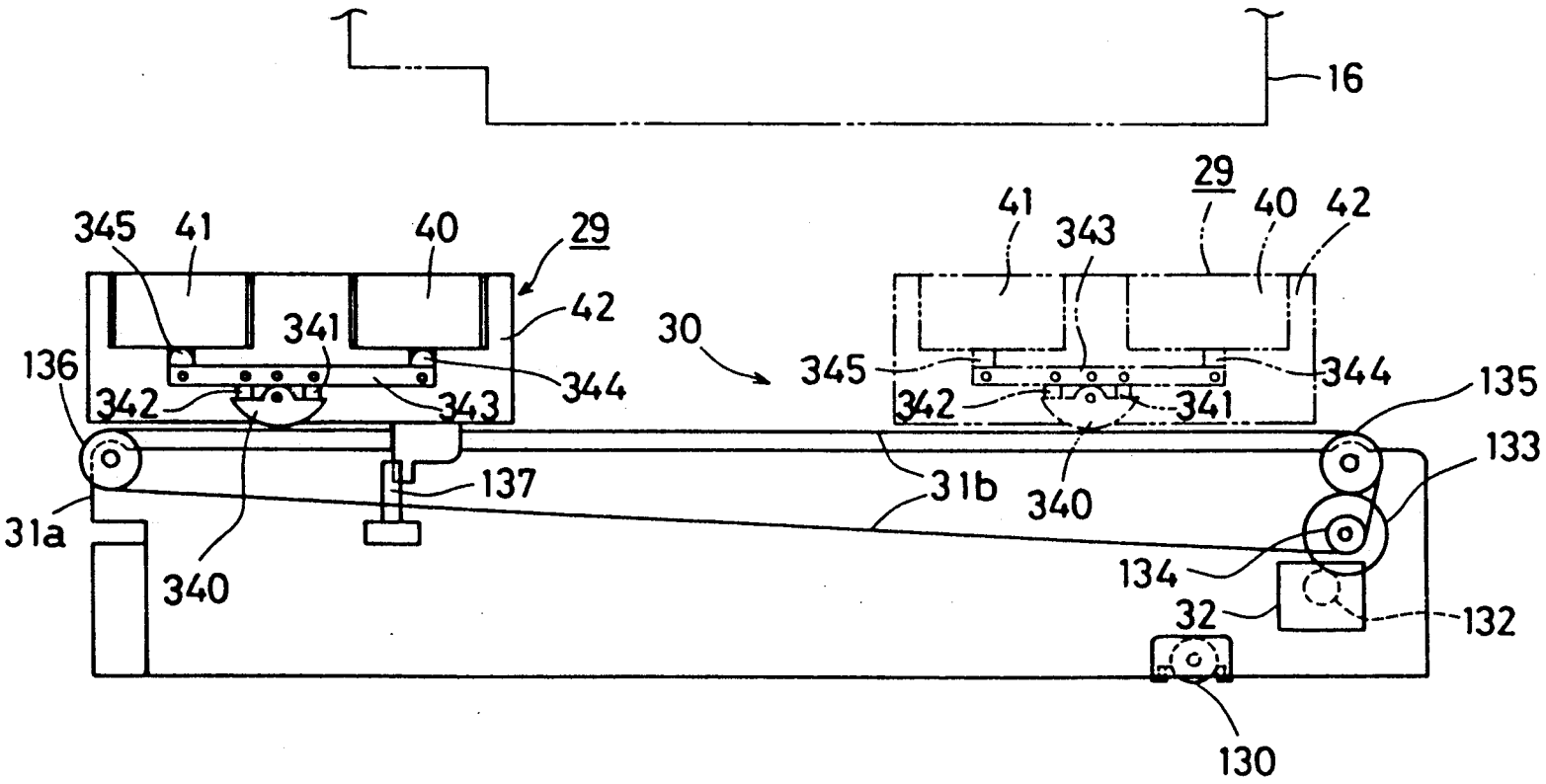
FIG. 31 is an elevational view seen from an arrow direction A in FIG. 29, showing a widthwise movement of the support.

FIGS. 28A and 28B are diagrams showing respective punching positions and stapling positions: first punching positions a1, second punching positions a2, first stapling positions b1, second stapling positions b2.

FIG. 28A shows a case where distances L1 are longer than a distance L. The distance L1 is defined by the first punching position a1 (second punching position a2) and first stapling position b1 (second stapling position b2). The distance L is defined by the punch hole 150*b* of the punch 40 and the anvil of the stapler 41.

On the other hand, FIG. 28B shows a case where distances L2 are shorter than the distance L. The distance L2 is defined by the first punching position a1

(second punching position a2) and first stapling position b1 (second stapling position b2).

In the flow chart shown in FIGS. 27A and 27B, a finishing mode A is a mode in which the finishings are applied in the first stapling position b1, first punching position a1, and second punching position a2 in FIG. 28A.

A finishing mode B is a mode in which the finishings are applied in the first punching position a1, second punching position a2, and second stapling position b2 in FIG. 28A.

A finishing mode C is a mode in which the finishings are applied in the first stapling position b1, first punching position a1, second punching position a2, and second stapling position b2 in FIG. 28A.

A finishing mode D is a mode in which the finishings are applied in the first stapling position b1, first punching position a1, second punching position a2, and second stapling position b2 in FIG. 28B.

A finishing mode E is a mode in which the finishings are applied in the first stapling position b1, first punching position a1, and second punching position a2 in FIG. 28B.

A finishing mode F is a mode in which the finishings are applied in the first punching position a1, second punching position a2, and second stapling position b2 in FIG. 28B.

Upon start of the sheet finishing operation in the second mode, similarly to the first embodiment, a bin tray 16 in an operative position is moved to a retracted position; a holder 86 is moved downwards so as to pressingly hold a copy sheet set P; and a stopper 25 of the bin tray 16 is released.

Subsequently, it is discriminated which finishing mode is selected through a selection key panel 13 in Step S200.

If the finishing mode A is discriminated to have been selected in Step S200, the following operations are executed in Step S201. A support 29 is moved in a widthwise direction of the bin tray 16 from a home position up to a position where a stapler 41 opposes the first stapling position b1. Subsequently, a mount table 44 is moved forwards to set the copy sheet set P in the stapler 41, and then the stapling is applied to the copy sheet set P in the first stapling position b1.

Subsequently, the support 29 is further moved to the right in the drawing of FIG. 28A until the punch 40 reaches the first punching position a1, and the punch 40 punches the copy sheet set P thereat in Step S202. Then, the support 29 is further moved to the right until the punch 40 reaches the second punching position a2, and the punch 40 punches the copy sheet set P thereat in Step S203.

Thereafter, the mount table 44 is moved backwards and the support 29 is moved to the left up to the home position and paused thereat. Then, after the stopper 25, holder 86, and bin tray 16 are returned to original positions thereof, the sheet finishing device waits for the sheet finishing operation for a copy sheet set P placed on the next bin tray 16.

If the finishing mode B is discriminated to have been selected in Step S200, the following operations are executed in Step S204. The support 29 is moved to the right in the widthwise direction of the bin tray 16 from the home position up to a position where the punch 40 opposes the first punching position a1. Subsequently, the mount table 44 is moved forwards so as to set the copy sheet set P in the punch 40, and then the punching is applied to the copy sheet set P in the first punching position a1.

Subsequently, the support 29 is moved further to the right until the punch 40 reaches the second punching position a2, and the punch 40 punches the copy sheet set P thereat in Step S205. Then, the support 29 is moved further to the right until the stapler 41 reaches the second stapling position b2, and the stapler 41 staples the copy sheet set P thereat in Step S206.

If the finishing mode C is discriminated to have been selected in Step S200, the operations in Steps S201 to S203 are executed in Steps S207 to S209. After Step S209, the support 29 is further moved to the right until the stapler 41 reaches the second stapling position b2, and the stapler 41 staples the copy sheet set P thereat in Step S210.

In these ways, in the finishing modes A to C, the sheet finishing operation is sequenced such that the finishing is applied to the copy sheet set P in the processing positions from the closest to the farthest from the home position, and this operation sequence is stored in a storage 201. Accordingly, the sheet finishing operation is executed for the copy sheet set P placed on the bin tray 16 by moving the support 29 only in one direction away from the home position.

Next, there will be described a case where the finishing mode D is discriminated to have been selected in Step S200. In this case, the distance L2 is shorter than the distance L as described above. Accordingly, when the punch 40 is in the first punching position a1 as indicated by phantom line in FIG. 28B, a distance L40 defined by the punch hole 150*b* of the punch 40 and the second punching position a2 is shorter than a distance L41 defined by the anvil of the stapler 41 and the second stapling position b2.

Thus, if the support 29 is moved in such a fashion that the finishing is applied to the copy sheet set P from the closest to the farthest from the home position, the stapler 41 has gone past the second stapling position b2 when the punch 40 reaches the second punching position a2.

More specifically, the support 29 is moved slightly towards the home position after the finishing in the second punching position a2 in order to set the stapler 41 in the second stapling position b2.

The finishing mode D is constructed in view of the above inefficiency. In this mode, firstly, the following operations are executed in Step S212. The support 29 is moved from the home position up to a position where the stapler 41 opposes the first stapling position b1. Then, the mount table 44 is moved forwards so that the copy sheet set P is set in the stapler 41 in the first stapling position b1, and the stapler 41 staples the copy sheet set P thereat.

Subsequently, the support 29 is moved to the right until the punch 40 reaches the first punching position a1, and the punch 40 punches the copy sheet set P thereat in Step S213. Then, the support 29 is further moved to the right until the stapler 41 reaches the second stapling position b2, and the stapler 41 staples the copy sheet set P thereat in Step S214. Thereafter, the support 29 is further moved to the right until the punch 40 reaches the second punching position a2, and the punch 40 punches the copy sheet set P thereat in Step S215.

In the case where the finishing mode E is discriminated to have been selected in Step S200, the following operations are executed in Step S216. The support 29 is moved to the right up to the position where the stapler 41 reaches the first stapling position b1. Then, the mount table 44 is moved forwards so that the copy sheet set P is set in the stapler 41 in the first stapling position b1, and the stapler 41 staples the copy sheet set P thereat.

Subsequently, the support 29 is moved so that the punching and stapling are applied to the copy sheet set P in the first punching position a1 and second punching position a2 in this order in Steps S217 and S218.

In the case where the finishing mode F is discriminated to have been selected in Step S200, the following operations are executed in Step S219. The support 29 is moved to the right up to the position where the punch 40 reaches the first punching position a1. Then, the mount table 44 is moved forwards so that the copy sheet set P is set in the punch 40 in the first punching position a1, and the punch 40 punches the copy sheet set P thereat.

Subsequently, the support 29 is moved so that the punching and stapling are applied to the copy sheet set P in the second stapling position b2 and second punching position a2 in this order in Steps S220 and S221.

As described above, in order to complete the finishing to the copy sheet set P placed on the bin tray 16 while moving the support 29 to the right from the home position, the storage 201 stores such a sequence of finishings that the finishing is applied to the copy sheet set, in principle, from the closest to the farthest from the home position.

However, the following consideration is necessary in the case where a distance between the unreached punching position and stapling position which are closest to the latest finishing position or home position and where neither the punching nor stapling has not yet executed is shorter than the distance between the punch hole 150*b* of the punch 40 and the anvil of the stapler 41. In this case, the storage 201 stores such a sequence of finishings that the finishing is applied first in the unreached finishing position which is closer to the corresponding sheet finisher, i.e. punch 40 or stapler 41, when the last finishing is applied to the copy sheet set P or when the support 29 is in the home position.

The support 29 is moved according to the stored sequence. Thus, all the predetermined finishings can be applied to the copy sheet set P placed on the bin tray 16 while the support 29 is moved only in the forward direction from the home position. Accordingly, the moving distance of the support 29 can be reduced, thereby reducing time required for the sheet finishing operation. Further, the efficiency in finishing sheets can be improved, enabling a higher speed sheet finishing operation.

Although this embodiment is described with respect to the punching operation and stapling operation, the sheet finishing operation in accordance with the invention is not limited to the above. The sheet finished may be a printer, and a plurality of sheet finishers other than the punch and stapler may be provided to apply a plurality of types of finishings to the copy sheet set P. Even in these cases, the sheet finishing device of the invention can be controlled in the similar manner.

Further, the finishing modes stored in the storage 201 are not limited to the aforementioned finishing modes A to F. Various other finishing modes can be stored according the punching positions and stapling positions, and a suitable finishing mode is selectable from these by manipulating the selection key panel 13 or the like.

Moreover, in this embodiment, the sequence of finishings is stored in the storage 201, and the sheet finishing operation is executed according to the stored sequence. However, even in the case where the finishing positions where desired finishings are executed are manually set in desired positions widthwise along the rear end portion of the copy sheet set P by manipulating operation keys, a sequence of finishings can be readily set such that all the finishings are applied to the copy sheet set P while the support is moved only in the forward direction from the home position.

More specifically, in this case, the control unit 200 discriminates which one of the punching positions is closer to the home position and which one of the stapling positions is closer to the home position, and further discriminates which one of the closer punching and stapling positions is closer to the punch 40 or stapler 41 of the support 29 in the home position, causes the support 29 to move so that the punch 40 or stapler 41 first reaches the discriminated closest position. Also, the control unit 200 discriminates which one of the punching positions is closer to the latest finishing position and which one of the stapling positions is closer to the latest finishing position, and further discriminates which one of the closer punching and stapling positions is closer to the punch 40 or stapler 41 of the support 29 in the latest finishing position, causes the support 29 to move so that the punch 40 or stapler 41 first reaches the discriminated closest position.

Next, a sixth sheet finishing device of the invention will be described with reference to FIGS. 29 to 33. It will be appreciated that like or identical numerals designate like or identical parts in the first and sixth embodiments, and description of them is omitted here. This sheet finishing device is provided with another drive transmission mechanism for moving a mount table 44 carrying a sheet finisher 28.

The support 29 is provided with a base table 42 and mount tables 441, 442. On the mount tables 441, 442 are mounted a punch 40 and a stapler 41 respectively. The mount table 442 is arranged closer to a door 14*a* than the mount table 441.

Being mounted on the mount table 442, the stapler 41, which requires more frequent maintenance such as replenishment of staples, is easily accessible merely by opening the door 14*a*, and the punch 40 will not stand as a hindrance in the case where the maintenance for the stapler 41 is carried out. The stapler 41 is often used to staple one corner of a rear end portion of a copy sheet set, though the punch 40 is not. In view of this, the above arrangement is advantageous since the support 29 is not to project outward from one lateral end of a bin tray 16 facing the door 14*a* by the width of the punch 40. As a result, the sheet processing device 30 will take up less space in the sorting unit 14.

Further, guide rails 441*a* and 442*a* are provided on undersides of the mount tables 441 and 442 extending in a lengthwise direction of the mount tables 441 and 442 respectively. Rails 421 and 422 are fixed on an upper surface of a base table 42 extending in a lengthwise direction of the base table 42. The guide rails 441*a* and 442*a* are slidably engaged with the fixed rails 421 and 422, and thereby guiding movement of the mount tables 441 and 442 forwards and backwards in the guide rail extending direction.

A mount table moving mechanism is provided on the upper surface of the base table 42 for moving the mount table 441 and 442 toward and away from the bin tray 16 along the fixed rails 421 and 422. The mount table moving mechanism includes a motor 339, cam member 340, linkage member 341, 342, arm 343, pushers 344, 345, and springs 346 and 347. The cam member 340 having contact surfaces 340*a* and 340*b* is coupled to the motor 339, and is rotated clockwise or counterclockwise by a specified angle by driving the motor 339. According to rotation of the cam member 340, either the contact surface 340*a* or 340*b* comes into contact with one ends of the corresponding linkage member, thereby pushing the same forwards.

The arm 343 has a middle point thereof rotatably supported by a shaft 343*a* serving as a supporting point, and has opposite ends thereof rotatably connected to the pushers 344 and 345 through shafts 343*b* and 343*c*. Further, one end of the linkage members 341 and 342 are respectively rotatably connected to the arm 343 through shafts 343*d* and 343*e* which are located at intermediate points between the shaft 343*a* and 343*b* and between the shafts 343*a* and 343*c*. The shaft 343*d* and 343*e* are equidistant from the shaft 343*a*.

Free ends of the pushers 344 and 345 come into contact with the rear ends of the mount tables 441 and 442, thereby pushing the mount tables 441 and 442 forwards. The springs 346 and 347 has one end thereof connected to the rear ends of the mount tables 441 and 442 and have the other ends thereof fixed to the base table 42 at specified positions. The springs 346 and 347 bias the mount tables 441 and 442 in the backward direction.

Figure 32A:
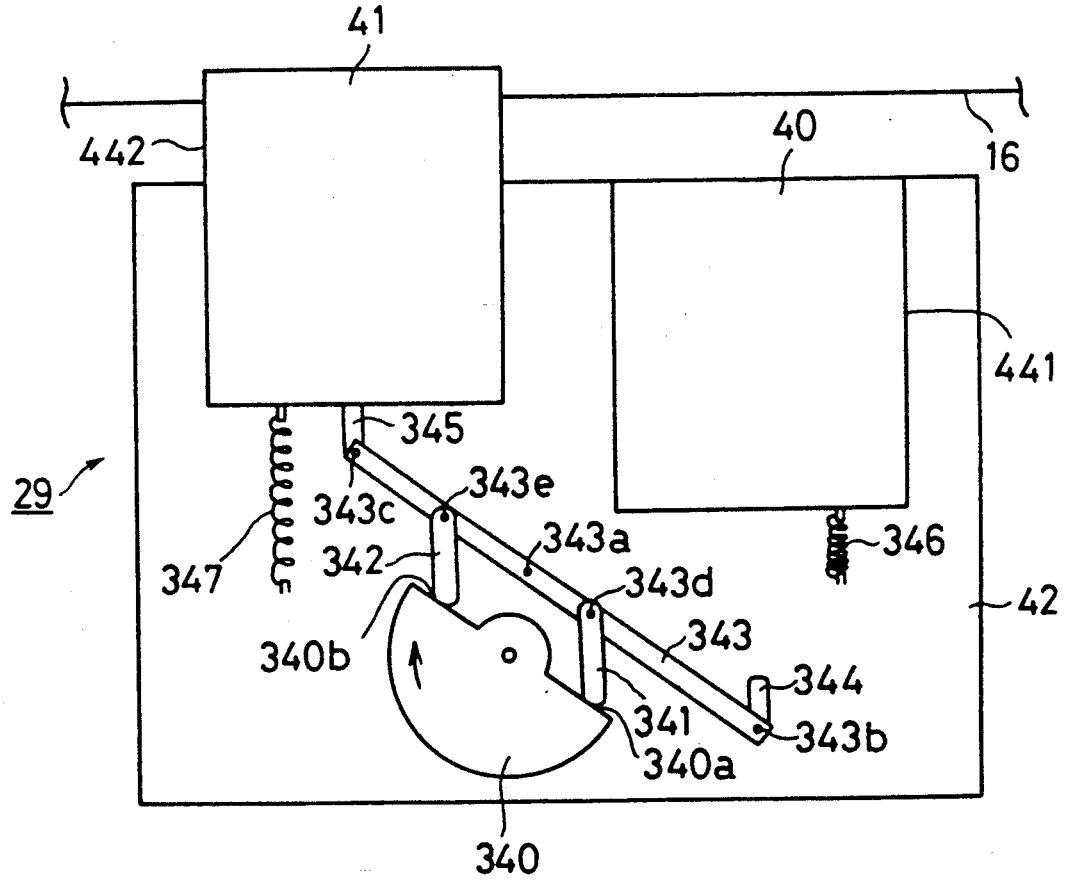
FIG. 32A and 32B is plan views of a support of the sixth automatic sheet finishing device, FIG. 32A showing a state of a mount table moving mechanism where a cam member is rotated clockwise, FIG. 32B showing another state of the mount table moving mechanism where the came member is rotated counterclockwise.

In the case where the cam member 340 is rotated clockwise as shown in FIG. 32A, the linkage member 342 is pushed by the cam member 340 to rotate the arm 343 clockwise. Then, the mount table 442 is pushed forwards by the pusher 345, and thereby the stapler 41 mounted on the table 442 moves toward the bin tray 16.

Figure 32B:
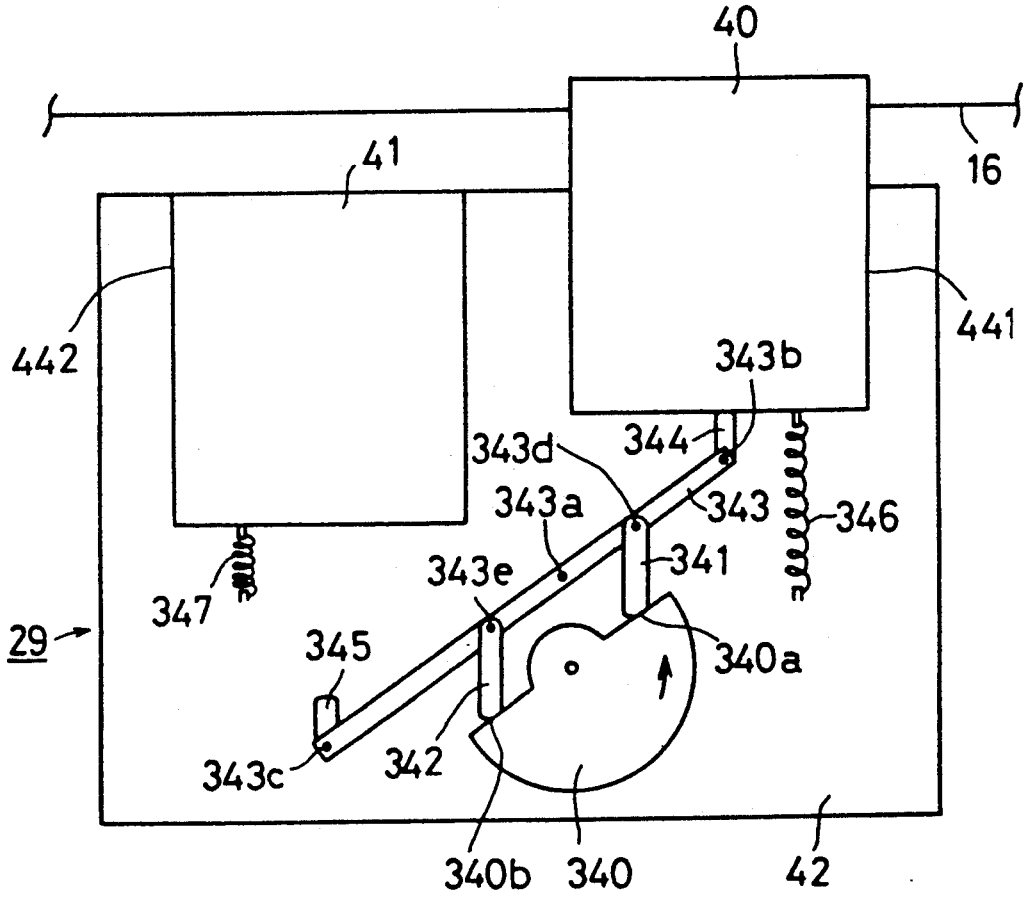

On the other hand, in the case where the cam member 340 is rotated counterclockwise as shown in FIG. 32B, the linkage member 341 is pushed by the cam member 340 to rotate the arm 343 counterclockwise. Then, the mount table 441 is pushed forwards by the pusher 344, and thereby the punch 40 mounted on the table 441 move toward the bin tray 16.

In this way, either the punch 40 or stapler 41 is caused to move toward the bin tray 16 by driving the motor 339 to rotate the cam member 340 clockwise or counterclockwise.

It may be appropriate to connect the linkage members 341 and 342 to the cam member 340 and to connect the pushers 344 and 345 respectively to the rear ends of the mount tables 441 and 442. In this case, the mount table moving mechanism will function properly by suitably adjusting the length of the linkage members 341, 342 and pushers 344, 345.

Next, a procedure of the sheet finishing operation in the sixth embodiment will be described. Since the operation procedure of this embodiment is substantially similar to the one of the first embodiment, description thereof will be given with reference to flow charts shown in FIGS. 14 to 17.

Since a basic procedure of the sheet finishing operation is the same as the one shown in FIG. 14, description thereof is omitted here.

A first mode of this embodiment will be described with reference to FIG. 15. The first mode is identical to the one of the first embodiment except Steps S13 and S15. In this embodiment, in Step S13, the cam member 340 is rotated clockwise to move the mount table 442 forwards until copy sheet set is set on a base of the stapler 41. In step S15, the cam member 340 is rotated counterclockwise to move the mount table 441 backwards, thereby returning the stapler 41 to its retracted position.

Next, a second mode will be described with reference to FIGS. 16 and 17. The second mode is identical to the one of the first embodiment except Steps S25 and S29. In this embodiment, in Step S25, the cam member 340 is rotated counterclockwise to move the mount table 441 forwards until the copy sheet set is set on a table 151 and auxiliary tables 152 of the punch 40. In Step S29, the cam member 340 is rotated clockwise to move the mount table 441 backwards, thereby returning the punch 40 to its retracted position.

As described above, only the necessary sheet finisher out of the punch 40 and the stapler 41 is moved by means of the mount table moving mechanism including the motor 339. This contributes to reduction in burden on the motor 339 or the like used to move the mount tables 441 and 442 and also to reduction in the size of the sheet finishing device.

This embodiment is described with respect to the punching operation, the stapling operation is executable with a similar control. Even in the case where a plurality of types of finishings are applied to the copy sheet set P placed on one bin tray 16, such a sheet finishing operation can be controlled in the similar manner.

Also, this embodiment is described with respect to a case where the finishing is applied to the copy sheet set P in two positions. However, it should be understood that the sheet finishing operation can be controlled similarly to the above even if the finishing is to be applied to the copy sheet set in three or more positions. In addition, the finishing can be applied to the copy sheet set in any desired position at the rear end portion thereof.

Figure 33:
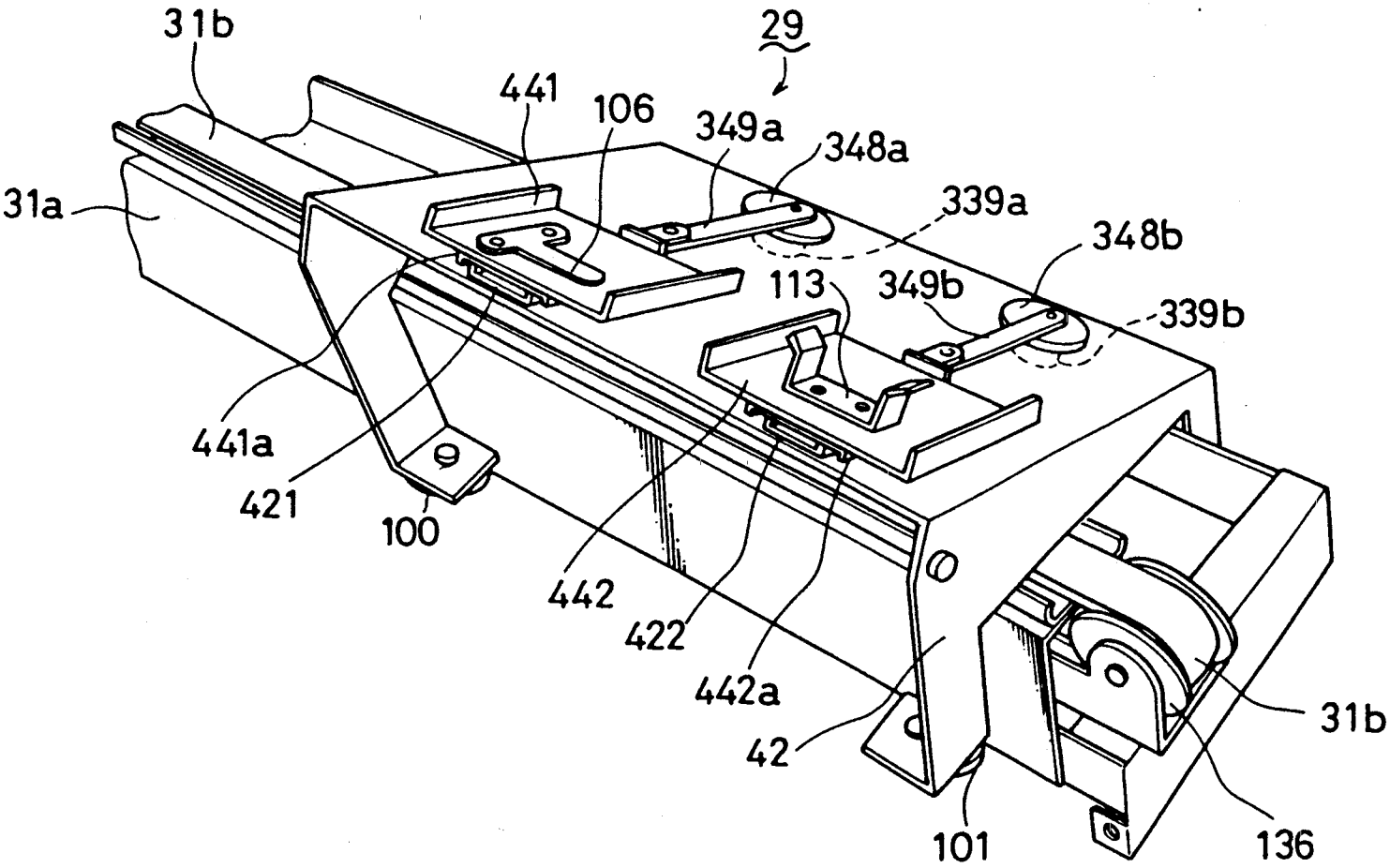
FIG. 33 is a perspective view showing a support and a drive transmission mechanism of the sixth automatic sheet finishing unit, the support not carrying sheet finishers.

Next, a modified mount table moving mechanism is described with reference to FIG. 33. This mount table moving mechanism includes motors 339*a* and 339*b*, discs 348*a* and 348*b*, and linkage members 349*a* and 349*b*. The discs 348*a*, 348*b* are respectively coupled to the motors 339*a*, 339*b*, and drivingly rotated thereby. One end of the linkage members 349*a*, 349*b* are respectively connected to the discs 348*a*, 348*b* in specified peripheral positions thereof, and the other ends thereof are connected to rear ends of the mount tables 441, 442. In this arrangement, the linkage members 349*a*, 349*b* are designed to convert the rotational forces of the discs 348*a*, 348*b* into reciprocal movement of the mount tables 441, 442 respectively.

When the disc 348*a* is rotated by 180 degrees by driving the motor 339*a*, the linkage member 349*a* is pushed forwards, thereby pushing the mount table 441 forwards. As a result, the punch 40 mounted on the mount table 441 is moved forwards toward the bin tray 16.

On the other hand, when the disc 348*b* is rotated by 180 degrees by driving the motor 339*b*, the linkage member 349*b* is pushed forwards, thereby pushing the mount table 442 forwards. As a result, the stapler 41 mounted on the mount table 442 is moved forwards toward the bin tray 16.

Since the mount tables 441, 442 are independently driven in this mount table moving mechanism, it is both possible to move only either one of the punch 40 and stapler 41 forwards, and to move the punch 40 and stapler 41 simultaneously.

Accordingly, in the case where both punching and stapling operations are applied to the copy sheet set P, the punch 40 and stapler 41 can be moved forwards and backwards simultaneously unlike the former mount table moving mechanism. Therefore, the sheet finishing operation can be executed for a reduced time.

In the forgoing embodiments, it is possible to set the home position of the support 29 near the side wall of the sorting unit 14 opposing the wall having the door 14*a*. In this case, another door may be provided on that side wall so as to facilitate maintenance, inspection, and like operation for the sheet finishers.

Further, in the foregoing embodiments, the punch 40 and stapler 41 are used as exemplary sheet finishers 28. However, in accordance with the invention, the sheet finishers 28 are not limited to those. Any device including a printer may be a sheet finisher, provided that it applies a finishing to a sheet or set of sheets. Such devices can be made readily replaceable by constructing a mounting structure thereof similar to those of the punch 40 and stapler 41.

Moreover, in the foregoing embodiments, the rotating amount of the motor 43 or 339 is controlled to move the mount tables 44, or 441 and 442 so as to properly set the set of copy sheets in the sheet finisher(s) 28. However, a way of controlling movement of the sheet finisher(s) 28 is not limited to this. For instance, a sheet sensor switch for detecting the presence of the sheet(s) may be provided in the vicinity of a portion of the sheet finisher 28 where the actual finishing is carried out. The sensor switch sends an ON-signal or OFF signal based on the detection result. The motor 43 or 339 is on-off controlled in accordance with the signal from the sensor switch, so as to set the sheet finisher 28 in the proper finishing position. Provision of the sensor switch is advantageous in preventing an idle operation of the sheet finisher 28. This is because, in the case where the sheets are taken out of the bin trays 16 during an intermediate time between the sorting operation and sheet finishing, the sensor switch is kept in the OFF state and therefore the sheet finishing operation is not to be started.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An automatic sheet finishing device comprising:

a single base member for supporting a plurality of sheet finishers, the plurality of sheet finishers being operable to apply sheet finishings to a sheet having a length and a width, at specified portions along a widthwise direction of the sheet respectively, the plurality of sheet finishers being arranged in the widthwise direction of the sheet;

main moving means for moving the single base member in the widthwise direction of the sheet, said main moving means being connected with the single base member;

storage means for storing sheet finishing data;

calculator means for calculating from the sheet finishing data stored in the storage means a sequence of finishing positions for the plurality of sheet finishers at which the plurality of sheet finishers are to be temporarily stopped to carry out the sheet finishings along the widthwise direction of the sheet; and control means for controlling the main moving means so as to move the plurality of sheet finishers to the respective calculated finishing positions along the widthwise direction of the sheet.

2. An automatic sheet finishing device as defined in claim 1 wherein the plurality of sheet finishers are detachably supported on the single base member.

3. An automatic sheet finishing device as defined in claim 1 further comprising secondary moving means, provided on the single base member, for moving the plurality of sheet finishers in a lengthwise direction of the sheet integrally with each other.

4. An automatic sheet finishing device as defined in claim 1 further comprising secondary moving means, provided on the single base member, for moving the plurality of sheet finishers in a lengthwise direction of the sheet independently of each other.

5. An automatic sheet finishing device as defined in claim 1 further comprising detector means for detecting positions of the plurality of sheet finishers supported on the single base member, so that the calculator means calculates the sequence of finishing positions.

6. An automatic sheet finishing device as defined in claim 1 further comprising:

a frame attached on a sorting unit including an opening formed in a forward portion thereof and a bin tray having a rearward end and a forward end;

a support member supported on the frame and withdrawable from the sorting unit through the forward opening of the sorting unit; and wherein the single base member is returnable to a home position where one of the plurality of sheet finishers is outside either end of the bin tray.

7. An automatic sheet finishing device as defined in claim 6 wherein:

the support member has a slide member; and the frame has a slide surface over which the support member is slidable and is formed with a slot engageable with the slide member at a position where all the plurality of sheet finishers are outside either end of the bin tray when withdrawing the support member.

8. An automatic sheet finishing device as defined in claim 7 wherein the plurality of sheet finishers are detachably mounted on the single base member, a sheet finisher having a highest frequency of detachment being mounted on a portion closest to the forward opening of the sorting unit.

9. An automatic sheet finishing device comprising:

sheet punch means for making a hole in a sheet having a specified length and width;

moving means for supporting the sheet punch means and for moving the sheet punch means along a side of the sheet; and control means including:

storage means for storing sheet finishing data;

calculator means for calculating a punching position from the sheet finishing data; and first control portion means for controlling the moving means so as to move the sheet punch means to the calculated punching position;

container means for containing waste produced by the sheet punch means; and leveling means for leveling a deposit of waste in the container means while the sheet punch means is being moved, said leveling means being attached to the sheet punch means and having a tip positioned in the container means.

10. An automatic sheet finishing device for use with a sorting unit for sorting sheets discharged from an image forming apparatus and having a specified length and width, comprising:

a support member mounted on the sorting unit and withdrawable from the sorting unit in a widthwise direction of the sheet;

a base member movably mounted on the support member;

base member moving means supported on the support member for moving the base member in a widthwise range of movement in a widthwise direction of the sheet;

a mount member movably mounted on the base member;

mount member moving means supported on the base member for moving the mount member in a lengthwise direction of the sheet in a lengthwise range of movement smaller than the widthwise range of movement by the base member moving means;

sheet finisher means mounted on the mount member for finishing the sheet;

storage means for storing sheet finishing data;

calculator means for calculating a finishing position from the sheet finishing data; and control means for controlling the base member moving means and the mount member moving means to move the sheet finisher means to the calculated finishing position.

11. An automatic sheet finishing device as defined in claim 10 wherein the sheet finisher means is a punch for making a hole in the sheet.

12. An automatic sheet finishing device as defined in claim 11 further comprising container means for containing waste produced by the sheet finisher means.

13. An automatic sheet finishing device as defined in claim 12 further comprising introducing means, attached to the sheet finisher means, for introducing the waste to the container means.

14. An automatic sheet finishing device as defined in claim 10 wherein the sheet finisher means is a stapler.

15. An automatic sheet finishing device as defined in claim 10 wherein the sheet finisher means is detachably mountable on the mount member.

16. An automatic sheet finishing device as defined in claim 10 wherein the support member is detachably mountable on the sorting unit.

17. An automatic sheet finishing device as defined in claim 10 wherein the support member has a slide member; and further comprising frame means, attached on the sorting unit, for supporting the support member, the frame means having a slide surface over which the support member is slidable, the slide surface being formed with a slot engageable with the slide member for temporarily stopping sliding of the support member.

18. An automatic sheet finishing device as defined in claim 10 wherein the base member moving means includes:

an endless belt provided on the support member in the widthwise direction of the sheet, the base member fixedly attached on a portion of the endless belt; and motor means, provided on one end of the endless belt, for driving the endless belt.

19. An automatic sheet finishing device comprising:

sheet finisher means for applying a sheet finishing to a sheet having a specified length and width;

moving means for supporting the sheet finisher means and for reciprocatingly moving the sheet finishing means along a side of the sheet between a first limit and a second limit; and control means including: storage means for storing sheet finishing data;

calculator means for calculating a finishing position from the sheet finishing data;

first control portion means for controlling the moving means so as to move the sheet finisher means to the calculated finishing position;

discriminator means for discriminating which is shorter of a first distance between the first limit and a last stopping position of the sheet finisher means and a second distance between the second limit and the last stopping position; and second control portion means, responsive to the discriminator means, for controlling the moving means so as to move the sheet finisher means to the nearer one of the first and second limits after the sheet finishing is completed.

20. An automatic sheet finishing device comprising:

sheet finisher means for applying a sheet finishing to a sheet having a specified length and width;

moving means for supporting the sheet finisher means and for moving the sheet finisher means along a side of the sheet;

mount means for mounting the moving means on a sorting unit of an image forming apparatus, wherein the sorting unit includes:

a plurality of bin trays movable in a vertical direction for holding sheets; and bin tray moving means for moving the plurality of bin trays in the vertical direction; and control means including:

storage means for storing sheet finishing data specifying a plurality of finishing positions for each sheet on each bin tray;

calculator means for calculating a finishing position from the sheet finishing data;

first control portion means for controlling the moving means so as to move the sheet finisher means to the calculated finishing position; and second control portion means for controlling the moving means so as to permit the sheet finisher means to stay at a last finishing position for one bin tray after the sheet finishing for the one bin tray is finished, and for moving the sheet finisher means to the one of the plurality of finishing positions for the next bin tray which is closest to the last finishing position for the one bin tray.

21. An automatic sheet finishing device comprising:

sheet finisher means for applying a sheet processing to a sheet having a specified length and width;

moving means for supporting the sheet finisher means and for moving the sheet finisher means along a side of the sheet;

mount means for mounting the moving means on a sorting unit of an image forming apparatus, wherein the sorting unit includes a plurality of bin trays movable in a vertical direction for holding sheets, each bin tray being movable in a direction inclined at a predetermined angle with respect to the vertical direction;

the moving means includes:

a base member movable in a widthwise direction of the bin tray;

first moving mechanism means for moving the base member in the widthwise direction of the bin tray;

mount member means, movable over the base member in a lengthwise direction of the bin tray, for supporting the sheet finisher means;

guide means, provided on the base member, for guiding the mount member means so as to move in a direction inclined at the same angle as the bin tray being moved; and second moving means for moving the mount member means along the guide means; and control means including:

storage means for storing sheet finishing data;

calculator means for calculating a finishing position from the sheet finishing data; and first control portion means for controlling the moving means so as to move the sheet finisher means to the calculated finishing position.

* * * * *